US010381018B2

(12) United States Patent
Yamamoto et al.

(10) Patent No.: US 10,381,018 B2
(45) **Date of Patent: *Aug. 13, 2019**

(54) SIGNAL PROCESSING APPARATUS AND SIGNAL PROCESSING METHOD, ENCODER AND ENCODING METHOD, DECODER AND DECODING METHOD, AND PROGRAM

(71) Applicant: Sony Corporation, Tokyo (JP)

(72) Inventors: Yuki Yamamoto, Tokyo (JP); Toru Chinen, Kanagawa (JP); Hiroyuki Honma, Chiba (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/046,070

(22) Filed: Jul. 26, 2018

(65) Prior Publication Data

US 2018/0330746 A1 Nov. 15, 2018

Related U.S. Application Data

(63) Continuation of application No. 15/584,447, filed on May 2, 2017, now Pat. No. 10,224,054, which is a (Continued)

(51) Int. Cl.
*G10L 19/02* (2013.01)
*G10L 19/16* (2013.01)

(Continued)

(52) U.S. Cl.
CPC ..... *G10L 21/0388* (2013.01); *G10L 19/0204* (2013.01); *G10L 19/0208* (2013.01); *G10L 19/167* (2013.01); *G10L 21/038* (2013.01)

(58) Field of Classification Search
CPC ..... G10L 21/0388; G10L 21/038; G10L 19/0204; G10L 19/167; G10L 19/0208

(Continued)

(56) References Cited

U.S. PATENT DOCUMENTS 4,628,529 A 12/1986 Borth et al.
4,817,151 A 3/1989 Bod et al.

(Continued)

FOREIGN PATENT DOCUMENTS

CA 2775387 A1 4/2011
CN 1328707 C 7/2007

(Continued)

OTHER PUBLICATIONS

Korean Office Action dated Nov. 21, 2018 in connection with Korean Application No. 10-2018-7005649 and English translation thereof.

(Continued)

*Primary Examiner* — Yogeshkumar Patel
(74) *Attorney, Agent, or Firm* — Wolf, Greenfield & Sacks, P.C.

(57) ABSTRACT

Methods and apparatus for performing signal processing. The signal processing comprises demultiplexing input encoded data into data including information for a segment including frames and coefficient information for a coefficient selected in the frames of the segment, and low band encoded data, decoding the low band encoded data to produce a low band signal, selecting a coefficient of a frame to be processed from a plurality of the coefficients based on the data, calculating a high band sub-band power of a high band sub-band signal of each sub-band constituting a high band signal of the frame to be processed based on a low band sub-band signal of each sub-band constituting the low band signal of the frame to be processed and the selected coefficient, and producing the high band signal of the frame to be processed based on the high band sub-band power and the low band sub-band signal.

2 Claims, 51 Drawing Sheets

Related U.S. Application Data continuation of application No. 15/003,960, filed on Jan. 22, 2016, now Pat. No. 9,679,580, which is a continuation of application No. 13/639,325, filed as application No. PCT/JP2011/059028 on Apr. 11, 2011, now Pat. No. 9,406,312.

(51) Int. Cl.
*G10L 21/038* (2013.01)
*G10L 21/0388* (2013.01)

(58) Field of Classification Search
USPC ..... 381/22, 23
See application file for complete search history.

(56) References Cited

U.S. PATENT DOCUMENTS 5,664,055 A 9/1997 Kroon
5,687,157 A 11/1997 Imai et al.
6,022,222 A 2/2000 Guinan
6,073,100 A 6/2000 Goodridge, Jr.
6,415,251 B1 7/2002 Oikawa et al.
6,708,145 B1 3/2004 Liljeryd et al.
6,782,366 B1 8/2004 Huang et al.
6,829,360 B1 12/2004 Iwata et al.
6,895,375 B2 5/2005 Malah et al.
7,003,451 B2 2/2006 Kjorling et al.
7,069,212 B2 6/2006 Tanaka et al.
7,139,702 B2 11/2006 Tsushima et al.
7,242,710 B2 7/2007 Ekstrand
7,246,065 B2 7/2007 Tanaka et al.
7,283,955 B2 10/2007 Liljeryd et al.
7,318,035 B2 1/2008 Andersen et al.
7,330,812 B2 2/2008 Ding
7,337,118 B2 2/2008 Davidson et al.
7,447,631 B2 11/2008 Truman et al.
7,899,676 B2 3/2011 Honma et al.
7,941,315 B2 5/2011 Matsuo
7,974,847 B2 7/2011 Kjoerling et al.
7,983,424 B2 7/2011 Kjorling et al.
7,991,621 B2 8/2011 Oh et al.
8,014,534 B2 9/2011 Henn et al.
8,019,614 B2 9/2011 Takagi et al.
8,032,387 B2 10/2011 Davidson et al.
8,050,933 B2 11/2011 Davidson et al.
8,063,809 B2 11/2011 Liu et al.
8,078,474 B2 12/2011 Vos et al.
8,144,804 B2 3/2012 Chinen et al.
8,145,475 B2 3/2012 Kjoerling et al.
8,244,524 B2 8/2012 Shirakawa et al.
8,260,609 B2 9/2012 Rajendran et al.
8,321,229 B2 11/2012 Choo et al.
8,332,210 B2 12/2012 Nilsson et al.
8,340,213 B2 12/2012 Chinen et al.
8,346,566 B2 1/2013 Kjoerling et al.
8,352,249 B2 1/2013 Chong et al.
8,364,474 B2 1/2013 Honma et al.
8,370,133 B2 2/2013 Taleb et al.
8,386,243 B2 2/2013 Nilsson et al.
8,407,046 B2 3/2013 Gao
8,423,371 B2 4/2013 Yamanashi et al.
8,433,582 B2 4/2013 Ramabadran et al.
8,463,599 B2 6/2013 Ramabadran et al.
8,463,602 B2 6/2013 Oshikiri
8,484,036 B2 7/2013 Vos
8,498,344 B2 7/2013 Wilson et al.
8,527,283 B2 9/2013 Jasiuk et al.
8,560,330 B2 10/2013 Gao
8,688,441 B2 4/2014 Ramabadran et al.
8,793,126 B2 7/2014 Gao
8,818,541 B2 8/2014 Villemoes et al.
8,949,119 B2 2/2015 Yamamoto et al.
8,972,248 B2 3/2015 Otani et al.
9,047,875 B2 6/2015 Gao
9,177,563 B2 11/2015 Yamamoto et al.
9,208,795 B2 12/2015 Yamamoto et al.
9,294,062 B2 3/2016 Hatanaka et al.
9,361,900 B2 6/2016 Yamamoto et al.
9,390,717 B2 7/2016 Yamamoto et al.
9,406,306 B2 8/2016 Yamamoto et al.
9,406,312 B2 8/2016 Yamamoto et al.
9,437,197 B2 9/2016 Honma et al.
9,437,198 B2 9/2016 Hatanaka et al.
9,536,542 B2 1/2017 Yamamoto et al.
9,542,952 B2 1/2017 Hatanaka et al.
9,583,112 B2 2/2017 Yamamoto et al.
9,659,573 B2 5/2017 Yamamoto et al.
9,679,580 B2 6/2017 Yamamoto et al.
9,691,410 B2 6/2017 Yamamoto et al.
9,767,814 B2 9/2017 Yamamoto et al.
9,767,824 B2 9/2017 Yamamoto et al.
9,842,603 B2 12/2017 Yamamoto et al.
9,875,746 B2 1/2018 Honma et al.
10,083,700 B2 9/2018 Hatanaka et al.
10,140,995 B2 11/2018 Hatanaka et al.
10,224,054 B2 3/2019 Yamamoto et al.
10,229,690 B2 3/2019 Yamamoto et al.
10,236,015 B2 3/2019 Yamamoto et al.
2002/0128835 A1 9/2002 Iso
2003/0033142 A1 2/2003 Murashima
2003/0093271 A1* 5/2003 Tsushima ..... G10L 19/0208 704/230
2003/0093278 A1 5/2003 Malah
2003/0187663 A1 10/2003 Truman et al.
2003/0233234 A1 12/2003 Truman et al.
2004/0028244 A1 2/2004 Tsushima et al.
2005/0004793 A1 1/2005 Ojala et al.
2005/0060146 A1 3/2005 Oh
2005/0096917 A1 5/2005 Kjorling et al.
2005/0143985 A1 6/2005 Sung et al.
2005/0171785 A1 8/2005 Nomura et al.
2005/0267763 A1 12/2005 Ojanpera
2006/0031075 A1 2/2006 Oh et al.
2006/0039682 A1 2/2006 Chen et al.
2006/0106620 A1 5/2006 Thompson et al.
2006/0136199 A1 6/2006 Nongpiur et al.
2006/0251178 A1 11/2006 Oshikiri
2006/0271356 A1 11/2006 Vos
2007/0005351 A1 1/2007 Sathyendra et al.
2007/0040709 A1 2/2007 Sung et al.
2007/0071116 A1 3/2007 Oshikiri
2007/0088541 A1 4/2007 Vos et al.
2007/0150267 A1 6/2007 Honma et al.
2007/0165869 A1 7/2007 Ojanpera
2007/0174063 A1 7/2007 Mehrotra et al.
2007/0219785 A1 9/2007 Gao
2007/0282599 A1 12/2007 Choo et al.
2007/0296614 A1 12/2007 Lee et al.
2007/0299656 A1 12/2007 Son et al.
2008/0027733 A1 1/2008 Oshikiri et al.
2008/0056511 A1 3/2008 Zhang et al.
2008/0097751 A1 4/2008 Tsuchinaga et al.
2008/0120118 A1 5/2008 Choo et al.
2008/0129350 A1 6/2008 Mitsufuji et al.
2008/0140425 A1 6/2008 Shimada
2008/0219344 A1 9/2008 Suzuki et al.
2008/0253587 A1 10/2008 Une
2008/0262835 A1 10/2008 Oshikiri
2008/0263285 A1 10/2008 Sharma et al.
2008/0270125 A1 10/2008 Choo et al.
2009/0048846 A1 2/2009 Smaragdis et al.
2009/0132238 A1 5/2009 Sudhakar
2009/0157413 A1 6/2009 Oshikiri
2009/0171673 A1 7/2009 Yamanashi et al.
2009/0192792 A1 7/2009 Lee et al.
2009/0228284 A1 9/2009 Moon et al.
2009/0234657 A1 9/2009 Takagi et al.
2009/0248407 A1 10/2009 Oshikiri
2009/0265167 A1 10/2009 Ehara et al.
2009/0271204 A1 10/2009 Tammi
2009/0281811 A1 11/2009 Oshikiri et al.
2010/0017198 A1 1/2010 Yamanashi et al.
2010/0063802 A1 3/2010 Gao
2010/0063812 A1 3/2010 Gao

(56) References Cited

U.S. PATENT DOCUMENTS

2010/0083344 A1 4/2010 Schildbach et al.
2010/0106494 A1 4/2010 Honma et al.
2010/0106509 A1 4/2010 Shimada
2010/0161323 A1 6/2010 Oshikiri
2010/0179991 A1 7/2010 Lorch et al.
2010/0198587 A1 8/2010 Ramabadran et al.
2010/0198588 A1 8/2010 Sudo et al.
2010/0217607 A1* 8/2010 Neuendorf ..... G10L 19/20 704/500
2010/0222907 A1 9/2010 Hashimoto
2010/0226498 A1 9/2010 Kino et al.
2010/0228541 A1 9/2010 Oshikiri
2010/0228557 A1 9/2010 Chen et al.
2010/0241437 A1 9/2010 Taleb et al.
2010/0280833 A1 11/2010 Yamanashi et al.
2010/0286990 A1 11/2010 Biswas et al.
2010/0305956 A1 12/2010 Oh et al.
2010/0318350 A1 12/2010 Endo et al.
2011/0046965 A1 2/2011 Taleb et al.
2011/0054911 A1 3/2011 Baumgarte et al.
2011/0075855 A1 3/2011 Oh et al.
2011/0106529 A1 5/2011 Disch
2011/0112845 A1 5/2011 Jasiuk et al.
2011/0137643 A1 6/2011 Yamanashi et al.
2011/0137650 A1 6/2011 Ljolje
2011/0137659 A1 6/2011 Honma et al.
2011/0153318 A1 6/2011 Rossello et al.
2011/0170711 A1 7/2011 Rettelbach et al.
2011/0173006 A1 7/2011 Nagel et al.
2011/0178807 A1 7/2011 Yang et al.
2011/0222630 A1 9/2011 Suzuki et al.
2011/0264454 A1 10/2011 Ullberg et al.
2011/0282675 A1 11/2011 Nagel et al.
2011/0305352 A1 12/2011 Villemoes et al.
2011/0307248 A1 12/2011 Yamanashi et al.
2012/0010880 A1 1/2012 Nagel et al.
2012/0016667 A1 1/2012 Gao
2012/0016668 A1 1/2012 Gao
2012/0057711 A1 3/2012 Makino et al.
2012/0226505 A1 9/2012 Lin et al.
2012/0243526 A1 9/2012 Yamamoto et al.
2012/0310654 A1 12/2012 Riedmiller et al.
2012/0328124 A1 12/2012 Kjoerling
2013/0028427 A1 1/2013 Yamamoto et al.
2013/0030818 A1 1/2013 Yamamoto et al.
2013/0124214 A1 5/2013 Yamamoto et al.
2013/0202118 A1 8/2013 Yamamoto et al.
2013/0208902 A1 8/2013 Yamamoto et al.
2013/0218577 A1 8/2013 Taleb et al.
2013/0226598 A1 8/2013 Laaksonen et al.
2013/0275142 A1 10/2013 Hatanaka et al.
2014/0006037 A1 1/2014 Honma et al.
2014/0046658 A1 2/2014 Grancharov et al.
2014/0156289 A1 6/2014 Hatanaka et al.
2014/0172433 A2 6/2014 Honma et al.
2014/0180682 A1 6/2014 Shi et al.
2014/0200899 A1 7/2014 Yamamoto et al.
2014/0200900 A1 7/2014 Yamamoto et al.
2014/0205101 A1 7/2014 Yamamoto et al.
2014/0205111 A1 7/2014 Hatanaka et al.
2014/0211948 A1 7/2014 Hatanaka et al.
2014/0214432 A1 7/2014 Hatanaka et al.
2014/0214433 A1 7/2014 Hatanaka et al.
2014/0222434 A1 8/2014 Nagel et al.
2014/0226822 A1 8/2014 Endegard et al.
2015/0051904 A1 2/2015 Kikuiri et al.
2015/0088528 A1 3/2015 Toguri et al.
2015/0120307 A1 4/2015 Yamamoto et al.
2015/0243295 A1 8/2015 Truman et al.
2016/0012829 A1 1/2016 Yamamoto et al.
2016/0019911 A1 1/2016 Yamamoto et al.
2016/0140982 A1 5/2016 Yamamoto et al.
2016/0225376 A1 8/2016 Honma et al.
2016/0322057 A1 11/2016 Yamamoto et al.
2016/0343380 A1 11/2016 Hatanaka et al.
2017/0011749 A1 1/2017 Kuech et al.
2017/0076737 A1 3/2017 Yamamoto et al.
2017/0148452 A1 5/2017 Hatanaka et al.
2017/0229139 A1 8/2017 Yamamoto et al.
2017/0236530 A1 8/2017 Yamamoto et al.
2017/0337928 A1 11/2017 Yamamoto et al.
2017/0352365 A1 12/2017 Yamamoto et al.
2018/0197555 A1 7/2018 Yamamoto et al.

FOREIGN PATENT DOCUMENTS

CN 1992533 A 7/2007
CN 101083076 A 12/2007
CN 101178898 A 5/2008
CN 101183527 A 5/2008
CN 101548318 A 9/2009
CN 101853663 A 10/2010
CN 101896968 A 11/2010
EP 1 439 524 A1 7/2004
EP 1921610 A2 5/2008
EP 2019391 A2 1/2009
EP 2317509 A1 5/2011
EP 2317509 A1 * 5/2011 ..... G10L 21/038
EP 2472512 A1 7/2012
JP 3-254223 A 11/1991
JP 08-008933 A 1/1996
JP 08-030295 A 2/1996
JP 08-123484 A 5/1996
JP 10-020888 A 1/1998
JP 11-168622 A 6/1999
JP 2001-134287 A1 5/2001
JP 2001-521648 A 11/2001
JP 2002-536679 A 10/2002
JP 2002-373000 A 12/2002
JP 2003-514267 A 4/2003
JP 2003-216190 A 7/2003
JP 2003-255973 A 9/2003
JP 2003-255998 A 9/2003
JP 2003-316394 A 11/2003
JP 2004-101720 A 4/2004
JP 2004-521394 A 7/2004
JP 2004-258603 A 9/2004
JP 2005-520219 A 7/2005
JP 2005-521907 A 7/2005
JP 2006-048043 A 2/2006
JP 2007-017908 A 1/2007
JP 2007-171821 A 7/2007
JP 2007-316254 A 12/2007
JP 2007-333785 A 12/2007
JP 2008-107415 A 5/2008
JP 2008-139844 A 6/2008
JP 2008139844 A * 6/2008
JP 2008-158496 A 7/2008
JP 2008-224902 9/2008
JP 2008-261978 A 10/2008
JP 2009-116275 A1 5/2009
JP 2009-116371 A 5/2009
JP 2009-134260 A 6/2009
JP 2010-020251 A 1/2010
JP 2010-079275 A 4/2010
JP 2010-526331 A 7/2010
JP 2010-212760 A 9/2010
JP 2012-504260 A 2/2012
JP 2013-015633 A 1/2013
JP 2016-006540 A 1/2016
KR 10-2006-0060928 A 6/2006
KR 10-2006-0085118 A 7/2006
KR 10-2007-0083997 A 8/2007
KR 10-2007-0118174 A 12/2007
KR 10-1835156 B1 3/2018
WO WO 2004/010415 A1 1/2004
WO WO 2004/027368 A1 4/2004
WO WO 2005/111568 A1 11/2005
WO WO 2006/049205 A1 5/2006
WO WO 2006/075563 A1 7/2006
WO WO 2007/037361 A1 4/2007
WO WO 2007/052088 A1 5/2007
WO WO 2007/126015 A1 11/2007
WO WO 2007/129728 A1 11/2007

(56) References Cited

FOREIGN PATENT DOCUMENTS

| | | | |
|---|---|---|---|
| WO | WO 2007/142434 | A1 | 12/2007 |
| WO | WO 2009/001874 | A1 | 12/2008 |
| WO | WO 2009/004727 | A1 | 1/2009 |
| WO | WO 2009/029037 | A1 | 3/2009 |
| WO | WO 2009/054393 | A1 | 4/2009 |
| WO | WO 2009/059631 | A1 | 5/2009 |
| WO | WO 2009/093466 | A1 | 7/2009 |
| WO | WO 2010/003539 | A1 | 1/2010 |
| WO | WO 2010/024371 | A1 | 3/2010 |
| WO | WO 2011/043227 | A1 | 4/2011 |
| WO | WO 2015/144587 | A1 | 10/2015 |

OTHER PUBLICATIONS

Korean Office Action dated Nov. 28, 2018 in connection with Korean Application No. 10-2018-7004221, and English translation thereof.
Korean Office Action dated Nov. 28, 2018 in connection with Korean Application No. 10-2018-7005834, and English translation thereof.
U.S. Appl. No. 16/276,936, filed Feb. 15, 2019, Yamamoto et al.
Japanese Office Action dated Aug. 28, 2018 in connection with Japanese Application No. 2017-140510 and English translation thereof.
Korean Office Action dated Aug. 29, 2018 in connection with Korean Application No. 10-2018-7020930 and English translation thereof.
U.S. Appl. No. 13/498,234, filed Apr. 12, 2012, Yamamoto et al.
U.S. Appl. No. 13/499,559, filed Jun. 11, 2012, Yamamoto et al.
U.S. Appl. No. 13/639,325, filed Oct. 4, 2012, Yamamoto et al.
U.S. Appl. No. 13/639,338, filed Oct. 4, 2012, Yamamoto et al.
U.S. Appl. No. 13/640,500, filed Apr. 19, 2013, Yamamoto et al.
U.S. Appl. No. 13/877,192, filed Apr. 1, 2013, Yamamoto et al.
U.S. Appl. No. 14/006,148, filed Sep. 19, 2013, Honma et al.
U.S. Appl. No. 14/236,350, filed Jan. 31, 2014, Yamamoto et al.
U.S. Appl. No. 14/237,990, filed Feb. 10, 2014, Yamamoto et al.
U.S. Appl. No. 14/237,993, filed Feb. 10, 2014, Yamamoto et al.
U.S. Appl. No. 14/585,974, filed Dec. 30, 2014, Yamamoto et al.
U.S. Appl. No. 14/861,734, filed Sep. 22, 2015, Yamamoto et al.
U.S. Appl. No. 14/870,268, filed Sep. 30, 2015, Yamamoto et al.
U.S. Appl. No. 15/003,960, filed Jan. 22, 2016, Yamamoto et al.
U.S. Appl. No. 15/206,783, filed Jul. 11, 2016, Yamamoto et al.
U.S. Appl. No. 14/917,825, filed Mar. 9, 2016, Honma et al.
U.S. Appl. No. 15/106,498, filed Jun. 20, 2016, Yamamoto.
U.S. Appl. No. 13/978,175, filed Jul. 3, 2013, Hatanaka et al.
U.S. Appl. No. 14/238,265, filed Feb. 11, 2014, Hatanaka et al.
U.S. Appl. No. 14/239,574, filed Feb. 19, 2014, Hatanaka et al.
U.S. Appl. No. 14/239,568, filed Feb. 19, 2014, Hatanaka et al.
U.S. Appl. No. 14/238,243, filed Feb. 11, 2014, Hatanaka et al.
U.S. Appl. No. 15/227,024, filed Aug. 3, 2016, Hatanaka et al.
U.S. Appl. No. 14/239,797, filed Feb. 20, 2014, Hatanaka et al.
U.S. Appl. No. 15/357,877, filed Nov. 21, 2016, Yamamoto et al.
U.S. Appl. No. 15/424,741, filed Feb. 3, 2017, Hatanaka et al.
U.S. Appl. No. 15/581,527, filed Apr. 28, 2017, Yamamoto et al.
U.S. Appl. No. 15/584,447, filed May 2, 2017, Yamamoto et al.
U.S. Appl. No. 15/670,407, filed Aug. 7, 2017, Yamamoto et al.
U.S. Appl. No. 15/684,340, filed Aug. 23, 2017, Yamamoto et al.
U.S. Appl. No. 16/263,356, filed Jan. 31, 2019, Yamamoto et al.

* cited by examiner

SIGNAL PROCESSING APPARATUS AND SIGNAL PROCESSING METHOD, ENCODER AND ENCODING METHOD, DECODER AND DECODING METHOD, AND PROGRAM

CROSS REFERENCES TO RELATED APPLICATIONS

The present application claims the benefit under 35 U.S.C. § 120 as a continuation application of U.S. application Ser. No. 15/584,447, filed May 2, 2017, which is a continuation application of U.S. application Ser. No. 15/003,960, filed Jan. 22, 2016, now U.S. Pat. No. 9,679,580, which is a continuation application of U.S. application Ser. No. 13/639,325, filed Oct. 4, 2012, now U.S. Pat. No. 9,406,312, which is a national stage filing under 35 U.S.C. § 371 of international PCT application, PCT/JP2011/059028, filed Apr. 11, 2011, which claims priority under 35 U.S.C. § 119 to Japanese Patent Application No. JP 2011-017230, filed Jan. 28, 2011, to Japanese Patent Application No. JP 2011-072380, filed Mar. 29, 2011, and to Japanese Patent Application No. JP 2010-092689, filed Apr. 13, 2010, the entire contents of each of which is incorporated herein by reference.

TECHNICAL FIELD

The present invention relates to a signal processing apparatus and a signal processing method, an encoder and an encoding method, a decoder and a decoding method, and a program, and more particularly to a signal processing apparatus and a signal processing method, an encoder and an encoding method, a decoder and a decoding method, and a program for reproducing a music signal with improved sound quality by expansion of a frequency band.

BACKGROUND ART

Recently, music distribution services for distributing music data via the internet have been increased. The music distribution service distributes, as music data, encoded data obtained by encoding a music signal. As an encoding method of the music signal, an encoding method has been commonly used in which the encoded data file size is suppressed to decrease a bit rate so as to save time during download.

Such an encoding method of the music signal is broadly divided into an encoding method such as MP3 (MPEG (Moving Picture Experts Group) Audio Layers 3) (International Standard ISO/IEC 11172-3) and an encoding method such as HE-AAC (High Efficiency MPEG4 AAC) (International Standard ISO/IEC 14496-3).

The encoding method represented by MP3 cancels a signal component of a high frequency band (hereinafter, referred to as a high band) having about 15 kHz or more in music signal that is almost imperceptible to humans, and encodes the low frequency band (hereinafter, referred to as a low band) of the signal component of the remainder. Therefore, the encoding method is referred to as a high band cancelation encoding method. This kind of high band cancelation encoding method can suppress the file size of encoded data. However, since sound in a high band can be perceived slightly by human, if sound is produced and output from the decoded music signal obtained by decoding the encoded data, suffers a loss of sound quality whereby a sense of realism of an original sound is lost and a sound quality deterioration such a blur of sound occurs.

Unlike this, the encoding method represented by HE-AAC extracts specific information from a signal component of the high band and encodes the information in conjunction with a signal component of the low band. The encoding method is referred to below as a high band characteristic encoding method. Since the high band characteristic encoding method encodes only characteristic information of the signal component of the high band as information on the signal component of the high band, deterioration of sound quality is suppressed and encoding efficiency can be improved.

In decoding data encoded by the high band characteristic encoding method, the signal component of the low band and characteristic information are decoded and the signal component of the high band is produced from a signal component of the low band and characteristic information after being decoded. Accordingly, a technology that expands a frequency band of the signal component of the high band by producing a signal component of the high band from signal component of the low band is referred to as a band expansion technology.

As an application example of a band expansion method, after decoding of data encoded by a high band cancelation encoding method, a post process is performed. In the post process, the high band signal component lost in the encoding is generated from the decoded low band signal component, thereby expanding the frequency band of the signal component of the low band (see Patent Document 1). The method of frequency band expansion of the related art is referred below to as a band expansion method of Patent Document 1.

In a band expansion method of the Patent Document 1, the apparatus estimates a power spectrum (hereinafter, suitably referred to as a frequency envelope of the high band) of the high band from the power spectrum of an input signal by setting the signal component of the low band after decoding as the input signal and produces the signal component of the high band having the frequency envelope of the high band from the signal component of the low band.

FIG. 1 illustrates an example of a power spectrum of the low band after the decoding as an input signal and a frequency envelope of an estimated high band.

In FIG. 1, the vertical axis illustrates a power as a logarithm and a horizontal axis illustrates a frequency.

The apparatus determines the band in the low band of the signal component of the high band (hereinafter, referred to as an expansion start band) from a kind of an encoding system on the input signal and information such as a sampling rate, a bit rate and the like (hereinafter, referred to as side information). Next, the apparatus divides the input signal as signal component of the low band into a plurality of sub-band signals. The apparatus obtains a plurality of sub-band signals after division, that is, an average of respective groups (hereinafter, referred to as a group power) in a time direction of each power of a plurality of sub-band signals of a low band side lower than the expansion start band is obtained (hereinafter, simply referred to as a low band side). As illustrated in FIG. 1, according to the apparatus, it is assumed that the average of respective group powers of the signals of a plurality of sub-bands of the low band side is a power and a point making a frequency of a lower end of the expansion start band be a frequency is a starting point. The apparatus estimates a primary straight line of a predetermined slope passing through the starting point as the frequency envelope of the high band higher than the expansion start band (hereinafter, simply referred to as a high band side). In addition, a position in a power direction of the starting point may be adjusted by a user. The apparatus produces each of a plurality of signals of a sub-band of the high band side from a plurality of signals of a sub-band of the low band side to be an estimated frequency envelope of the high band side. The apparatus adds a plurality of the produced signals of the sub-band of the high band side to each other into the signal components of the high band and adds the signal components of the low band to each other to output the added signal components. Therefore, the music signal after expansion of the frequency band is close to the original music signal. However, it is possible to produce the music signal of a better quality.

The band expansion method disclosed in the Patent Document 1 has an advantage that the frequency band can be expanded for the music signal after decoding of the encoded data with respect to various high band cancelation encoding methods and encoded data of various bit rates.

CITATION LIST

Patent Document

Patent Document 1: Japanese Patent Application Laid-Open No. 2008-139844

SUMMARY OF THE INVENTION

Problems to be Solved by the Invention

Accordingly, the band expansion method disclosed in Patent Document 1 may be improved in that the estimated frequency envelope of a high band side is a primary straight line of a predetermined slope, that is, a shape of the frequency envelope is fixed.

In other words, the power spectrum of the music signal has various shapes and the music signal has a lot of cases where the frequency envelope of the high band side estimated by the band expansion method disclosed in Patent Document 1 deviates considerably.

FIG. 2 illustrates an example of an original power spectrum of an attack music signal (attack music signal) having a rapid change in time as a drum is strongly hit once.

In addition, FIG. 2 also illustrates the frequency envelope of the high band side estimated from the input signal by setting the signal component of the low band side of the attack relative music signal as an input signal by the band expansion method disclosed in the Patent Document 1.

As illustrated in FIG. 2, the power spectrum of the original high band side of the attack music signal has a substantially flat shape.

Unlike this, the estimated frequency envelope of the high band side has a predetermined negative slope and even if the frequency is adjusted to have the power close to the original power spectrum, difference between the power and the original power spectrum becomes large as the frequency becomes high.

Accordingly, in the band expansion method disclosed in Patent Document 1, the estimated frequency envelope of the high band side cannot reproduce the frequency envelope of the original high band side with high accuracy. Therefore, if sound from the music signal after the expansion of the frequency band is produced and output, clarity of the sound in auditory is lower than the original sound.

In addition, in the high band characteristic encoding method such as HE-AAC and the like described above, the frequency envelope of the high band side is used as characteristic information of the encoded high band signal components. However, it needs to reproduce the frequency envelope of the original high band side with high accuracy in a decoding side.

The present invention has been made in a consideration of such a circumstance and provides a music signal having a better sound quality by expanding a frequency band.

Solutions to Problems

A signal processing apparatus according to a first aspect of the present invention includes: a demultiplexing unit that demultiplexes input encoded data into data including information on a segment including frames in which the same coefficient as a coefficient used in producing a high band signal is selected in a section to be processed including a plurality of frames, and coefficient information for obtaining the coefficient selected in the frames of the segment, and low band encoded data; a low band decoding unit that decodes the low band encoded data to produce a low band signal; a selection unit that selects a coefficient of a frame to be processed from a plurality of the coefficients based on the data; a high band sub-band power calculation unit that calculates a high band sub-band power of a high band sub-band signal of each sub-band constituting the high band signal of the frame to be processed based on a low band sub-band signal of each sub-band constituting the low band signal of the frame to be processed and the selected coefficient; and a high band signal production unit that produces the high band signal of the frame to be processed based on the high band sub-band power and the low band sub-band signal.

The section to be processed may be divided into the segments so that positions of the frames adjacent to each other in which different coefficients are selected are set as boundary positions of the segments, and information indicating a length of each of the segments may be set as information on the segments.

The section to be processed may be divided into the several segments having the same length so that a length of the segment is the longest and information indicating the length and information indicating whether the selected coefficient is varied before and after each boundary position of the segments may be set as information on the segments.

When the same coefficient is selected in continuous several segments, the data may include one piece of coefficient information for obtaining the coefficient selected in the several continuous segments.

The data may be produced for each section to be processed by a system having a less data amount between a first system and a second system, wherein, in the first system, the section to be processed is divided into the segments so that the positions of frames adjacent to each other in which the different coefficients are selected, are set as a boundary position of the segments and information indicating a length of each of the segments is set as information on the segments, wherein, in the second system, the section to be processed is divided into the several segments having the same length so that a length of the segment is the longest and information indicating the length and information indicating whether the selected coefficient is varied before and after a boundary position of the segments are set as information on the segment, and wherein the data may further include information indicating whether the data is obtained by the first system or second system.

The data may further include reuse information indicating whether the coefficient of an initial frame in the section to be processed is the same as the coefficient of a frame just before the initial frame, and when the data includes the reuse information indicating that the coefficients are the same, the data may not include coefficient information of the initial segment of the section to be processed.

When a mode in which the coefficient information is reused, is designated, the data may include the reuse information, and when a mode in which the reuse of the coefficient information is prohibited, is designated, the data may not include the reuse information.

A signal processing method or a program according to the first aspect of the present invention includes the steps of: demultiplexing input encoded data into data including information on a segment including frames in which the same coefficient as a coefficient used in producing a high band signal is selected in a section to be processed including a plurality of frames, and coefficient information for obtaining the coefficient selected in the frames of the segment, and low band encoded data; decoding the low band encoded data to produce a low band signal; selecting a coefficient of a frame to be processed from a plurality of the coefficients based on the data; calculating a high band sub-band power of a high band sub-band signal of each sub-band constituting the high band signal of the frame to be processed based on a low band sub-band signal of each sub-band constituting the low band signal of the frame to be processed and the selected coefficient; and producing the high band signal of the frame to be processed based on the high band sub-band power and the low band sub-band signal.

In the first aspect of the present invention, input encoded data is demultiplexed into data including information on a segment including frames in which the same coefficient as a coefficient used in producing a high band signal is selected in a section to be processed including a plurality of frames, and coefficient information for obtaining the coefficient selected in the frames of the segment and low band encoded data, the low band encoded data is decoded to produce the low signal, a coefficient of a frame to be processed is selected from a plurality of the coefficients based on the data, the high band sub-band power of a high band sub-band signal of each sub-band constituting the high band signal in the frame to be processed is calculated based on a low band sub-band signal of each sub-band constituting the low band signal of the frame to be processed and the selected coefficient, and the high band signal of the frames to be processed is produced based on the high band sub-band power and the low band sub-band signal.

A signal processing apparatus according to a second aspect of the present invention includes: a sub-band division unit that produces a low band sub-band signal of a plurality of sub-bands in a low band side of an input signal, and a high band sub-band signal of a plurality of sub-bands in a high band side of the input signal; a pseudo high band sub-band power calculation unit that calculates a pseudo high band sub-band power which is an estimation value of power of the high band sub-band signal based on the low band sub-band signal and a predetermined coefficient; a selection unit that selects any of a plurality of the coefficients for respective frames of the input signal by comparing the high band sub-band power of the high band sub-band signal and the pseudo high band sub-band power; and a production unit that produces data including information on a segment having frames in which the same coefficient is selected in a section to be processed having a plurality of frames of the input signal, and coefficient information for obtaining the coefficient selected in frames of the segment.

The production unit may divide the section to be processed into the segments so that the positions of frames adjacent to each other in which different coefficients are selected, are set as boundary positions of the segments, and set information indicating a length of each of the segments as information on the segment.

The production unit may divide the section to be processed into the several segments having the same length so that a length of the segment is the longest and information indicating the length and information indicating whether the selected coefficient is varied before and after boundary positions of the segments may be set as information on the segments.

The production unit may produce the data including one piece of coefficient information for obtaining the coefficient selected in the several continuous segments when the same coefficient is selected in the several continuous segments.

The production unit may produce data for each section to be processed with a system having a less data amount between a first system and a second system, wherein, in the first system, the section to be processed is divided into the segments so that the positions of frames adjacent to each other in which the different coefficients are selected, are set as boundary positions of the segments, and information indicating a length of each of the segments is set as information on the segments, and wherein, in the second system, the section to be processed is divided into the several segments having the same length so that a length of the segment is the longest and information indicating the length and information indicating whether the selected coefficient is varied before and after a boundary position of the segments are set as information on the segments.

The data may further include information indicating whether the data is obtained by the first system or the second system.

The production unit produces the data including the reuse information indicating whether the coefficient of an initial frame of the section to be processed is the same as the coefficient of a frame just before the initial frame, and when the reuse information indicating that the coefficients are the same is included in the data, the data in which the coefficient information of an initial segment of the section to be processed is not included, is produced.

When a mode in which the coefficient information is reused, is designated, the production unit produces the data including the reuse information, and when a mode in which the reuse of the coefficient information is prohibited, is designated, the production unit produces the data that the reuse information is not included.

A signal processing method or a program according to the second aspect of the present invention includes the steps of: producing a low band sub-band signal of a plurality of sub-bands in a low band side of an input signal, and a high band sub-band signal of a plurality of sub-bands in a high band side of the input signal; calculating a pseudo high band sub-band power which is an estimation value of power of the high band sub-band signal based on the low band sub-band signal and a predetermined coefficient; selecting any of a plurality of the coefficients for respective frames of the input signal by comparing the high band sub-band power of the high band sub-band signal and the pseudo high band sub-band power; and producing data including information on a segment having frames in which the same coefficient is selected in a section to be processed having a plurality of frames of the input signal, and coefficient information for obtaining the coefficient selected in frames of the segment.

In the second aspect of the present invention, a low band sub-band signal of a plurality of sub-bands in a low band side of an input signal, and a high band sub-band signal of a plurality of sub-bands in a high band side of the input signal are provided, a pseudo high band sub-band power is calculated as an estimation value of power of the high band sub-band signal based on the low band sub-band signal and a predetermined coefficient, any of a plurality of the coefficients for respective frames of the input signal is selected by comparing the high band sub-band power of the high band sub-band signal and the pseudo high band sub-band power, and information interval segment having frames in which the same coefficient is selected in an section to be processed having a plurality of frames of the input signal, and coefficient information for obtaining the coefficient selected at frames of the segment are produced.

A decoder according to a third aspect of the present invention includes: a demultiplexing unit that demultiplexes input encoded data into data including information on a segment including frames in which the same coefficient as a coefficient used in producing a high band signal is selected in a section to be processed including a plurality of frames, and coefficient information for obtaining the coefficient selected in the frames of the segment, and low band encoded data; a low band decoding unit that decodes the low band encoded data to produce a low band signal; a selection unit that selects a coefficient of a frame to be processed from a plurality of the coefficients based on the data; a high band sub-band power calculation unit that calculates a high band sub-band power of a high band sub-band signal of each sub-band constituting the high band signal of the frame to be processed based on a low band sub-band signal of each sub-band constituting the low band signal of the frame to be processed and the selected coefficient; a high band signal production unit that produces the high band signal of the frame to be processed based on the high band sub-band power and the low band sub-band signal; and a synthesis unit that synthesizes the low band signal and the high band signal to produce an output signal.

A decoding method of the third aspect of the present invention includes steps of demultiplexing input encoded data into data including information on a segment including frames in which the same coefficient as a coefficient used in producing a high band signal are selected in a section to be processed including a plurality of frames, and coefficient information for obtaining the coefficient selected in the frames of the segment and low band encoded data, decoding the low band encoded data to produce the low band signal, selecting a coefficient of a frame to be processed from a plurality of coefficient based on the data, calculating a high band sub-band power of a high band sub-band signal of each sub-band including the high band signal of the frame to be processed based on a low band sub-band signal of each sub-band including the low band signal of the frame to be processed and the selected coefficient, producing the high band signal of the frame to be processed based on the high band sub-band power and the low band sub-band signal, and synthesizing the low band signal and the high band signal to produce an output signal.

In the third aspect of the present invention, input encoded data is demultiplexed into data including information on a segment including frames in which the same coefficient as a coefficient used in producing a high band signal is selected in a section to be processed including a plurality of frames, and coefficient information for obtaining the coefficient selected at the frames of the segment and low band encoded data, the low band encoded data is decoded to produce the low signal, a coefficient of a frame to be processed is selected from a plurality of the coefficients based on the data, the high band sub-band power of a high band sub-band signal of each sub-band constituting the high band signal in the frame to be processed is calculated based on a low band sub-band signal of each sub-band constituting the low band signal of the frame to be processed and the selected coefficient, and the high band signal of the frames to be processed is produced based on the high band sub-band power and the low band sub-band signal, and synthesizing the low band signal and the high band signal to produce an output signal.

An encoder according to a fourth aspect of the present invention includes: a sub-band division unit that produces a low band sub-band signal of a plurality of sub-bands in a low band side of an input signal, and a high band sub-band signal of a plurality of sub-bands in a high band side of the input signal; a pseudo high band sub-band power calculation unit that calculates a pseudo high band sub-band power which is an estimation value of power of the high band sub-band signal based on the low band sub-band signal and a predetermined coefficient; a selection unit that selects any of a plurality of the coefficients for respective frames of the input signal by comparing the high band sub-band power of the high band sub-band signal and the pseudo high band sub-band power; a high band encoding unit that produces high band encoded data by encoding information on a segment having frames in which the same coefficient is selected in a section to be processed including a plurality of frames of the input signal, and coefficient information for obtaining the coefficient selected in the frames of the segment; a low band encoding unit that encodes a low band signal of the input signal and produces low band encoded data; and a multiplexing unit that produces an output code string by multiplexing the low band encoded data and the high band encoded data.

An encoding method of the fourth aspect of the present invention includes producing a low band sub-band signal of a plurality of sub-bands in a low band side of an input signal, and a high band sub-band signal of a plurality of sub-bands in a high band side of the input signal, calculating a pseudo high band sub-band power which is an estimation value of power of the high band sub-band signal based on the low band sub-band signal and a predetermined coefficient, selecting any of a plurality of the coefficients for respective frames of the input signal by comparing the high band sub-band power of the high band sub-band signal and the pseudo high band sub-band power, and producing high band encoded data by encoding information on a segment including frames in which the same coefficient is selected in a section to be processed including a plurality of frames of the input signal and coefficient information for obtaining the coefficient selected in frames of the segment, encoding a low band signal of the input signal, producing the low band encoded data and producing an output code string by multiplexing the low band encoded data and the high band encoded data.

In the fourth aspect of the present invention, a low band sub-band signal of a plurality of sub-bands in a low band side of an input signal, and a high band sub-band signal of a plurality of sub-bands in a high band side of the input signal are provided, a pseudo high band sub-band power which is an estimation value of power of the high band sub-band signal is calculated based on the low band sub-band signal and a predetermined coefficient, any of a plurality of coefficients for respective frames of the input signal is selected by comparing the high band sub-band power of the high band sub-band signal and the pseudo high band sub-band power, the high band encoded data is produced by encoding information on a segment including frames in which the same coefficient is selected and the coefficient information for obtaining the coefficient selected in the frames of the segment, the low band signal of the input signal is encoded, the low band encoded data is produced, and an output code string is produced by multiplexing the low band encoded data and the high band encoded data.

Effects of the Invention

According to the first embodiment to the fourth embodiment, it is possible to reproduce music signal with high sound quality by expansion of a frequency band.

MODE FOR CARRYING OUT THE INVENTION

An embodiment of the present invention will be described with reference to the drawings. In addition, the description thereof is performed in the following sequence.

1. First embodiment (when the present invention is applied to a frequency band expansion apparatus)
2. Second embodiment (when the present invention is applied to an encoder and a decoder)
3. Third embodiment (when a coefficient index is included in high band encoded data)

4. Fourth embodiment (when a difference between coefficient index and a pseudo high band sub-band power is included in high band encoded data)

5. Fifth embodiment (when a coefficient index is selected using an estimation value).

6. Sixth embodiment (when a portion of a coefficient is commons)

7. Seventh embodiment (when an encoding amount of a coefficient index string is reduced in time direction by a variable length method)

8. Eighth embodiment (when an encoding amount of a coefficient index string is reduced in time direction by a fixed length method)

9. Ninth embodiment (when any of a variable length method or a fixed length method is selected)

10. Tenth embodiment (when recycling of information is performed by a variable method)

11. Eleventh embodiment (when recycling of information is performed by a fixed length method)

1. First Embodiment

In a first embodiment, a process that expands a frequency band (hereinafter, referred to as a frequency band expansion process) is performed with respect to a signal component of a low band after decoding obtained by decoding encoded data using a high cancelation encoding method.

[Functional Configuration Example of Frequency Band Expansion Apparatus]

Figure 3:
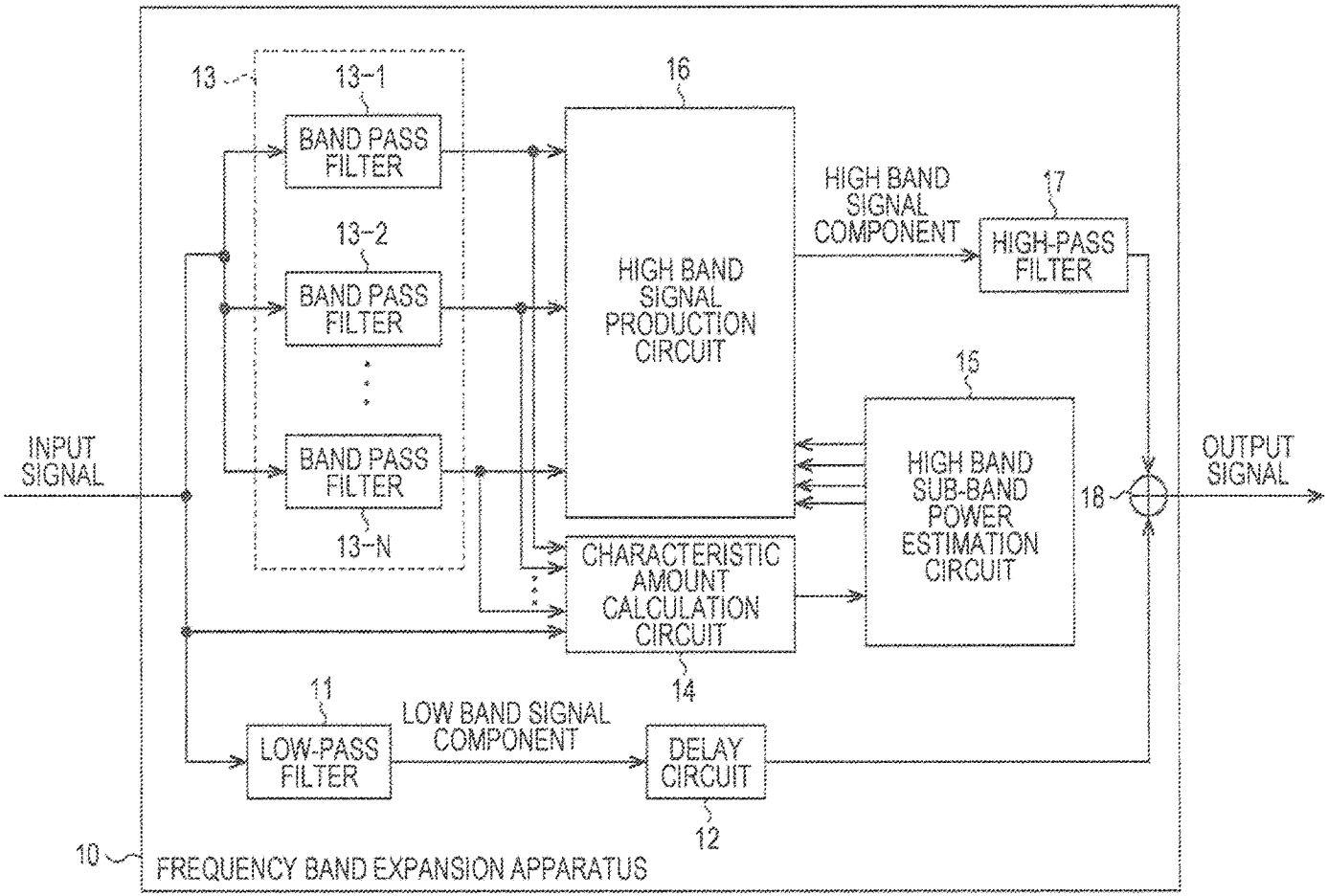
FIG. 3 is a block diagram illustrating a functional configuration example of a frequency band expansion apparatus in a first embodiment of the present invention.

FIG. 3 illustrates a functional configuration example of a frequency band expansion apparatus according to the present invention.

A frequency band expansion apparatus 10 performs a frequency band expansion process with respect to the input signal by setting a signal component of the low band after decoding as the input signal and outputs the signal after the frequency band expansion process obtained by the result as an output signal.

The frequency band expansion apparatus 10 includes a low-pass filter 11, a delay circuit 12, a band pass filter 13, a characteristic amount calculation circuit 14, a high band sub-band power estimation circuit 15, a high band signal production circuit 16, a high-pass filter 17 and a signal adder 18.

The low-pass filter 11 filters an input signal by a predetermined cut off frequency and supplies a low band signal component, which is a signal component of the low band as a signal after filtering to the delay circuit 12.

Since the delay circuit 12 is synchronized when adding the low band signal component from the low-pass filter 11 and a high band signal component which will be described later to each other, it delays the low signal component only a certain time and the low signal component is supplied to the signal adder 18.

The band pass filter 13 includes band pass filters 13-1 to 13-N having pass bands different from each other. The band pass filter 13-$i$($\leq i \leq$N)) passes a signal of a predetermined pass band of the input signal and supplies the passed signal as one of a plurality of sub-band signal to the characteristic amount calculation circuit 14 and the high band signal production circuit 16.

The characteristic amount calculation circuit 14 calculates one or more characteristic amounts by using at least any one of a plurality of sub-band signals and the input signal from the band pass filter 13 and supplies the calculated characteristic amounts to the high band sub-band power estimation circuit 15. Herein, the characteristic amounts are information showing a feature of the input signal as a signal.

The high band sub-band power estimation circuit 15 calculates an estimation value of a high band sub-band power which is a power of the high band sub-band signal for each high band sub-band based on one or more characteristic amounts from the characteristic amount calculation circuit 14 and supplies the calculated estimation value to the high band signal production circuit 16.

The high band signal production circuit 16 produces the high band signal component which is a signal component of the high band based on a plurality of sub-band signals from the band pass filter 13 and an estimation value of a plurality of high band sub-band powers from the high band sub-band power estimation circuit 15 and supplies the produced high signal component to the high-pass filter 17.

The high-pass filter 17 filters the high band signal component from the high band signal production circuit 16 using a cut off frequency corresponding to the cut off frequency in the low-pass filter 11 and supplies the filtered high band signal component to a signal adder 18.

The signal adder 18 adds the low band signal component from the delay circuit 12 and the high band signal component from the high-pass filter 17 and outputs the added components as an output signal.

In addition, in a configuration in FIG. 3, in order to obtain a sub-band signal, the band pass filter 13 is applied but is not limited thereto. For example, the band division filter disclosed in Patent Document 1 may be applied.

In addition, likewise, in a configuration in FIG. 3, the signal adder 18 is applied in order to synthesize a sub-band signal, but is not limited thereto. For example, a band synthetic filter disclosed in Patent Document 1 may be applied.

[Frequency Band Expansion Process of Frequency Band Expansion Apparatus]

Next, referring to a flowchart in FIG. 4, the frequency band expansion process by the frequency band expansion apparatus in FIG. 3 will be described.

In step S1, the low-pass filter 11 filters the input signal by a predetermined cutoff frequency and supplies the low band signal component as a signal after filtering to the delay circuit 12.

The low-pass filter 11 can set an optional frequency as the cutoff frequency. However, in an embodiment of the present invention, the low-pass filter can set to correspond a frequency of a low end of the expansion start band by setting a predetermined frequency as an expansion start band described blow. Therefore, the low-pass filter 11 supplies a low band signal component, which is a signal component of the lower band than the expansion start band to the delay circuit 12 as a signal after filtering.

In addition, the low-pass filter 11 can set the optimal frequency as the cutoff frequency in response to the encoding parameter such as the high band cancelation encoding method or a bit rate and the like of the input signal. As the encoding parameter, for example, side information employed in the band expansion method disclosed in Patent Document 1 can be used.

In step S2, the delay circuit 12 delays the low band signal component only a certain delay time from the low-pass filter 11 and supplies the delayed low band signal component to the signal adder 18.

In step S3, the band pass filter 13 (band pass filters 13-1 to 13-N) divides the input signal into a plurality of sub-band signals and supplies each of a plurality of sub-band signals after the division to the characteristic amount calculation circuit 14 and the high band signal production circuit 16. In addition, the process of division of the input signal by the band pass filter 13 will be described below.

In step S4, the characteristic amount calculation circuit 14 calculates one or more characteristic amounts by at least one of a plurality of sub-band signals from the band pass filter 13 and the input signal and supplies the calculated characteristic amounts to the high band sub-band power estimation circuit 15. In addition, a process of the calculation for the characteristic amount by the characteristic amount calculation circuit 14 will be described below in detail.

In step S5, the high band sub-band power estimation circuit 15 calculates an estimation value of a plurality of high band sub-band powers based on one or more characteristic amounts and supplies the calculated estimation value to the high band signal production circuit 16 from the characteristic amount calculation circuit 14. In addition, a process of a calculation of an estimation value of the high band sub-band power by the high band sub-band power estimation circuit 15 will be described below in detail.

In step S6, the high band signal production circuit 16 produces a high band signal component based on a plurality of sub-band signals from the band pass filter 13 and an estimation value of a plurality of high band sub-band powers from the high band sub-band power estimation circuit 15 and supplies the produced high band signal component to the high-pass filter 17. In this case, the high band signal component is the signal component of the higher band than the expansion start band. In addition, a process on the production of the high band signal component by the high band signal production circuit 16 will be described below in detail.

In step S7, the high-pass filter 17 removes the noise such as an alias component in the low band included in the high band signal component by filtering the high band signal component from the high band signal production circuit 16 and supplies the high band signal component to the signal adder 18.

In step S8, a signal adder 18 adds the low band signal component from the delay circuit 12 and the high band signal component from the high-pass filter 17 to each other and outputs the added components as an output signal.

According to the above-mentioned process, the frequency band can be expanded with respect to a signal component of the low band after decoding.

Next, a description for each process of step S3 to S6 of the flowchart in FIG. 4 will be described.

[Description of Process by Band Pass Filter]

First, a description of process by the band pass filter 13 in step S3 in a flowchart of FIG. 4 will be described.

In addition, for convenience of the explanation, as described below, it is assumed that the number N of the band pass filter 13 is N=4.

For example, it is assumed that one of 16 sub-bands obtained by dividing Nyquist frequency of the input signal into 16 parts is an expansion start band and each of 4 sub-bands of the lower band than the expansion start band of 16 sub-bands is each pass band of the band pass filters 13-1 to 13-4.

Figure 5:
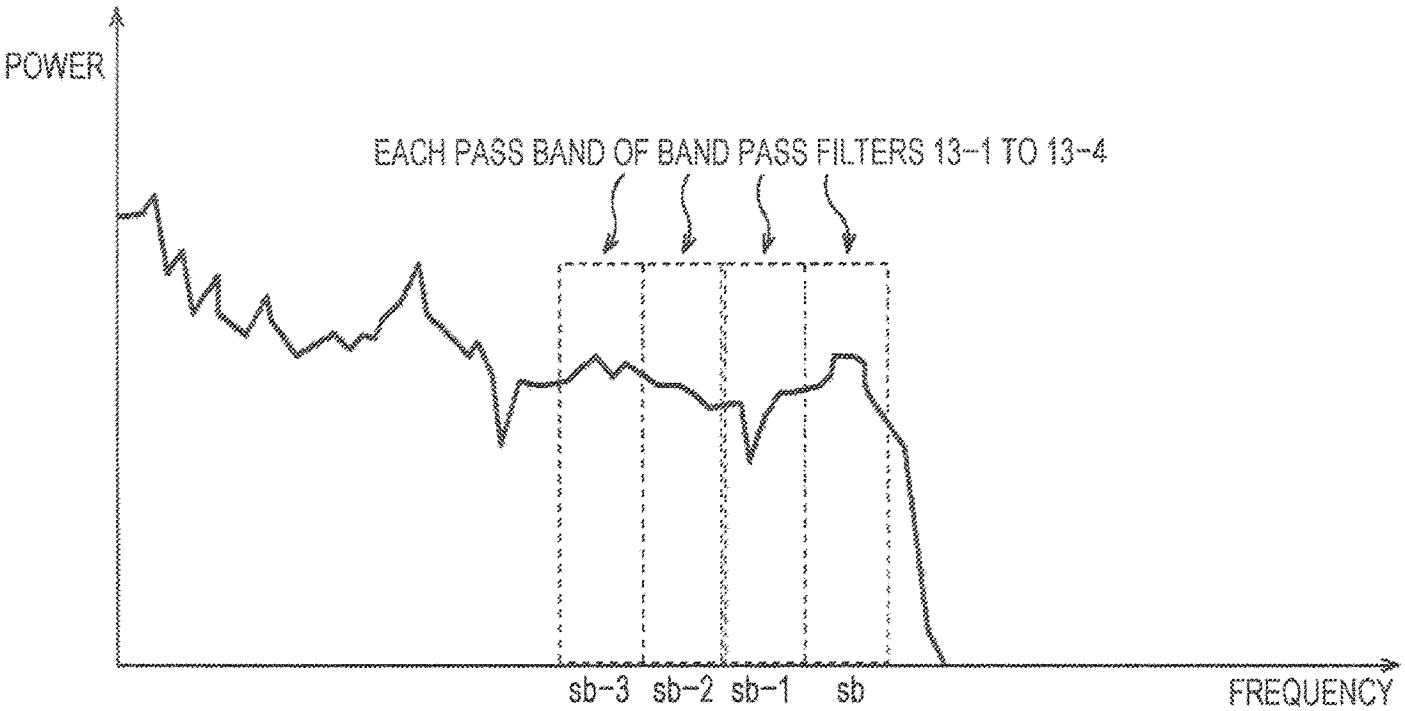
FIG. 5 is a view illustrating arrangement of a power spectrum of signal input to a frequency band expansion apparatus in FIG. 3 and arrangement on a frequency axis of a band pass filter.

FIG. 5 illustrates arrangements on each axis of a frequency for each pass band of the band pass filters 13-1 to 13-4.

As illustrated in FIG. 5, if it is assumed that an index of the first sub-band from the high band of the frequency band (sub-band) of the lower band than the expansion start band is sb, an index of second sub-band is sb−1, and an index of I-th sub-band is sb−(I−1), Each of band pass filters 13-1 to 13-4 assign each sub-band in which the index is sb to sb−3 among the sub-band of the low band lower than the expansion initial band as the pass band.

In the present embodiment, each pass band of the band pass filters 13-1 to 13-4 is 4 predetermined sub-bands of 16 sub-bands obtained by dividing the Nyquist frequency of the input signal into 16 parts but is not limited thereto and may be 4 predetermined sub-bands of 256 sub-band obtained by dividing the Nyquist frequency of the input signal into 256 parts. In addition, each bandwidth of the band pass filters 13-1 to 13-4 may be different from each other.

[Description of Process by Characteristic Amount Calculation Circuit]

Next, a description of a process by the characteristic amount calculation circuit 14 in step S4 of the flowchart in FIG. 4 will be described.

The characteristic amount calculation circuit 14 calculates one or more characteristic amounts used such that the high band sub-band power estimation circuit 15 calculates the estimation value of the high band sub-band power by using at least one of a plurality of sub-band signals from the band pass filter 13 and the input signal.

In more detail, the characteristic amount calculation circuit 14 calculates as the characteristic amount, the power of the sub-band signal (sub-band power (hereinafter, referred to as a low band sub-band power)) for each sub-band from 4 sub-band signals of the band pass filter 13 and supplies the calculated power of the sub-band signal to the high band sub-band power estimation circuit 15.

In other words, the characteristic amount calculation circuit 14 calculates the low band sub-band power power(ib, J) in a predetermined time frame J from 4 sub-band signals x(ib,n), which is supplied from the band pass filter 13 by using the following Equation (1). Herein, ib is an index of the sub-band, and n is expressed as index of discrete time. In addition, the number of a sample of one frame is expressed as FSIZE and power is expressed as decibel.

[Equation 1]

$$\text{power}(ib, J) = 10\log10\left\{\left(\sum_{n=J*FSIZE}^{(J+1)FSIZE-1} x(ib, n)^2\right) \Big/ FSIZE\right\} \quad (1)$$

$$(sb-3 \le ib \le sb)$$

Accordingly, the low band sub-band power power(ib, J) obtained by the characteristic amount calculation circuit 14 is supplied to the high band sub-band power estimation circuit 15 as the characteristic amount.

[Description of Process by High Band Sub-Band Power Estimation Circuit]

Next, a description of a process by the high band sub-band power estimation circuit 15 of step S5 of a flowchart in FIG. 4 will be described.

The high band sub-band power estimation circuit 15 calculates an estimation value of the sub-band power (high band sub-band power) of the band (frequency expansion band) which is caused to be expanded following the sub-band (expansion start band) of which the index is sb+1, based on 4 sub-band powers supplied from the characteristic amount calculation circuit 14.

That is, if the high band sub-band power estimation circuit 15 considers the index of the sub-band of maximum band of the frequency expansion band to be eb, (eb−sb) sub-band power is estimated with respect to the sub-band in which the index is sb+1 to eb.

In the frequency expansion band, the estimation value $power_{est}(ib,J)$ of sub-band power of which the index is ib is expressed by the following Equation (2) using 4 sub-band power power(ib,j) supplied from the characteristic amount calculation circuit 14.

[Equation 2]

$$power_{est}(ib, J) = \left(\sum_{kb=sb-3}^{sb} [A_{ib}(kb)\,power(kb, J)]\right) + B_{ib}(J * FSIZE \le n \le (J+1)FSIZE - 1,\ sb+1 \le ib \le eb) \quad (2)$$

Herein, in Equation (2), coefficients $A_{ib}(kb)$, and $B_{ib}$ are coefficients having value different for respective sub-band ib. Coefficients $A_{ib}(kb)$, $B_{ib}$ are coefficients set suitably to obtain a suitable value with respect to various input signals. In addition, Coefficients $A_{ib}(kb)$, $B_{ib}$ are also charged to an optimal value by changing the sub-band sb. A deduction of $A_{ib}(kb)$, $B_{ib}$ will be described below.

In Equation (2), the estimation value of the high band sub-band power is calculated by a primary linear combination using power of each of a plurality of sub-band signals from the band pass filter 13, but is not limited thereto, and for example, may be calculated using a linear combination of a plurality of the low band sub-band powers of frames before and after the time frame J, and may be calculated using a nonlinear function.

As described above, the estimation value of the high band sub-band power calculated by the high band sub-band power estimation circuit 15 is supplied to the high band signal production circuit 16 will be described.

[Description of Process by High Band Signal Production Circuit]

Next, a description will be made of process by the high band signal production circuit 16 in step S6 of a flowchart in FIG. 4.

The high band signal production circuit 16 calculates the low band sub-band power power(ib, J) of each sub-band based on Equation (1) described above, from a plurality of sub-band signals supplied from the band pass filter 13. The high band signal production circuit 16 obtains a gain amount G(ib,J) by Equation 3 described below, using a plurality of low band sub-band powers power(ib, J) calculated, and an estimation value $power_{est}(ib,J)$ of the high band sub-band power calculated based on Equation (2) described above by the high band sub-band power estimation circuit 15.

[Equation 3]

$$G(ib,J)=10^{[(power_{est}(ib,J)-power(sb_{map}(ib),J))/20]} \quad (J*FSIZE \le n \le (J+1)FSIZE-1, sb+1 \le lb \le eb) \quad (3)$$

Herein, in Equation (3), $sb_{map}(ib)$ shows the index of the sub-band of an original map of the case where the sub-band ib is considered as the sub-band of an original map and is expressed by the following Equation 4.

[Equation 4]

$$sb_{map}(ib) = ib - 4INT\left(\frac{ib - sb - 1}{4} + 1\right) \quad (sb+1 \le ib \le eb) \quad (4)$$

In addition, in Equation (4), INT (a) is a function which cut down a decimal point of value a.

Next, the high band signal production circuit 16 calculates the sub-band signal x2(*ib,n*) after gain control by multiplying the gain amount G(ib,J) obtained by Equation 3 by an output of the band pass filter 13 using the following Equation (5).

[Equation 5]

$$x2(ib,n)=G(ib,J)\times(sb_{map}(ib),n)(J*FSIZE \le n \le (J+1)FSIZE-1, sb+1 \le ib \le eb) \quad (5)$$

Further, the high band signal production circuit 16 calculates the sub-band signal x3(*ib, n*) after the gain control which is cosine-transferred from the sub-band signal x2(*ib, n*) after adjustment of gain by performing cosine transfer to a frequency corresponding a frequency of the upper end of the sub-band having index of sb from a frequency corresponding to a frequency of the lower end of the sub-band having the index of sb−3 by the following Equation (6).

[Equation 6]

$$x3(ib,n)=x2(ib,n)*2\cos(n)*\{4(ib+1)\pi/32\}(sb+1 \le ib \le eb) \quad (6)$$

In addition, in Equation (6), π shows a circular constant. Equation (6) means that the sub-band signal x2(*ib, n*) after the gain control is shifted to the frequency of each of 4 band part high band sides.

Therefore, the high band signal production circuit 16 calculates the high band signal component $x_{high}(n)$ from the sub-band signal x3(*ib,n*) after the gain control shifted to the high band side according to the following Equation 7.

[Equation 7]

$$x_{high}(n) = \sum_{ib=sb+1}^{eb} x3(ib, n) \quad (7)$$

Accordingly, the high band signal component is produced by the high band signal production circuit 16 based on the 4 low band sub-band powers obtained based on the 4 sub-band signals from the band pass filter 13 and an estimation value of the high band sub-band power from the high band sub-band power estimation circuit 15, and the produced high band signal component is supplied to the high-pass filter 17.

According to process described above, since the low band sub-band power calculated from a plurality of sub-band signals is set as the characteristic amount with respect to the input signal obtained after decoding of the encoded data by the high band cancelation encoding method, the estimation value of the high band sub-band power is calculated based on a coefficient set suitably thereto, and the high band signal component is produced adaptively from the estimation value of the low band sub-band power and the high band sub-band power, whereby it is possible to estimate the sub-band power of the frequency expansion band with high accuracy and to reproduce a music signal with a better sound quality.

As described above, the characteristic amount calculation circuit 14 illustrates an example that calculates as the characteristic amount, only the low band sub-band power calculated from the plurality sub-band signal. However, in this case, the sub-band power of the frequency expansion band cannot be estimated with high accuracy by a kind of the input signal.

Herein, the estimate of the sub-band power of the frequency expansion band in the high band sub-band power estimation circuit 15 can be performed with high accuracy because the characteristic amount calculation circuit 14 calculates a characteristic amount having a strong correlation with an output system of sub-band power of the frequency expansion band (a power spectrum shape of the high band).

[Another Example of Characteristic Amount Calculated by Characteristic Amount Calculation Circuit]

Figure 6:
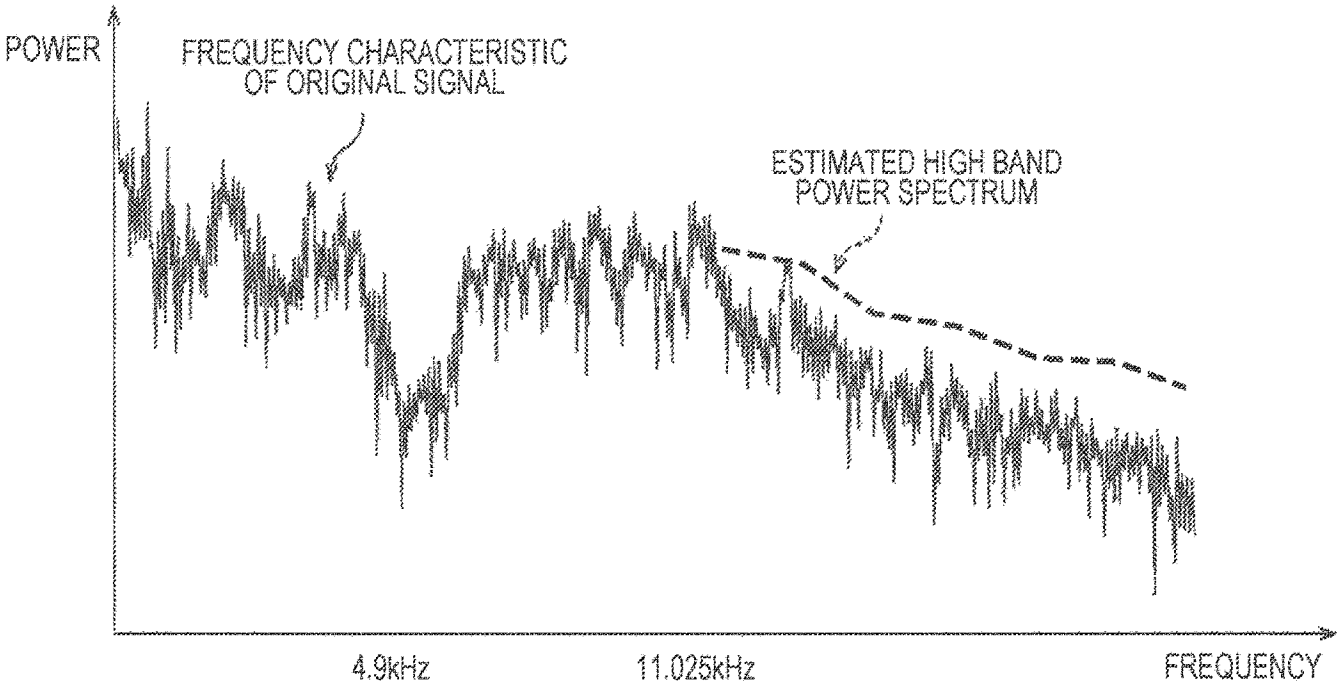
FIG. 6 is a view illustrating an example illustrating frequency characteristics of a vocal region and a power spectrum of a high band estimated.

FIG. 6 illustrates an example of the frequency characteristic of a vocal region where most of vocal is occupied and the power spectrum of the high band obtained by estimating the high band sub-band power by calculating only the low band sub-band power as the characteristic amount.

As illustrated in FIG. 6, in the frequency characteristic of the vocal region, there are many cases where the estimated power spectrum of the high band has a position higher than the power spectrum of the high band of an original signal. Since sense of incongruity of the singing voice of people is easily perceived by the people's ear, it is necessary to estimate the high band sub-band power with high accuracy in vocal region.

In addition, as illustrated in FIG. 6, in the frequency characteristic of the vocal region, there are many cases that a lager concave is disposed from 4.9 kHz to 11.025 kHz.

Herein, as described below, an example will be described which can apply a degree of the concave in 4.9 kHz to 11.025 kHz in the frequency area as a characteristic amount used in estimating the high band sub-band power of the vocal region. In addition, a characteristic amount showing a degree of the concave is referred to as a dip below.

A calculation example of a dip in time frames J dip(J) will be described below.

Fast Fourier Transform (FFT) of 2048 points is performed with respect to signals of 2048 sample sections included in a range of a few frames before and after a time frame J of the input signal, and coefficients on the frequency axis is calculated. The power spectrum is obtained by performing db conversion with respect to the absolute value of each of the calculated coefficients.

Figure 7:
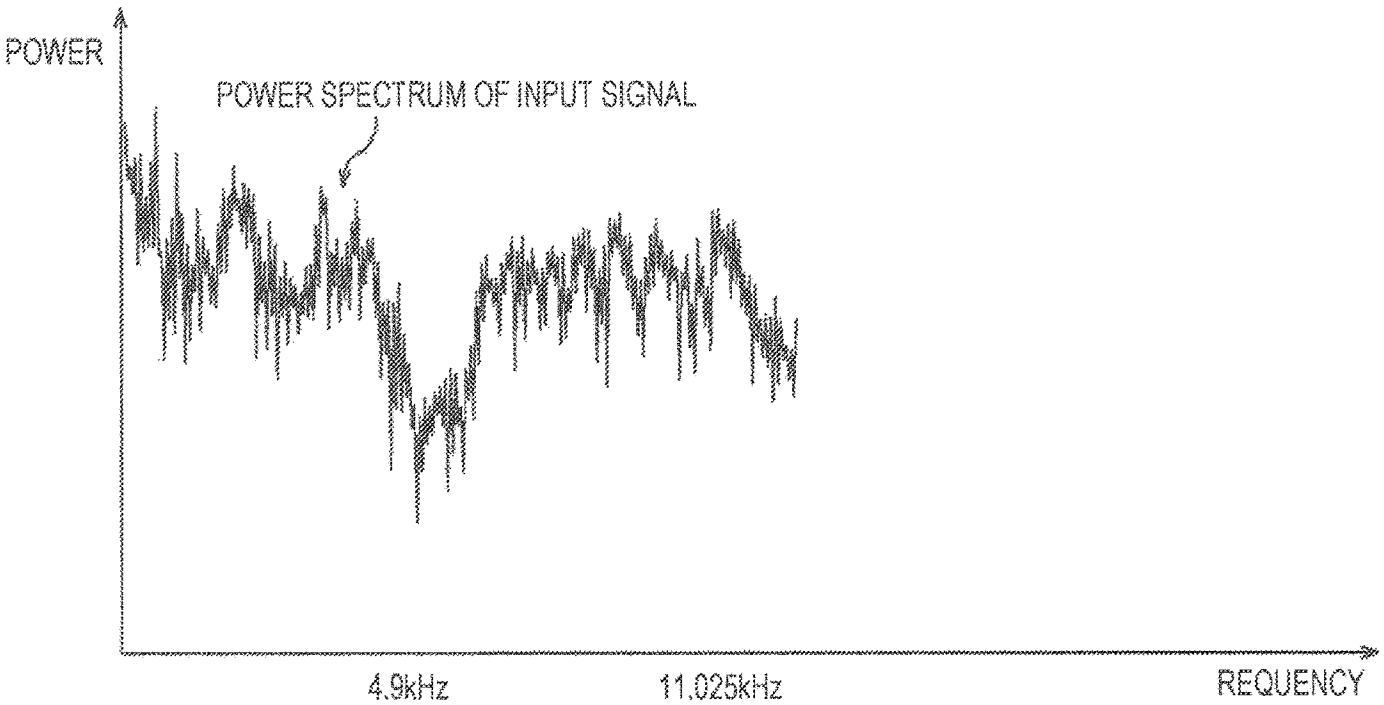
FIG. 7 is a view illustrating an example of a power spectrum of signal input to a frequency band expansion apparatus in FIG. 3.

FIG. 7 illustrates one example of the power spectrum obtained in above-mentioned method. Herein, in order to remove a fine component of the power spectrum, for example so as to remove component of 1.3 kHz or less, a liftering process is performed. If the liftering process is performed, it is possible to smooth the fine component of the spectrum peak by selecting each dimension of the power spectrum and performing a filtering process by applying the low-pass filter according to a time sequence.

Figure 8:
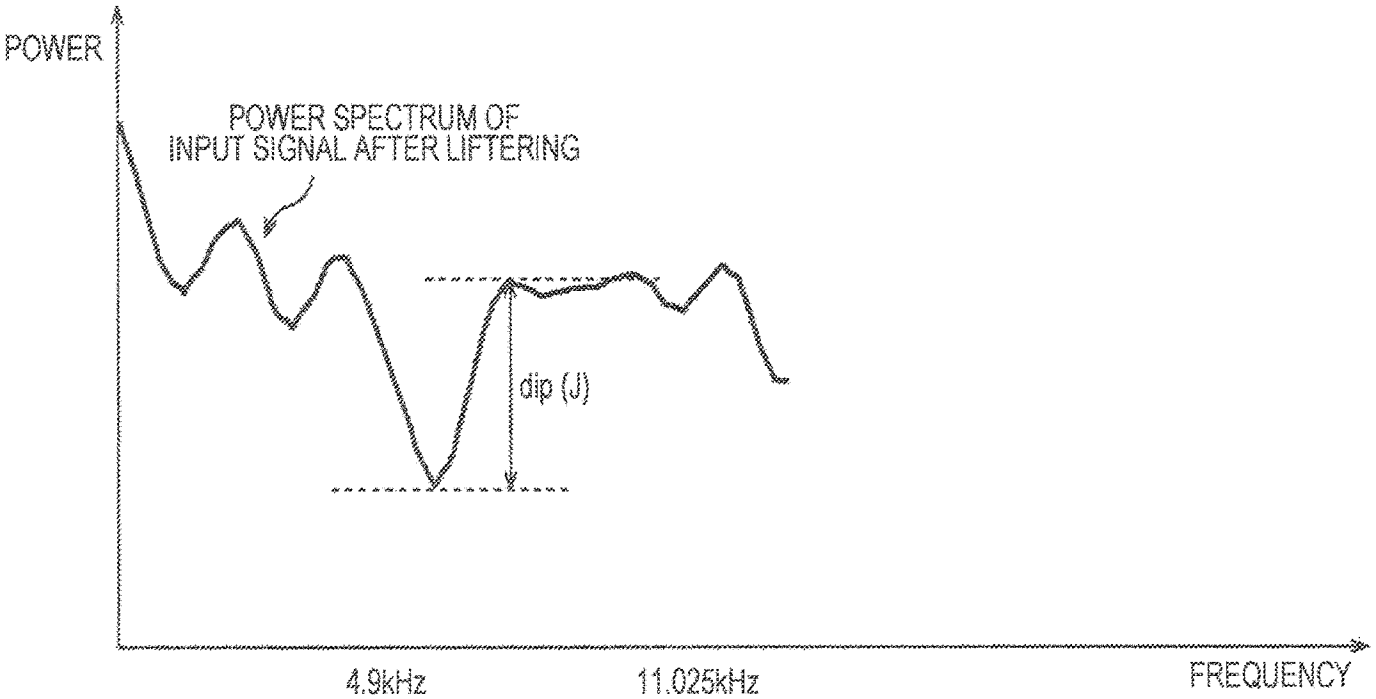
FIG. 8 is a view illustrating an example of a power vector after liftering of an input signal in FIG. 7.

FIG. 8 illustrates an example of the power spectrum of the input signal after liftering. In the power spectrum following recovering illustrated in FIG. 8, difference between minimum value and maximum value included in a range corresponding to 4.9 kHz to 11.025 kHz is set as a dip dip(J).

As described above, the characteristic amount having a strong correlation with the sub-band power of the frequency expansion band is calculated. In addition, a calculation example of a dip dip(J) is not limited to the above-mentioned method, and other method may be performed.

Next, other example of calculation of a characteristic amount having a strong correlation with the sub-band power of the frequency expansion band will be described.

[Still Another Example of Characteristic Amount Calculated by Characteristic Amount Calculation Circuit]

In a frequency characteristic of an attack region, which is, a region including an attack type music signal in any input signal, there are many cases that the power spectrum of the high band is substantially flat as described with reference to FIG. 2. It is difficult for a method calculating as the characteristic amount, only the low band sub-band power to estimate the sub-band power of the almost flat frequency expansion band seen from an attack region with high accuracy in order to estimate the sub-band power of a frequency expansion band without the characteristic amount indicating time variation having a specific input signal including an attack region.

Herein, an example applying time variation of the low band sub-band power will be described below as the characteristic amount used for estimating the high band sub-band power of the attack region.

Time vibration $power_d$ (J) of the low band sub-band power in some time frames J, for example, is obtained from the following Equation (8).

[Equation 8]

$$\text{power}_d(J) = \sum_{ib=sb-3}^{sb} \sum_{n=J*FSIZE}^{(J+1)FSIZE-1} (x(ib,n)^2) \Big/ \sum_{ib=sb-3}^{sb} \sum_{n=(J-1)FSIZE}^{J*FSIZE-1} (x(ib,n)^2) \tag{8}$$

According to Equation 8, time variation $power_d$(J) of a low band sub-band power shows ratio between the sum of four low band sub-band powers in time frames J−1 and the sum of four low band sub-band powers in time frames (J−1) before one frame of the time frames J, and if this value become large, the time variation of power between frames is large, that is, a signal included in time frames J is regarded as having strong attack.

Figure 1:
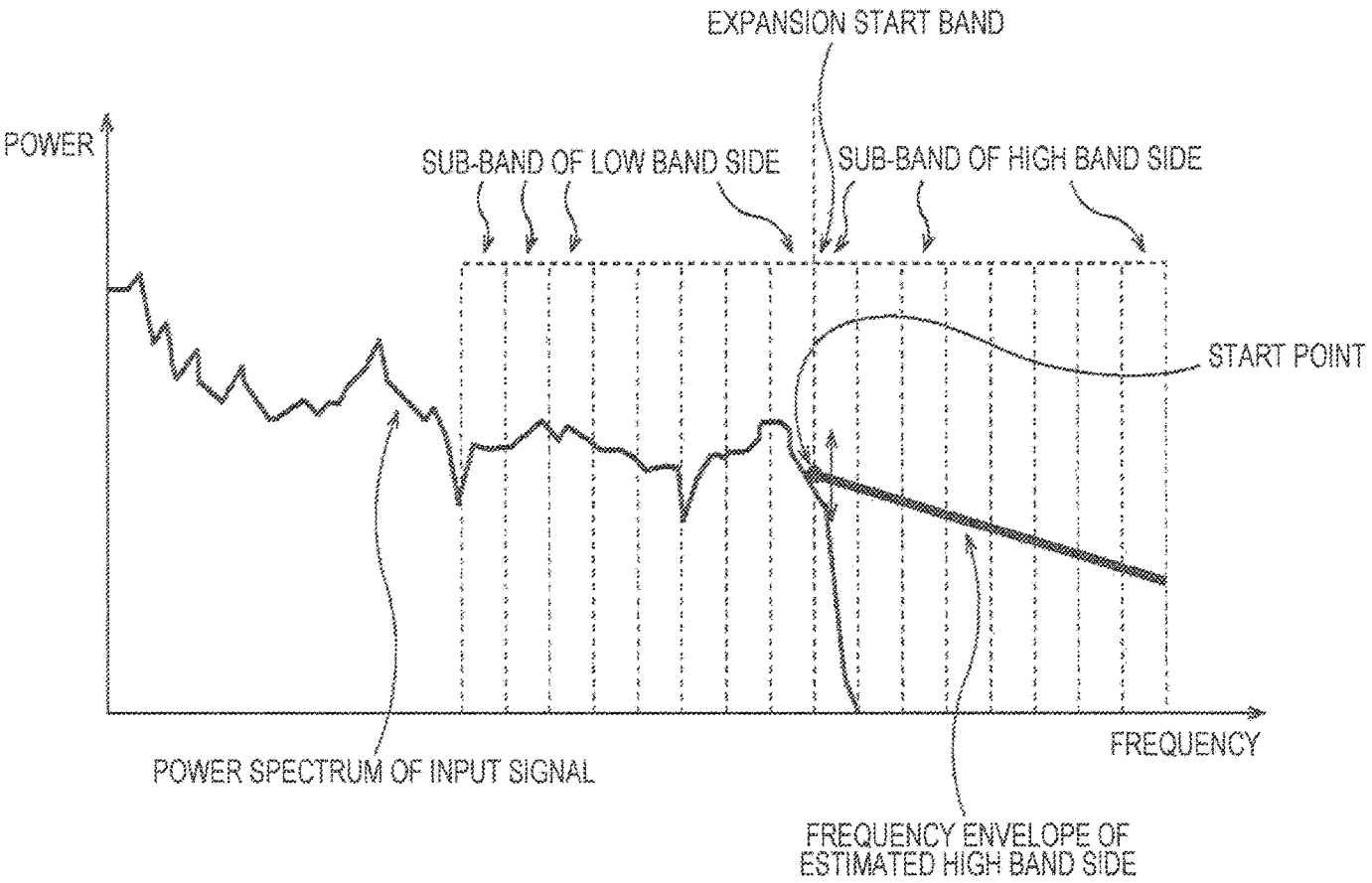
FIG. 1 is a view an example of illustrating in an example of a power spectrum of a low band after decoding an input signal and a frequency envelope of a high band estimated.
Figure 2:
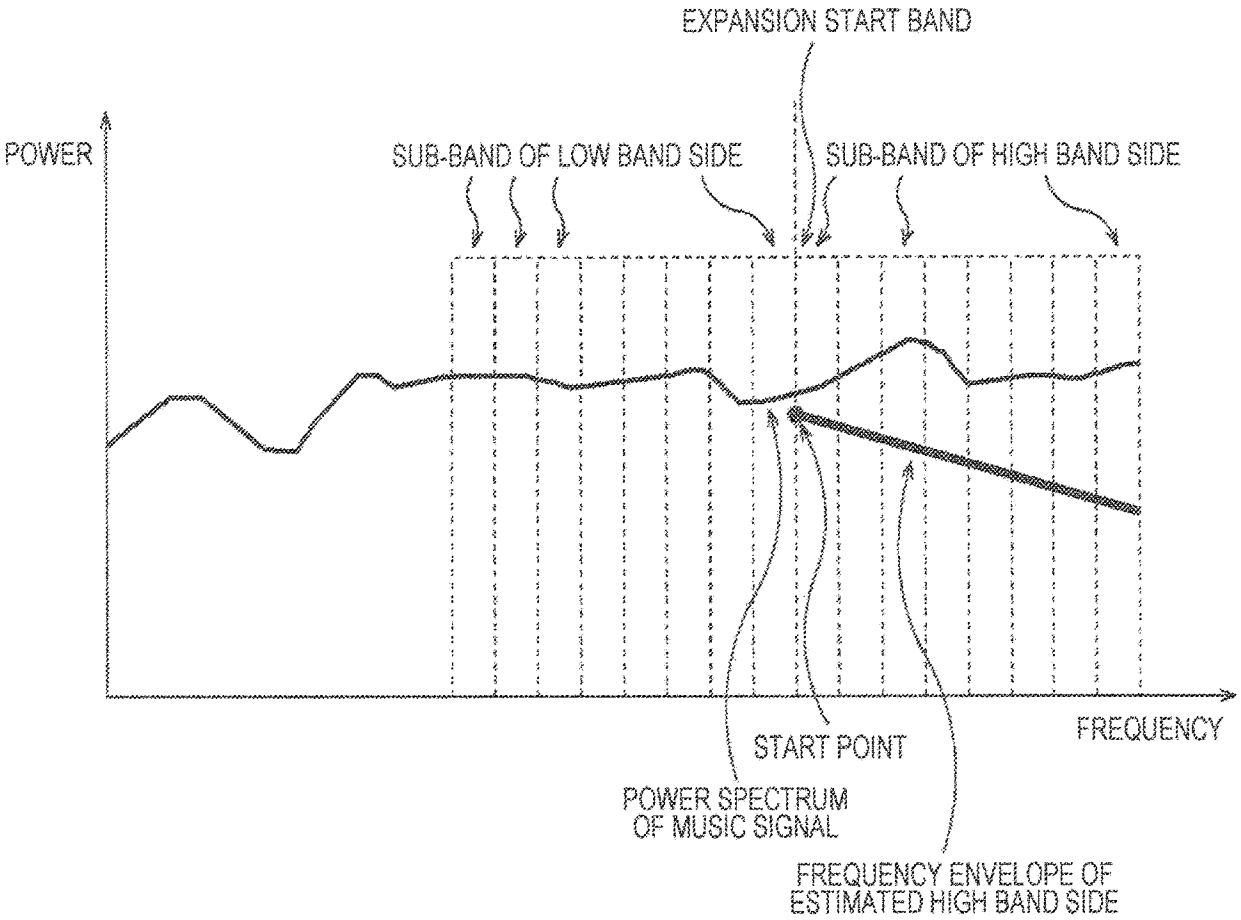
FIG. 2 is a view illustrating an example of an original power spectrum of music signal of an attack according to rapid change in time.

In addition, if the power spectrum illustrated in FIG. 1, which is average statistically is compared with the power spectrum of the attack region (attack type music signal) illustrated in FIG. 2, the power spectrum in the attack region ascends toward the right in a middle band. Between the attack regions, there are many cases which show the frequency characteristics.

Accordingly, an example which applies a slope in the middle band as the characteristic amount used for estimating the high band sub-band power between the attack regions will be described below.

A slope slope (J) of a middle band in some time frames J, for example, is obtained from the following Equation (9).

[Equation 9]

$$\text{slope}(J) = \sum_{ib=sb-3}^{sb} \sum_{n=J*FSIZE}^{(J+1)FSIZE-1} \{W(ib) * x(ib,n)^2)\} \Big/ \sum_{ib=sb-3}^{sb} \sum_{n=J*FSIZE}^{(J+1)FSIZE-1} (x(ib,n)^2) \tag{9}$$

In the Equation (9), a coefficient w (ib) is a weight factor adjusted to be weighted to the high band sub-band power. According to the Equation (9), the slope (J) shows a ratio of the sum of four low band sub-band powers weighted to the high band and the sum of four low band sub-band powers. For example, if four low band sub-band powers are set as a power with respect to the sub-band of the middle band, the slope (J) has a large value when the power spectrum in a middle band ascends to the right, and the power spectrum has small value when the power spectrum descends to the right.

Since there are many cases that the slope of the middle band considerably varies before and after the attack section, it may be assumed that the time variety $slope_d(J)$ of the slope expressed by the following Equation (10) is the characteristic amount used in estimating the high band sub-band power of the attack region.

[Equation 10]

$$slope_d(J)=slope(J)/slope(J-1)(J*FSIZE\leq n\leq(J+1)FSIZE-1) \quad (10)$$

In addition, it may be assumed that time variety $dip_d(J)$ of the dip dip(J) described above, which is expressed by the following Equation (11) is the characteristic amount used in estimating the high band sub-band power of the attack region.

[Equation 11]

$$dip_d(J)=dip(J)-dip(J-1)(J*FSIZE\leq n\leq(J+1)FSIZE-1) \quad (11)$$

According to the above-mentioned method, since the characteristic amount having a strong correlation with the sub-band power of the frequency expansion band is calculated, if using this, the estimation for the sub-band power of the frequency expansion band in the high band sub-band power estimation circuit 15 can be performed with high accuracy.

As described above, an example for calculating the characteristic amount having a strong correlation with the sub-band power of the frequency expansion band was described. However, an example for estimating the high band sub-band power will be described below using the characteristic amount calculated by the method described above.

[Description of Process by High Band Sub-Band Power Estimation Circuit]

Herein, an example for estimating the high band sub-band power using the dip described with reference to FIG. 8 and the low band sub-band power as the characteristic amount will be described.

Figure 4:
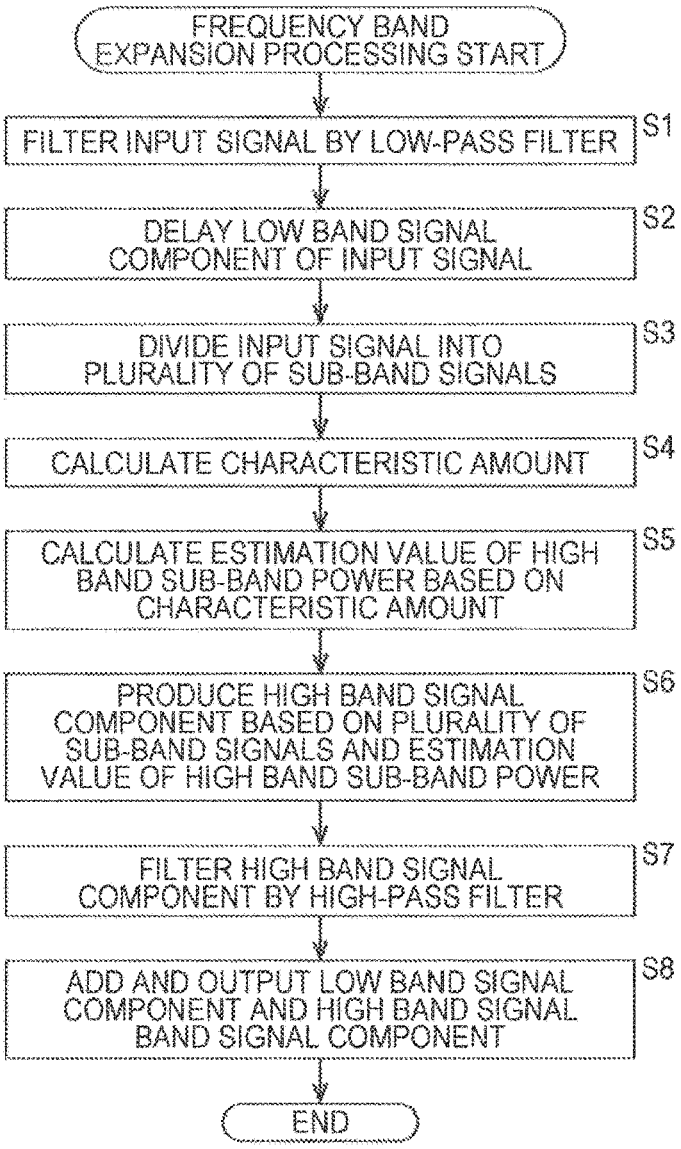
FIG. 4 is a flowchart illustrating an example of a frequency band expansion process by a frequency band expansion apparatus in FIG. 3.

That is, in step S4 of the flowchart in FIG. 4, the characteristic amount calculation circuit 14 calculates as the characteristic amount, the low band sub-band power and the dip and supplies the calculated low band sub-band power and dip to the high band sub-band power estimation circuit 15 for each sub-band from four sub-band signals from the band pass filter 13.

Therefore, in step S5, the high band sub-band power estimation circuit 15 calculates the estimation value of the high band sub-band power based on the four low band sub-band powers and the dip from the characteristic amount calculation circuit 14.

Herein, in the sub-band power and the dip, since ranges of the obtained values (scales) are different from each other, the high band sub-band power estimation circuit 15, for example, performs the following conversion with respect to the dip value.

The high band sub-band power estimation circuit 15 calculates the sub-band power of a maximum band of the four low band sub-band powers and a dip value with respect to a predetermined large amount of the input signal and obtains an average value and standard deviation respectively. Herein, it is assumed that the average value of sub-band power is $power_{ave}$, a standard deviation of the sub-band power is $power_{std}$, the average value of the dip is $dip_{ave}$, and the standard deviation of the dip is $dip_{std}$.

The high band sub-band power estimation circuit 15 converts the value of the dip dip(J) using the value as in the following Equation (12) and obtains the $dip_s$ dip(J) after conversion.

[Equation 12]

$$dip_s(J)=\frac{dip(J)-dip_{ave}}{dip_{std}}power_{std}+power_{ave} \quad (12)$$

By performing conversion described in Equation (12), the high band sub-band power estimation circuit 15 can statistically convert the value of dip dip(J) to an equal variable (dip) $dip_s(J)$ for the average and dispersion of the low band sub-band power and make a range of the value obtained from the dip approximately equal to a range of the value obtained from the sub-band power.

In the frequency expansion band, the estimation value $power_{est}(ib,J)$ of the sub-band power in which index is ib, is expressed, according to Equation 13, by a linear combination of the four low band sub-band powers power(ib,J) from the characteristic amount calculation circuit 14 and the dip $dip_s(J)$ shown in Equation (12).

[Equation 13]

$$power_{est}(ib,J)=\left(\sum_{kb=sb-3}^{sb}\{C_{ib}(kb)power(kb,J)\}\right)+D_{ib}dip_s(J)+E_{ib}(J*FSIZE\leq n\leq(J+1)FSIZE-1,\ sb+1\leq ib\leq eb) \quad (13)$$

Herein, in Equation (13), coefficients $C_{ib}(kb)$, $D_{ib}$, $E_{ib}$ are coefficients having value different for each sub-band ib. The coefficients $C_{ib}(kb)$, $D_{ib}$, and $E_{ib}$ are coefficients set suitably in order to obtain a favorable value with respect to various input signals. In addition, the coefficient $C_{ib}(kb)$, $D_{ib}$ and $E_{ib}$ are also changed to optimal values in order to change sub-band sb. Further, derivation of coefficient $C_{ib}(kb)$, $D_{ib}$, and $E_{ib}$ will be described below.

In Equation (13), the estimation value of the high band sub-band power is calculated by a linear combination, but is not limited thereto. For example, the estimation value may be calculated using a linear combination of a plurality characteristic amount of a few frames before and after the time frame J, and may be calculated using a non-linear function.

According to the process described above, it may be possible to reproduce music signal having a better quality in that estimation accuracy of the high band sub-band power at the vocal region is improved compared with a case that it is assumed that only the low band sub-band power is the characteristic amount in estimation of the high band sub-band power using a value of a specific dip of vocal region as a characteristic amount, the power spectrum of the high band is produced by being estimated to be larger than that of the high band power spectrum of the original signal and sense of incongruity can be easily perceived by the people's ear using a method setting only the low band sub-band as the characteristic amount.

Therefore, if the number of divisions of sub-bands is 16, since frequency resolution is low with respect to the dip calculated as the characteristic amount by the method described above (a degree of the concave in a frequency characteristic of the vocal region), a degree of the concave can not be expressed by only the low band sub-band power.

Herein, the frequency resolution is improved and it may be possible to express the degree of the concave at only the low band sub-band power in that the number of the divisions of the sub-bands increases (for example, 256 divisions of 16 times), the number of the band divisions by the band pass filter 13 increases (for example, 64 of 16 times), and the number of the low band sub-band power calculated by the characteristic amount calculation circuit 14 increases (64 of 16 times).

By only a low band sub-band power, it is assumed that it is possible to estimate the high band sub-band power with accuracy substantially equal to the estimation of the high band sub-band power used as the characteristic amount and the dip described above.

However, a calculation amount increases by increasing the number of the divisions of the sub-bands, the number of the band divisions and the number of the low band sub-band powers. If it is assumed that the high band sub-band power can be estimated with accuracy equal to any method, the method that estimates the high band sub-band power using the dip as the characteristic amount without increasing the number of divisions of the sub-bands is considered to be efficient in terms of the calculation amount.

As described above, a method that estimates the high band sub-band power using the dip and the low band sub-band power was described, but as the characteristic amount used in estimating the high band sub-band power, one or more the characteristic amounts described above (a low band sub-band power, a dip, time variation of the low band sub-band power, slope, time variation of the slope, and time variation of the dip) without being limited to the combination. In this case, it is possible to improve accuracy in estimating the high band sub-band power.

In addition, as described above, in the input signal, it may be possible to improve estimation accuracy of the section by using a specific parameter in which estimation of the high band sub-band power is difficult as the characteristic amount used in estimating the high band sub-band power. For example, time variety of the low band sub-band power, slope, time variety of slope and time variety of the dip are a specific parameter in the attack region, and can improve estimation accuracy of the high band sub-band power in the attack region by using the parameter thereof as the characteristic amount.

In addition, even if estimation of the high band sub-band power is performed using the characteristic amount other than the low band sub-band power and the dip, that is, time variety of the low band sub-band power, slope, time variety of the slope and time variety of the dip, the high band sub-band power can be estimated in the same manner as the method described above.

In addition, each calculation method of the characteristic amount described in the specification is not limited to the method described above, and other method may be used.

[Method for Obtaining Coefficients $C_{ib}$(kb), $D_{ib}$, $E_{ib}$]

Next, a method for obtaining the coefficients $C_{ib}$(kb), $D_{ib}$ and $E_{ib}$ will be described in Equation (13) described above.

The method is applied in which coefficients is determined based on learning result, which performs learning using instruction signal having a predetermined broad band (hereinafter, referred to as a broadband instruction signal) such that as method for obtaining coefficients $C_{ib}$(kb), $D_{ib}$ and $E_{ib}$, coefficients $C_{ib}$(kb), $D_{ib}$ and $E_{ib}$ become suitable values with respect to various input signals in estimating the sub-band power of the frequency expansion band.

When learning of coefficient $C_{ib}$(kb), $D_{ib}$ and $E_{ib}$ is performed, a coefficient learning apparatus including the band pass filter having the same pass band width as the band pass filters 13-1 to 13-4 described with reference to FIG. 5 is applied to the high band higher the expansion initial band. The coefficient learning apparatus performs learning when broadband instruction is input.

[Functional Configuration Example of Coefficient Learning Apparatus]

Figure 9:
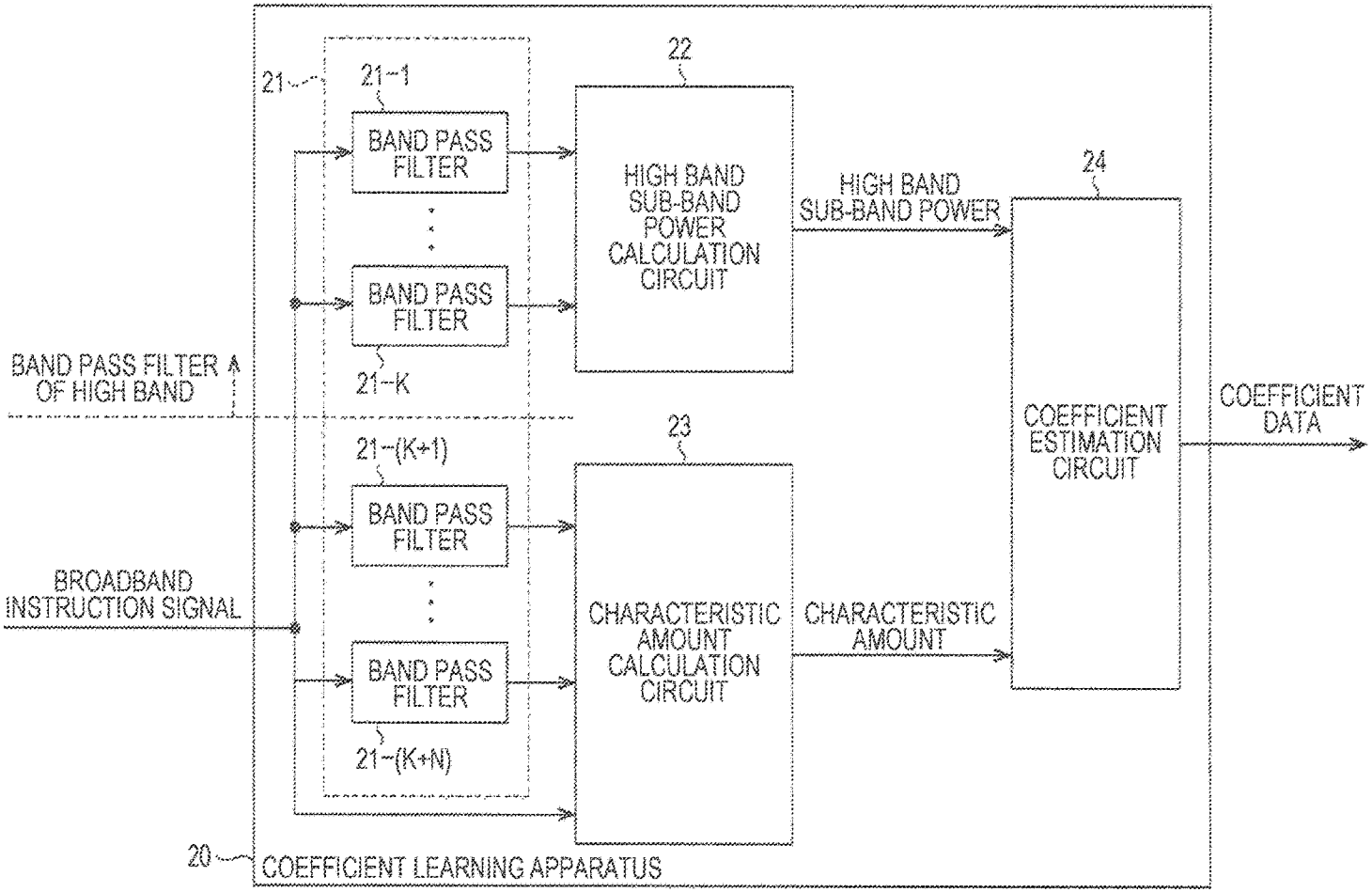
FIG. 9 is a block diagram illustrating a functional configuration example of a coefficient learning apparatus for performing learning of a coefficient used in a high band signal production circuit of a frequency band expansion apparatus in FIG. 3.

FIG. 9 illustrates a functional configuration example of a coefficient learning apparatus performing an instruction of coefficients $C_{ib}$(kb), $D_{ib}$ and $E_{ib}$.

The signal component of the low band lower than the expansion initial band of a broadband instruction signal input to a coefficient learning apparatus 20 in FIG. 9 is a signal encoded in the same manner as an encoding method performed when the input signal having a limited band input to the frequency band expansion apparatus 10 in FIG. 3 is encoded.

A coefficient learning apparatus 20 includes a band pass filter 21, a high band sub-band power calculation circuit 22, a characteristic amount calculation circuit 23, and a coefficient estimation circuit 24.

The band pass filter 21 includes band pass filters 21-1 to 21-(K+N) having the pass bands different from each other. The band pass filter 21-$i$($1 \leq i \leq K+N$) passes a signal of a predetermined pass band of the input signal and supplies the passed signal to the high band sub-band power calculation circuit 22 or the characteristic amount calculation circuit 23 as one of a plurality of sub-band signals. In addition, the band pass filters 21-1 to 21-K of the band pass filters 21-1 to 21-(K+N) pass a signal of the high band higher than the expansion start band.

The high band sub-band power calculation circuit 22 calculates a high band sub-band power of each sub-band for each constant time frame with respect to a plurality of sub-band signals of the high band, from the band pass filter 21 and supplies the calculated high band sub-band power to the coefficient estimation circuit 24.

The characteristic amount calculation circuit 23 calculates the same characteristic amount as the characteristic amount calculated by the characteristic amount calculation circuit 14 of the frequency band expansion apparatus 10 in FIG. 3 for the same respective time frames as a constant time frames in which the high band sub-band power is calculated by the high band sub-band power calculation circuit 22. That is, the characteristic amount calculation circuit 23 calculates one or more characteristic amounts using at least one of a plurality of sub-band signals from the band pass filter 21, and the broadband instruction signal, and supplies the calculated characteristic amounts to the coefficient estimation circuit 24.

The coefficient estimation circuit 24 estimates coefficient (coefficient data) used at the high band sub-band power estimation circuit 15 of the frequency band expansion apparatus 10 in FIG. 3 based on the high band sub-band power from the high band sub-band power calculation circuit 22 and the characteristic amount from the characteristic amount calculation circuit 23 for each constant time frame.

[Coefficient Learning Process of Coefficient Learning Apparatus]

Figure 10:
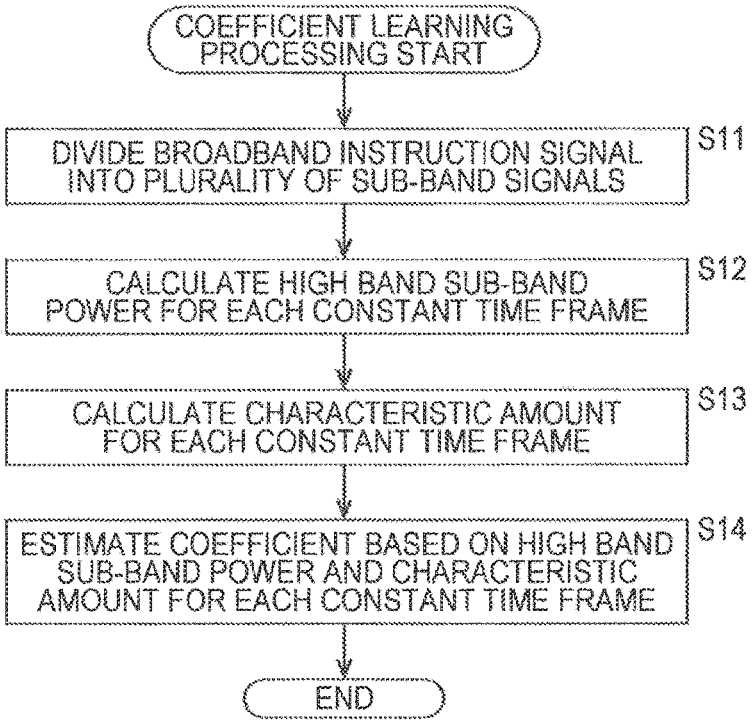
FIG. 10 is a flowchart describing an example of a coefficient learning process by a coefficient learning apparatus in FIG. 9.

Next, referring to a flowchart in FIG. 10, coefficient learning process by a coefficient learning apparatus in FIG. 9 will be described.

In step S11, the band pass filter 21 divides the input signal (expansion band instruction signal) into (K+N) sub-band signals. The band pass filters 21-1 to 21-K supply a plurality of sub-band signals of the high band higher than the expansion initial band to the high band sub-band power calculation circuit 22. In addition, the band pass filters 21-(K+1) to 21-(K+N) supply a plurality of sub-band signals of the low band lower than the expansion initial band to the characteristic amount calculation circuit 23.

In step S12, the high band sub-band power calculation circuit 22 calculates the high band sub-band power power (ib, J) of each sub-band for each constant time frame with respect to a plurality of the sub-band signals of the high band from the band pass filters 21 (band pass filter 21-1 to 21-K). The high band sub-band power power(ib, J) is obtained by the above mentioned Equation (1). The high band sub-band power calculation circuit 22 supplies the calculated high band sub-band power to the coefficient estimation circuit 24.

In step S13, the characteristic amount calculation circuit 23 calculates the characteristic amount for the same each time frame as the constant time frame in which the high band sub-band power is calculated by the high band sub-band power calculation circuit 22.

In addition, as described below, in the characteristic amount calculation circuit 14 of the frequency band expansion apparatus 10 in FIG. 3, it is assumed that the four sub-band powers and the dip of the low band are calculated as the characteristic amount and it will be described that the four sub-band powers and the dip of the low band calculated in the characteristic amount calculation circuit 23 of the coefficient learning apparatus 20 similarly.

That is, the characteristic amount calculation circuit 23 calculates four low band sub-band powers using four sub-band signals of the same respective four sub-band signals input to the characteristic amount calculation circuit 14 of the frequency band expansion apparatus 10 from the band pass filter 21 (band pass filter 21-(K+1) to 21-(K+4)). In addition, the characteristic amount calculation circuit 23 calculates the dip from the expansion band instruction signal and calculates the dip $dip_s(J)$ based on the Equation (12) described above. Further, the characteristic amount calculation circuit 23 supplies the four low band sub-band powers and the dip $dip_s(J)$ as the characteristic amount to the coefficient estimation circuit 24.

In step S14, the coefficient estimation circuit 24 performs estimation of coefficients $C_{ib}(kb)$, $D_{ib}$ and $E_{ib}$ based on a plurality of combinations of the (eb−sb) high band sub-band power of supplied to the same time frames from the high band sub-band power calculation circuit 22 and the characteristic amount calculation circuit 23 and the characteristic amount (four low band sub-band powers and dip $dip_s(J)$). For example, the coefficient estimation circuit 24 determines the coefficients $C_{ib}(kb)$, $D_{ib}$ and $E_{ib}$ in Equation (13) by making five characteristic amounts (four low band sub-band powers and dip $dip_s(J)$) be an explanatory variable with respect to one of the sub-band of the high bands, and making the high band sub-band power power(ib,J) be an explained variable and performing a regression analysis using a least-squares method.

In addition, naturally the estimation method of coefficients $C_{ib}(kb)$, $D_{ib}$ and $E_{ib}$ is not limited to the above-mentioned method and various common parameter identification methods may be applied.

According to the processes described above, since the learning of the coefficients used in estimating the high band sub-band power is set to be performed by using a predetermined expansion band instruction signal, there is possibility to obtain a preferred output result with respect to various input signals input to the frequency band expansion apparatus 10 and thus it may be possible to reproduce a music signal having a better quality.

In addition, it is possible to calculate the coefficients $A_{ib}(kb)$ and $B_{ib}$ in the above-mentioned Equation (2) by the coefficient learning method.

As described above, the coefficient learning processes was described premising that each estimation value of the high band sub-band power is calculated by the linear combination such as the four low band sub-band powers and the dip in the high band sub-band power estimation circuit 15 of the frequency band expansion apparatus 10.

However, a method for estimating the high band sub-band power in the high band sub-band power estimation circuit 15 is not limited to the example described above. For example, since the characteristic amount calculation circuit 14 calculates one or more of the characteristic amounts other than the dip (time variation of a low band sub-band power, slope, time variation of the slope and time variation of the dip), the high band sub-band power may be calculated, the linear combination of a plurality of characteristic amount of a plurality of frames before and after time frames J may be used, or a non-linear function may be used. That is, in the coefficient learning process, the coefficient estimation circuit 24 may calculate (learn) the coefficient on the same condition as that regarding the characteristic amount, the time frames and the function used in a case where the high band sub-band power is calculated by the high band sub-band power estimation circuit 15 of the frequency band expansion apparatus 10.

2. Second Embodiment

In a second embodiment, encoding processing and decoding processing in the high band characteristic encoding method by the encoder and the decoder are performed.

[Functional Configuration Example of Encoder]

Figure 11:
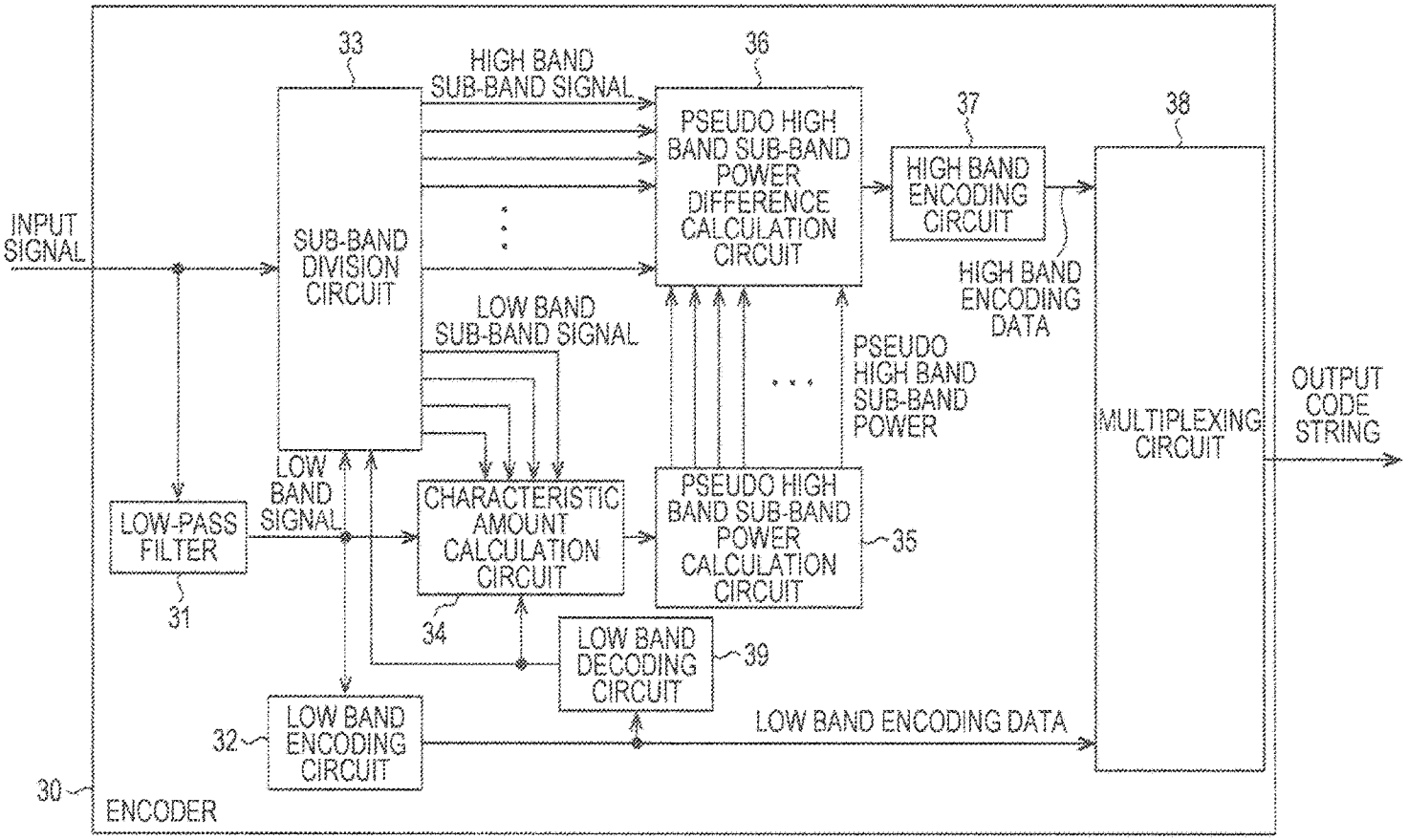
FIG. 11 is a block diagram illustrating a functional configuration example of an encoder in a second embodiment of the present invention.

FIG. 11 illustrates a functional configuration example of the encoder to which the present invention is applied.

An encoder 30 includes a 31, a low band encoding circuit 32, a sub-band division circuit 33, a characteristic amount calculation circuit 34, a pseudo high band sub-band power calculation circuit 35, a pseudo high band sub-band power difference calculation circuit 36, a high band encoding circuit 37, a multiplexing circuit 38 and a low band decoding circuit 39.

The low-pass filter 31 filters an input signal using a predetermined cutoff frequency and supplies a signal of a low band lower than a cutoff frequency (hereinafter, referred to as a low band signal) as signal after filtering to the low band encoding circuit 32, a sub-band division circuit 33, and a characteristic amount calculation circuit 34.

The low band encoding circuit 32 encodes a low band signal from the low-pass filter 31 and supplies low band encoded data obtained from the result to the multiplexing circuit 38 and the low band decoding circuit 39.

The sub-band division circuit 33 equally divides the input signal and the low band signal from the low-pass filter 31 into a plurality of sub-band signals having a predetermined band width and supplies the divided signals to the characteristic amount calculation circuit 34 or the pseudo high band sub-band power difference calculation circuit 36. In particular, the sub-band division circuit 33 supplies a plurality of sub-band signals (hereinafter, referred to as a low band sub-band signal) obtained by inputting to the low band signal, to the characteristic amount calculation circuit 34. In addition, the sub-band division circuit 33 supplies the sub-band signal (hereinafter, referred to as a high band sub-band signal) of the high band higher than a cutoff frequency set by the low-pass filter 31 among a plurality of the sub-band signals obtained by inputting an input signal to the pseudo high band sub-band power difference calculation circuit 36.

The characteristic amount calculation circuit 34 calculates one or more characteristic amounts using any one of a plurality of sub-band signals of the low band sub-band signal from the sub-band division circuit 33 and the low band signal from the low-pass filter 31 and supplies the calculated characteristic amounts to the pseudo high band sub-band power calculation circuit 35.

The pseudo high band sub-band power calculation circuit 35 produces a pseudo high band sub-band power based on one or more characteristic amounts from the characteristic amount calculation circuit 34 and supplies the produced pseudo high band sub-band power to the pseudo high band sub-band power difference calculation circuit 36.

The pseudo high band sub-band power difference calculation circuit 36 calculates a pseudo high band sub-band power difference described below based on the high band sub-band signal from the sub-band division circuit 33 and the pseudo high band sub-band power from the pseudo high band sub-band power calculation circuit 35 and supplies the calculated pseudo high band sub-band power difference to the high band encoding circuit 37.

The high band encoding circuit 37 encodes the pseudo high band sub-band power difference from the pseudo high band sub-band power difference calculation circuit 36 and supplies the high band encoded data obtained from the result to the multiplexing circuit 38.

The multiplexing circuit 38 multiples the low band encoded data from the low band encoding circuit 32 and the high band encoded data from the high band encoding circuit 37 and outputs as an output code string.

The low band decoding circuit 39 suitably decodes the low band encoded data from the low band encoding circuit 32 and supplies decoded data obtained from the result to the sub-band division circuit 33 and the characteristic amount calculation circuit 34.

[Encoding Processing of Encoder]

Next, referring to a flowchart in FIG. 12, the encoding processing by the encoder 30 in FIG. 11 will be described.

In step S111, the low-pass filter 31 filters the input signal using a predetermined cutoff frequency and supplies the low band signal as the signal after filtering to the low band encoding circuit 32, the sub-band division circuit 33 and the characteristic amount calculation circuit 34.

In step S112, the low band encoding circuit 32 encodes the low band signal from the low-pass filter 31 and supplies low band encoded data obtained from the result to the multiplexing circuit 38.

In addition, for encoding of the low band signal in step S112, a suitable encoding method should be selected according to an encoding efficiency and a obtained circuit scale, and the present invention does not depend on the encoding method.

In step S113, the sub-band division circuit 33 equally divides the input signal and the low band signal to a plurality of sub-band signals having a predetermined bandwidth. The sub-band division circuit 33 supplies the low band sub-band signal obtained by inputting the low band signal to the characteristic amount calculation circuit 34. In addition, the sub-band division circuit 33 supplies the high band sub-band signal of a band higher than a frequency of the band limit, which is set by the low-pass filter 31 of a plurality of sub-band signals obtained by inputting the input signal to the pseudo high band sub-band power difference calculation circuit 36.

In a step S114, the characteristic amount calculation circuit 34 calculates one or more characteristic amounts using at least any one of a plurality of sub-band signals of the low band sub-band signal from sub-band division circuit 33 and a low band signal from the low-pass filter 31 and supplies the calculated characteristic amounts to the pseudo high band sub-band power calculation circuit 35. In addition, the characteristic amount calculation circuit 34 in FIG. 11 has basically the same configuration and function as those of the characteristic amount calculation circuit 14 in FIG. 3. Since a process in step S114 is substantially identical with that of step S4 of a flowchart in FIG. 4, the description thereof is omitted.

In step S115, the pseudo high band sub-band power calculation circuit 35 produces a pseudo high band sub-band power based on one or more characteristic amounts from the characteristic amount calculation circuit 34 and supplies the produced pseudo high band sub-band power to the pseudo high band sub-band power difference calculation circuit 36. In addition, the pseudo high band sub-band power calculation circuit 35 in FIG. 11 has basically the same configuration and function as those of the high band sub-band power estimation circuit 15 in FIG. 3. Therefore, since a process in step S115 is substantially identical with that of step S5 of a flowchart in FIG. 4, the description thereof is omitted.

In step S116, a pseudo high band sub-band power difference calculation circuit 36 calculates the pseudo high band sub-band power difference based on the high band sub-band signal from the sub-band division circuit 33 and the pseudo high band sub-band power from the pseudo high band sub-band power calculation circuit 35 and supplies the calculated pseudo high band sub-band power difference to the high band encoding circuit 37.

Specifically, the pseudo high band sub-band power difference calculation circuit 36 calculates the (high band) sub-band power power(ib,J) in a constant time frames J with respect to the high band sub-band signal from the sub-band division circuit 33. In addition, in an embodiment of the present invention, all the sub-band of the low band sub-band signal and the sub-band of the high band sub-band signal distinguishes using the index ib. The calculation method of the sub-band power can apply to the same method as first embodiment, that is, the method used by Equation (1) thereto.

Next, the pseudo high band sub-band power difference calculation circuit 36 calculates a difference value (pseudo high band sub-band power difference) $\text{power}_{diff}(\text{ib},\text{J})$ between the high band sub-band power power (ib, J) and the pseudo high band sub-band power $\text{power}_{lh}(\text{ib},\text{J})$ from the pseudo high band sub-band power calculation circuit 35 in a time frame J. The pseudo high band sub-band power difference $\text{power}_{diff}(\text{ib},\text{J})$ is obtained by the following Equation (14).

[Equation 14]

$$\text{power}_{diff}(ib,J)=\text{power}(ib,J)-\text{power}_{lh}(ib,J)$$
$$(J*F\text{SIZE}\leq n\leq(J+1)F\text{SIZE}-1, sb+1\leq ib\leq eb) \quad (14)$$

In Equation (14), an index sb+1 shows an index of the sub-band of the lowest band in the high band sub-band signal. In addition, an index eb shows an index of the sub-band of the highest band encoded in the high band sub-band signal.

As described above, the pseudo high band sub-band power difference calculated by the pseudo high band sub-band power difference calculation circuit 36 is supplied to the high band encoding circuit 37.

In step S117, the high band encoding circuit 37 encodes the pseudo high band sub-band power difference from the pseudo high band sub-band power difference calculation circuit 36 and supplies high band encoded data obtained from the result to the multiplexing circuit 38.

Specifically, the high band encoding circuit 37 determines that on obtained by making the pseudo high band sub-band power difference from the pseudo high band sub-band power difference calculation circuit 36 be a vector (hereinafter, referred to as a pseudo high band sub-band power difference vector) belongs to which cluster among a plurality of clusters in a characteristic space of the predetermined pseudo high band power sub-band difference. Herein, the pseudo high band sub-band power difference vector in a time frame J has, as a element of the vector, a value of a pseudo high band sub-band power difference $power_{diff}(ib,J)$ for each index ib, and shows the vector of an (eb−sb) dimension. In addition, the characteristic space of the pseudo high band sub-band power difference is set as a space of the (eb−sb) dimension in the same way.

Therefore, the high band encoding circuit 37 measures a distance between a plurality of each representative vector of a plurality of predetermined clusters and the pseudo high band sub-band power difference vector in a characteristic space of the pseudo high band sub-band power difference, obtains index of the cluster having the shortest distance (hereinafter, referred to as a pseudo high band sub-band power difference ID) and supplies the obtained index as the high band encoded data to the multiplexing circuit 38.

In step S118, the multiplexing circuit 38 multiples low band encoded data output from the low band encoding circuit 32 and high band encoded data output from the high band encoding circuit 37 and outputs an output code string.

Therefore, as an encoder in the high band characteristic encoding method, Japanese Patent Application Laid-Open No. 2007-17908 discloses a technology producing the pseudo high band sub-band signal from the low band sub-band signal, comparing the pseudo high band sub-band signal and power of the high band sub-band signal with each other for each sub-band, calculating a gain of power for each sub-band to match the power of the pseudo high band sub-band signal to the power of the high band sub-band signal, and causing the calculated gain to be included in the code string as information of the high band characteristic.

According to the process described above, only the pseudo high band sub-band power difference ID may be included in the output code string as information for estimating the high band sub-band power in decoding. That is, for example, if the number of the predetermined clusters is 64, as information for restoring the high band signal in a decoder, 6 bit information may be added to the code string per a time frame and an amount of information included in the code string can be reduced to improve decoding efficiency compared with a method disclosed in Japanese Patent Application Laid-Open No. 2007-17908, and it is possible to reproduce a music signal having a better sound quality.

In addition, in the processes described above, the low band decoding circuit 39 may input the low band signal obtained by decoding the low band encoded data from the low band encoding circuit 32 to the sub-band division circuit 33 and the characteristic amount calculation circuit 34 if there is a margin in the characteristic amount. In the decoding processing by the decoder, the characteristic amount is calculated from the low band signal decoding the low band encoded data and the power of the high band sub-band is estimated based on the characteristic amount. Therefore, even in the encoding processing, if the pseudo high band sub-band power difference ID which is calculated based on the characteristic amount calculated from the decoded low band signal is included in the code string, in the decoding processing by the decoder, the high band sub-band power having a better accuracy can be estimated. Therefore, it is possible to reproduce a music signal having a better sound quality.

[Functional Configuration Example of Decoder]

Next, referring to FIG. 13, a functional configuration example of a decoder corresponding to the encoder 30 in FIG. 11 will be described.

A decoder 40 includes a demultiplexing circuit 41, a low band decoding circuit 42, a sub-band division circuit 43, a characteristic amount calculation circuit 44, and a high band decoding circuit 45, a decoded high band sub-band power calculation circuit 46, a decoded high band signal production circuit 47, and a synthesis circuit 48.

The demultiplexing circuit 41 demultiplexes the input code string into the high band encoded data and the low band encoded data and supplies the low band encoded data to the low band decoding circuit 42 and supplies the high band encoded data to the high band decoding circuit 45.

The low band decoding circuit 42 performs decoding of the low band encoded data from the demultiplexing circuit 41. The low band decoding circuit 42 supplies a signal of a low band obtained from the result of the decoding (hereinafter, referred to as a decoded low band signal) to the sub-band division circuit 43, the characteristic amount calculation circuit 44 and the synthesis circuit 48.

The sub-band division circuit 43 equally divides a decoded low band signal from the low band decoding circuit 42 into a plurality of sub-band signals having a predetermined bandwidth and supplies the sub-band signal (decoded low band sub-band signal) to the characteristic amount calculation circuit 44 and the decoded high band signal production circuit 47.

The characteristic amount calculation circuit 44 calculates one or more characteristic amounts using any one of a plurality of sub-band signals of decoded low band sub-band signals from the sub-band division circuit 43, and a decoded low band signal from a low band decoding circuit 42, and supplies the calculated characteristic amounts to the decoded high band sub-band power calculation circuit 46.

The high band decoding circuit 45 decodes high band encoded data from the demultiplexing circuit 41 and supplies a coefficient (hereinafter, referred to as a decoded high band sub-band power estimation coefficient) for estimating a high band sub-band power using a pseudo high band sub-band power difference ID obtained from the result, which is prepared for each predetermined ID (index), to the decoded high band sub-band power calculation circuit 46.

The decoded high band sub-band power calculation circuit 46 calculates the decoded high band sub-band power based on one or more characteristic amounts from the characteristic amount calculation circuit 44 and the decoded high band sub-band power estimation coefficient from the high band decoding circuit 45 and supplies the calculated decoded high band sub-band power to the decoded high band signal production circuit 47.

The decoded high band signal production circuit 47 produces a decoded high band signal based on a decoded low band sub-band signal from the sub-band division circuit 43 and the decoded high band sub-band power from the decoded high band sub-band power calculation circuit 46 and supplies the produced signal and power to the synthesis circuit 48.

The synthesis circuit 48 synthesizes a decoded low band signal from the low band decoding circuit 42 and the decoded high band signal from the decoded high band signal production circuit 47 and outputs the synthesized signals as an output signal.

[Decoding Process of Decoder]

Next, a decoding process using the decoder in FIG. 13 will be described with reference to a flowchart in FIG. 14.

In step S131, the demultiplexing circuit 41 demultiplexes an input code string into the high band encoded data and the low band encoded data, supplies the low band encoded data to the low band decoding circuit 42 and supplies the high band encoded data to the high band decoding circuit 45.

In step S132, the low band decoding circuit 42 decodes the low band encoded data from the demultiplexing circuit 41 and supplies the decoded low band signal obtained from the result to the sub-band division circuit 43, the characteristic amount calculation circuit 44 and the synthesis circuit 48.

In step S133, the sub-band division circuit 43 equally divides the decoded low band signal from the low band decoding circuit 42 into a plurality of sub-band signals having a predetermined bandwidth and supplies the obtained decoded low band sub-band signal to the characteristic amount calculation circuit 44 and the decoded high band signal production circuit 47.

In step S134, the characteristic amount calculation circuit 44 calculates one or more characteristic amount from any one of a plurality of the sub-band signals of the decoded low band sub-band signals from the sub-band division circuit 43 and the decoded low band signal from the low band decoding circuit 42 and supplies the signals to the decoded high band sub-band power calculation circuit 46. In addition, the characteristic amount calculation circuit 44 in FIG. 13 basically has the same configuration and function as the characteristic amount calculation circuit 14 in FIG. 3 and the process in step S134 has the same process in step S4 of a flowchart in FIG. 4. Therefore, the description thereof is omitted.

In step S135, the high band decoding circuit 45 decodes the high band encoded data from the demultiplexing circuit 41 and supplies the decoded high band sub-band power estimation coefficient prepared for each predetermined ID (index) using the pseudo high band sub-band power difference ID obtained from the result to the decoded high band sub-band power calculation circuit 46.

In step S136, the decoded high band sub-band power calculation circuit 46 calculates the decoded high band sub-band power based on one or more characteristic amount from the characteristic amount calculation circuit 44 and the decoded high band sub-band power estimation coefficient from the high band decoding circuit 45 and supplies the power to the decoded high band signal production circuit 47. In addition, since the decoding high band, decoding high bans sub-band calculation circuit 46 in FIG. 13 has the same configuration and a function as those of the high band sub-band power estimation circuit 15 in FIG. 3 and process in step S136 has the same process in step S5 of a flowchart in FIG. 4, the detailed description is omitted.

In step S137, the decoded high band signal production circuit 47 outputs a decoded high band signal based on a decoded low band sub-band signal from the sub-band division circuit 43 and a decoded high band sub-band power from the decoded high band sub-band power calculation circuit 46. In addition, since the decoded high band signal production circuit 47 in FIG. 13 basically has the same configuration and function as the high band signal production circuit 16 in FIG. 3 and the process in step S137 has the same process as step S6 of the flowchart in FIG. 4, the detailed description thereof is omitted.

In step S138, the synthesis circuit 48 synthesizes a decoded low band signal from the low band decoding circuit 42 and a decoded high band signal from the decoded high band signal production circuit 47 and outputs synthesized signal as an output signal.

According to the process described above, it is possible to improve estimation accuracy of the high band sub-band power and thus it is possible to reproduce music signals having a good quality in decoding by using the high band sub-band power estimation coefficient in decoding in response to the difference characteristic between the pseudo high band sub-band power calculated in advance in encoding and an actual high band sub-band power.

In addition, according to the process, since information for producing the high band signal included in the code string has only a pseudo high band sub-band power difference ID, it is possible to effectively perform the decoding processing.

As described above, although the encoding process and decoding processing according to the present invention are described, hereinafter, a method of calculates each representative vector of a plurality of clusters in a specific space of a predetermined pseudo high band sub-band power difference in the high band encoding circuit 37 of the encoder 30 in FIG. 11 and a decoded high band sub-band power estimation coefficient output by the high band decoding circuit 45 of the decoder 40 in FIG. 13 will be described.

[Calculation Method of Calculating Representative Vector of a Plurality of Clusters in Specific Space of Pseudo High Band Sub-Band Power Difference and Decoding High Bond Sub-Band Power Estimation Coefficient Corresponding to Each Cluster]

As a way for obtaining the representative vector of a plurality of clusters and the decoded high band sub-band power estimation coefficient of each cluster, it is necessary to prepare the coefficient so as to estimate the high band sub-band power in a high accuracy in decoding in response to a pseudo high band sub-band power difference vector calculated in encoding. Therefore, learning is performed by a broadband instruction signal in advance and the method of determining the learning is applied based on the learning result.

[Functional Configuration Example of Coefficient Learning Apparatus]

Figure 15:
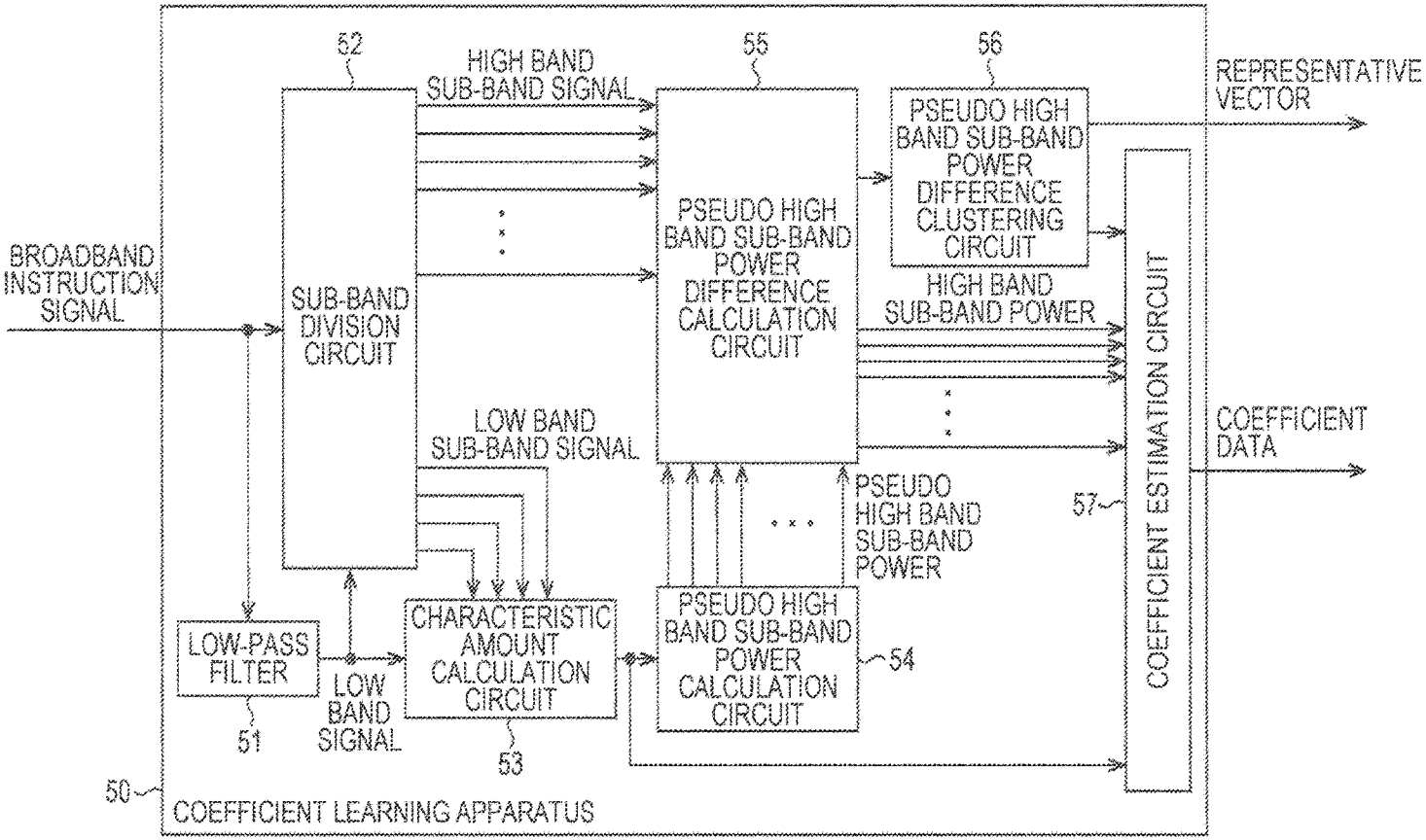
FIG. 15 is a block diagram illustrating a functional configuration example of a coefficient learning apparatus for performing learning of a representative vector used in a high band encoding circuit of an encoder in FIG. 11 and decoded high band sub-band power estimation coefficient used in a high band decoding circuit of decoder in FIG. 13.

FIG. 15 illustrates a functional configuration example of a coefficient learning apparatus performing learning of a representative vector of a plurality of cluster and a decoded high band sub-band power estimation coefficient of each cluster.

It is preferable that a signal component of the broadband instruction signal input to the coefficient learning apparatus 50 in FIG. 15 and of a cutoff frequency or less set by a low-pass filter 31 of the encoder 30 is a decoded low band signal in which the input signal to the encoder 30 passes through the low-pass filter 31, that is encoded by the low band encoding circuit 32 and that is decoded by the low band decoding circuit 42 of the decoder 40.

A coefficient learning apparatus 50 includes a low-pass filter 51, a sub-band division circuit 52, a characteristic amount calculation circuit 53, a pseudo high band sub-band power calculation circuit 54, a pseudo high band sub-band power difference calculation circuit 55, a pseudo high band sub-band power difference clustering circuit 56 and a coefficient estimation circuit 57.

In addition, since each of the low-pass filter 51, the sub-band division circuit 52, the characteristic amount calculation circuit 53 and the pseudo high band sub-band power calculation circuit 54 in the coefficient learning apparatus 50 in FIG. 15 basically has the same configuration and function as each of the low-pass filter 31, the sub-band division circuit 33, the characteristic amount calculation circuit 34 and the pseudo high band sub-band power calculation circuit 35 in the encoder 30 in FIG. 11, the description thereof is suitably omitted.

In other word, although the pseudo high band sub-band power difference calculation circuit 55 provides the same configuration and function as the pseudo high band sub-band power difference calculation circuit 36 in FIG. 11, the calculated pseudo high band sub-band power difference is supplied to the pseudo high band sub-band power difference clustering circuit 56 and the high band sub-band power calculated when calculating the pseudo high band sub-band power difference is supplied to the coefficient estimation circuit 57.

The pseudo high band sub-band power difference clustering circuit 56 clusters a pseudo high band sub-band power difference vector obtained from a pseudo high band sub-band power difference from the pseudo high band sub-band power difference calculation circuit 55 and calculates the representative vector at each cluster.

The coefficient estimation circuit 57 calculates the high band sub-band power estimation coefficient for each cluster clustered by the pseudo high band sub-band power difference clustering circuit 56 based on a high band sub-band power from the pseudo high band sub-band power difference calculation circuit 55 and one or more characteristic amount from the characteristic amount calculation circuit 53.

[Coefficient Learning Process of Coefficient Learning Apparatus]

Next, a coefficient learning process by the coefficient learning apparatus 50 in FIG. 15 will be described with reference to a flowchart in FIG. 16.

Figure 12:
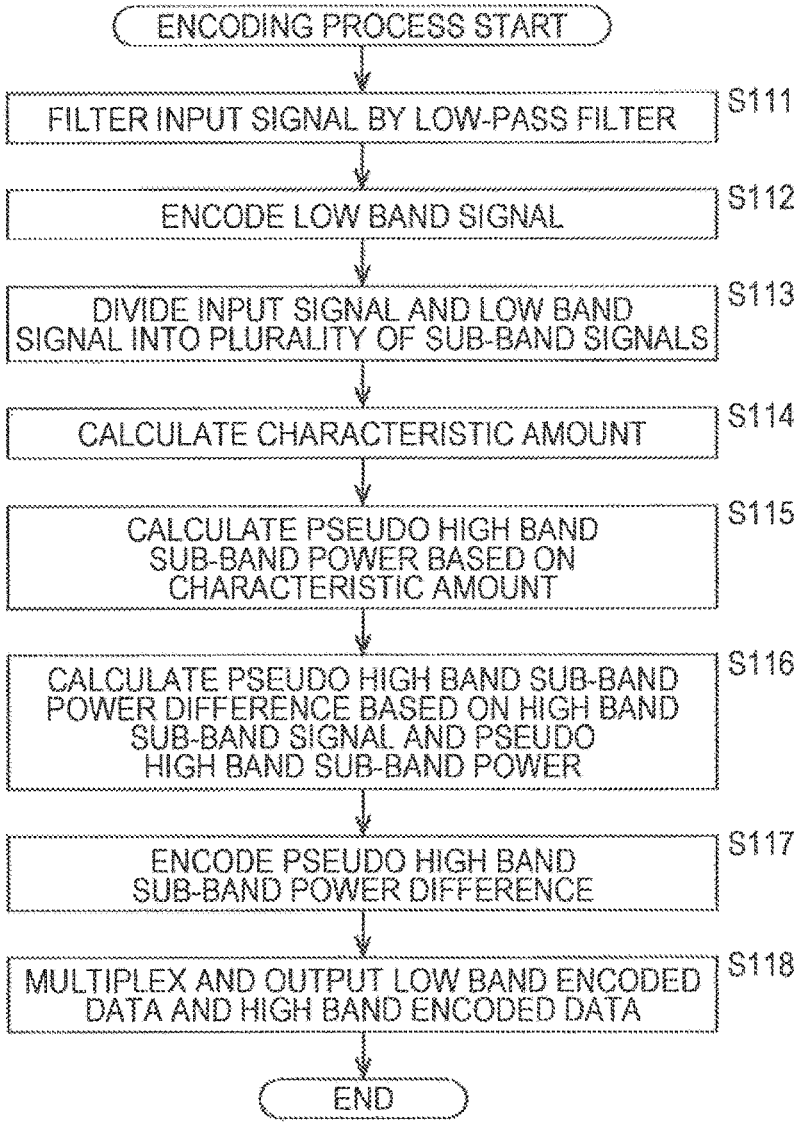
FIG. 12 is a flowchart describing an example of an encoding process by an encoder in FIG. 11.
Figure 16:
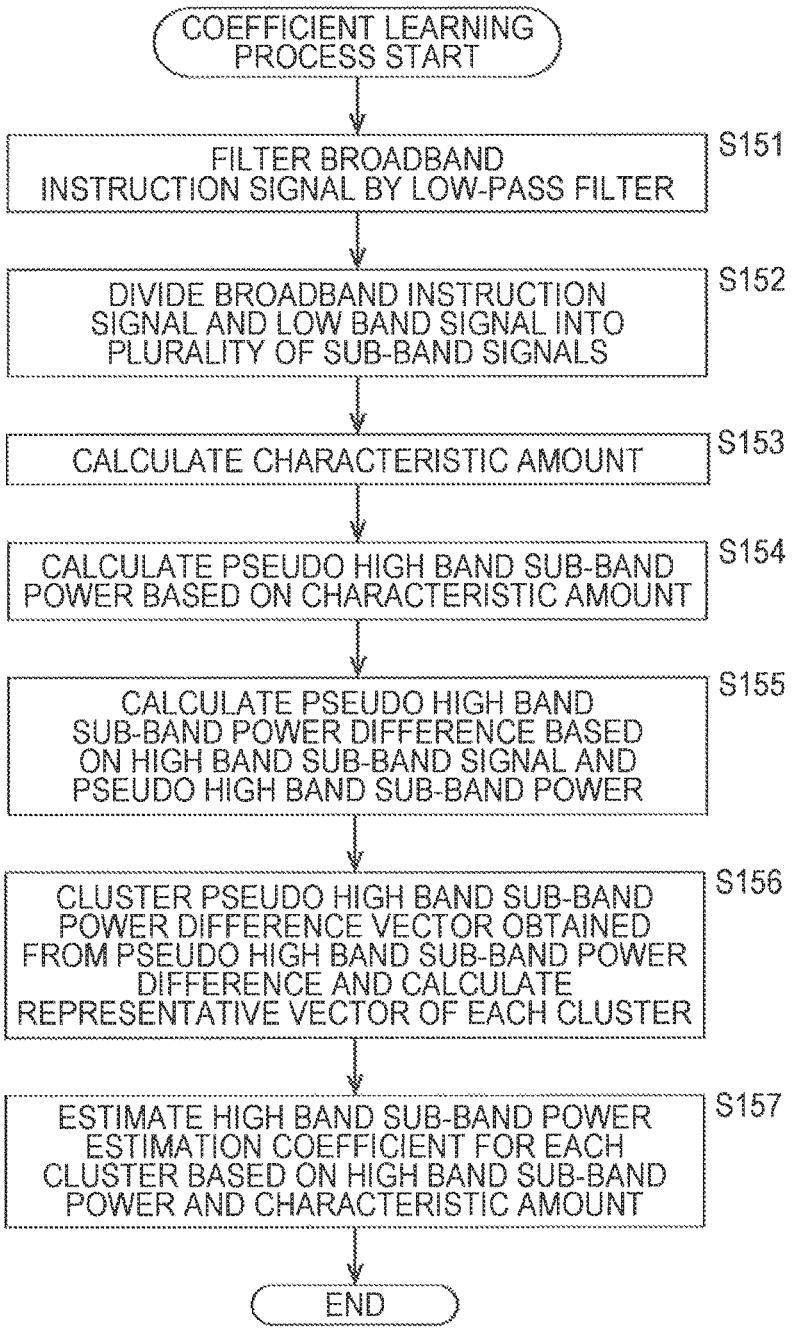
FIG. 16 is a flowchart describing an example of a coefficient learning process by a coefficient learning apparatus in FIG. 15.

In addition, the process of step S151 to S155 of a flowchart in FIG. 16 is identical with those of step S111, S113 to S116 of a flowchart in FIG. 12 except that signal input to the coefficient learning apparatus 50 is a broadband instruction signal, and thus the description thereof is omitted.

That is, in step S156, the pseudo high band sub-band power difference clustering circuit 56 clusters a plurality of pseudo high band sub-band power difference vectors (a lot of time frames) obtained from a pseudo high band sub-band power difference from the pseudo high band sub-band power difference calculation circuit 55 to 64 clusters and calculates the representative vector for each cluster. As an example of a clustering method, for example, clustering by k-means method can be applied. The pseudo high band sub-band power difference clustering circuit 56 sets a center vector of each cluster obtained from the result performing clustering by k-means method to the representative vector of each cluster. In addition, a method of the clustering or the number of cluster is not limited thereto, but may apply other method.

In addition, the pseudo high band sub-band power difference clustering circuit 56 measures distance between 64 representative vectors and the pseudo high band sub-band power difference vector obtained from the pseudo high band sub-band power difference from the pseudo high band sub-band power difference calculation circuit 55 in the time frames J and determines index CID(J) of the cluster included in the representative vector that has is the shortest distance. In addition, the index CID(J) takes an integer value of 1 to the number of the clusters (for example, 64). Therefore, the pseudo high band sub-band power difference clustering circuit 56 outputs the representative vector and supplies the index CID(J) to the coefficient estimation circuit 57.

In step S157, the coefficient estimation circuit 57 calculates a decoded high band sub-band power estimation coefficient at each cluster every set having the same index CID (J) (included in the same cluster) in a plurality of combinations of a number (eb−sb) of the high band sub-band power and the characteristic amount supplied to the same time frames from the pseudo high band sub-band power difference calculation circuit 55 and the characteristic amount calculation circuit 53. A method for calculating the coefficient by the coefficient estimation circuit 57 is identical with the method by the coefficient estimation circuit 24 of the coefficient learning apparatus 20 in FIG. 9. However, the other method may be used.

Figure 13:
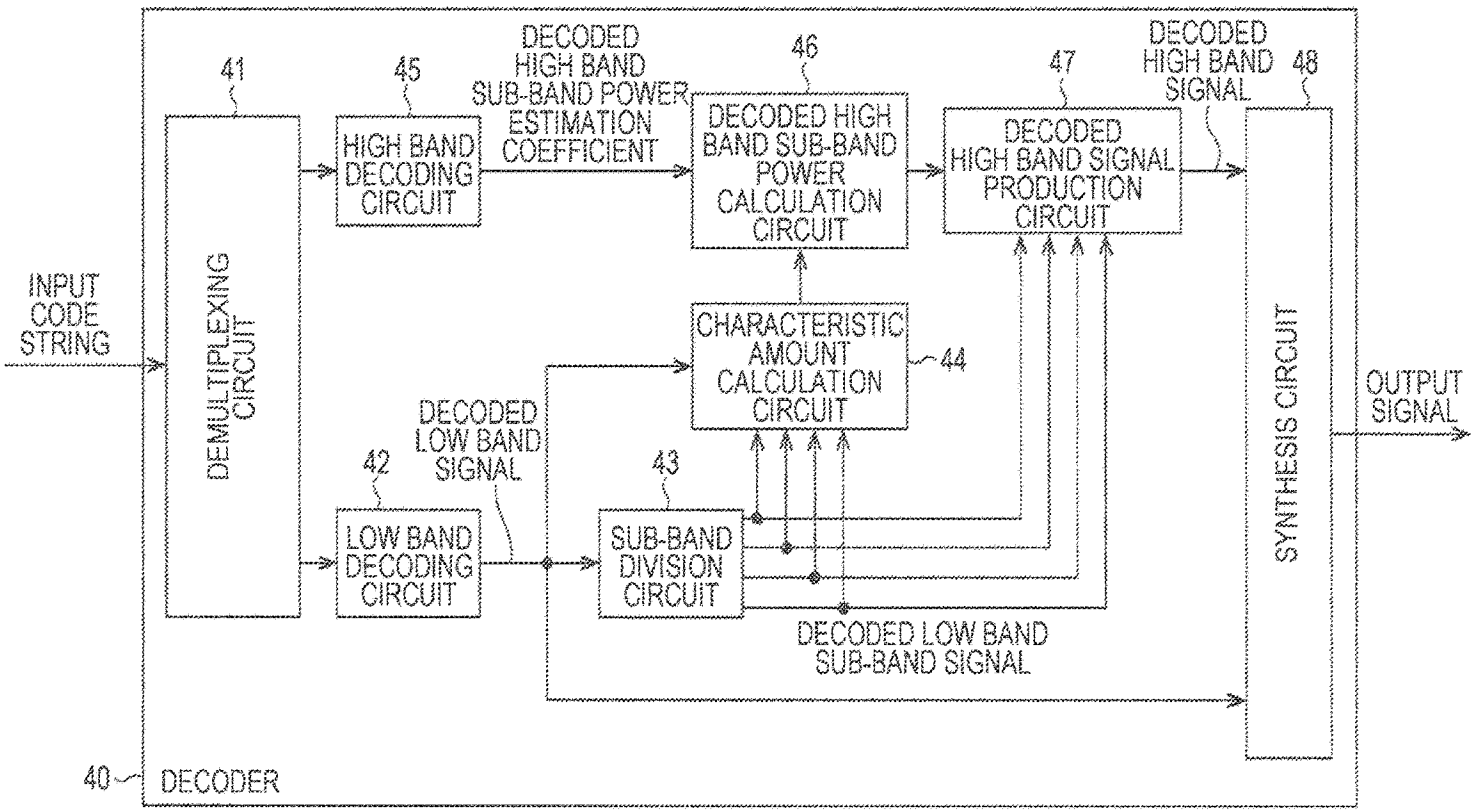
FIG. 13 is a block diagram illustrating a functional configuration example of a decoder in a second embodiment of the present invention.
Figure 14:
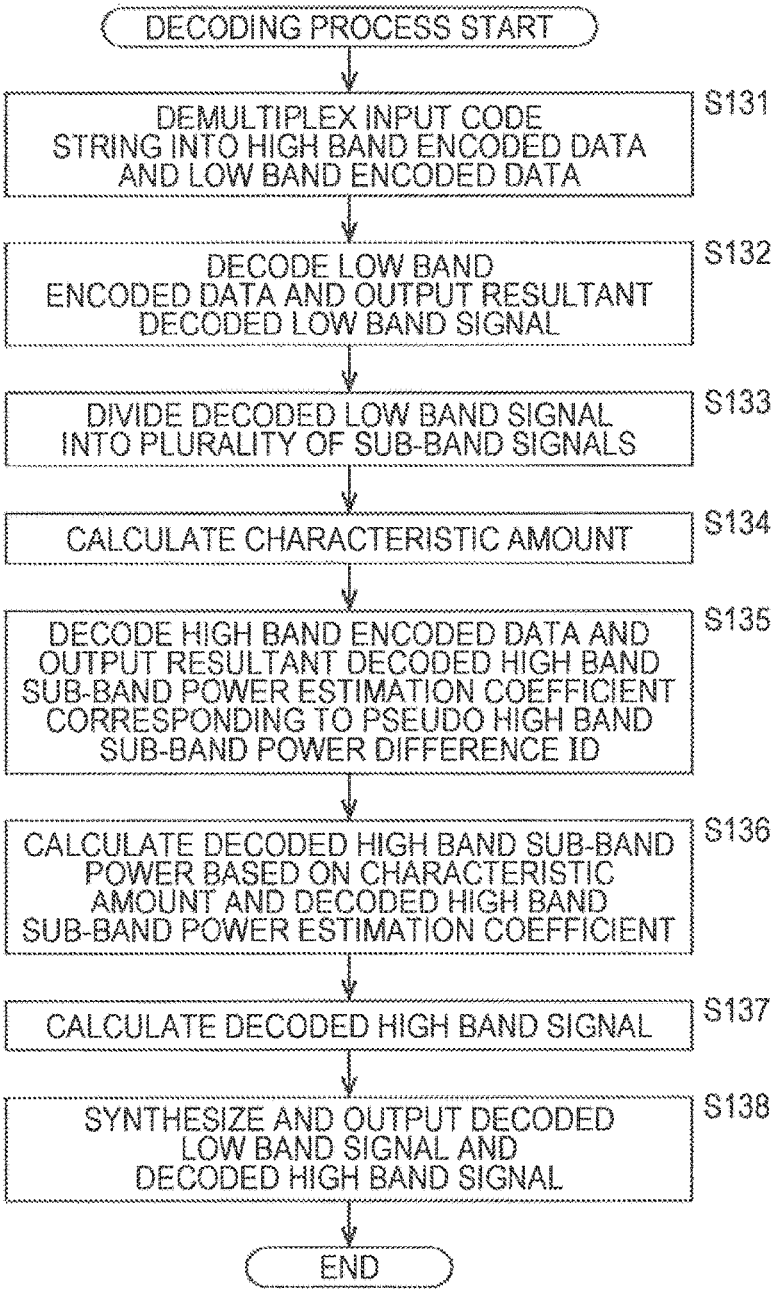
FIG. 14 is a flowchart describing an example of a decoding processing by a decoder in FIG. 13.

According to the processing described above, by using a predetermined broadband instruction signal, since a learning for the each representative vector of a plurality of clusters in the specific space of the pseudo high band sub-band power difference predetermined in the high band encoding circuit 37 of the encoder 30 in FIG. 11 and a learning for the decoded high band sub-band power estimation coefficient output by the high band decoding circuit 45 of the decoder 40 in FIG. 13 is performed, it is possible to obtain the desired output result with respect to various input signals input to the encoder 30 and various input code string input to the decoder 40 and it is possible to reproduce a music signal having the high quality.

In addition, with respect to encoding and decoding of the signal, the coefficient data for calculating the high band sub-band power in the pseudo high band sub-band power calculation circuit 35 of encoder 30 and the decoded high band sub-band power calculation circuit 46 of the decoder 40 can be processed as follows. That is, it is possible to record the coefficient in the front position of code string by using the different coefficient data by the kind of the input signal.

For example, it is possible to achieve an encoding efficiency improvement by changing the coefficient data by a signal such as speech and jazz.

Figure 17:
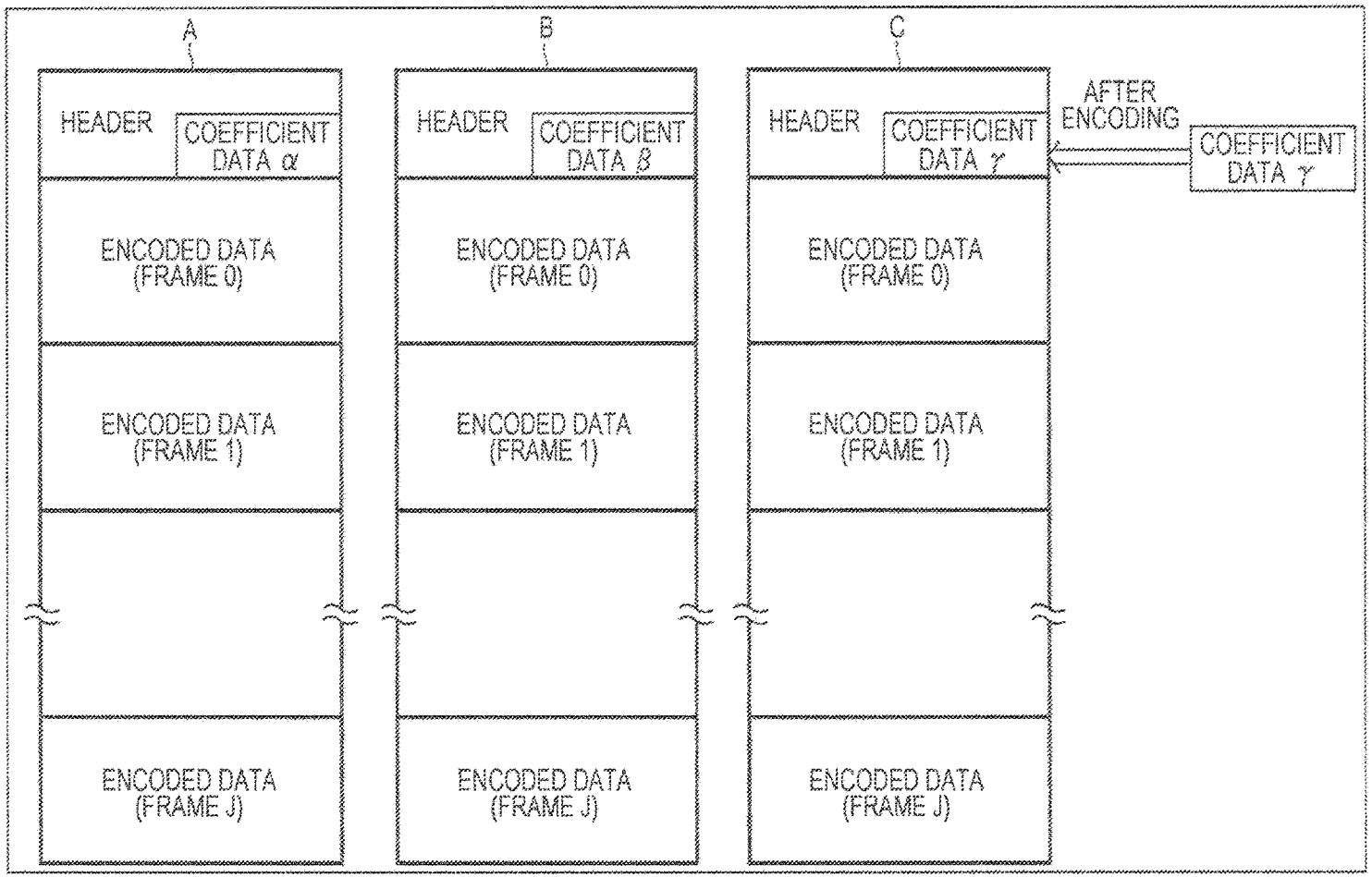
FIG. 17 is a view illustrating an example of an encoded string to which an encoder in FIG. 11 is output.

FIG. 17 illustrates the code string obtained from the above method.

The code string A in FIG. 17 encodes the speech and an optimal coefficient data a in the speech is recorded in a header.

In this contrast, since the code string B in FIG. 17 encodes jazz, the optimal coefficient data P in the jazz is recorded in the header.

The plurality of coefficient data described above can be easily learned by the same kind of the music signal in advance and the encoder 30 may select the coefficient data from genre information recorded in the header of the input signal. In addition, the genre is determined by performing a waveform analysis of the signal and the coefficient data may be selected. That is, a genre analysis method of signal is not limited in particular.

When calculation time allows, the encoder 30 is equipped with the learning apparatus described above and thus the process is performed by using the coefficient dedicated to the signal and as illustrated in the code string C in FIG. 17, finally, it is also possible to record the coefficient in the header.

An advantage using the method will be described as follow.

A shape of the high band sub-band power includes a plurality of similar positions in one input signal. By using characteristic of a plurality of input signals, and by performing the learning of the coefficient for estimating of the high band sub-band power every the input signal, separately, redundancy due to in the similar position of the high band sub-band power is reduced, thereby improving encoding efficiency. In addition, it is possible to perform estimation of the high band sub-band power with higher accuracy than the learning of the coefficient for estimating the high band sub-band power using a plurality of signals statistically.

Further, as described above, the coefficient data learned from the input signal in decoding can take the form to be inserted once into every several frames.

3. Third Embodiment

[Functional Configuration Example of Encoder]

In addition, although it was described that the pseudo high band sub-band power difference ID is output from the encoder 30 to the decoder 40 as the high band encoded data, the coefficient index for obtaining the decoded high band sub-band power estimation coefficient may be set as the high band encoded data.

Figure 18:
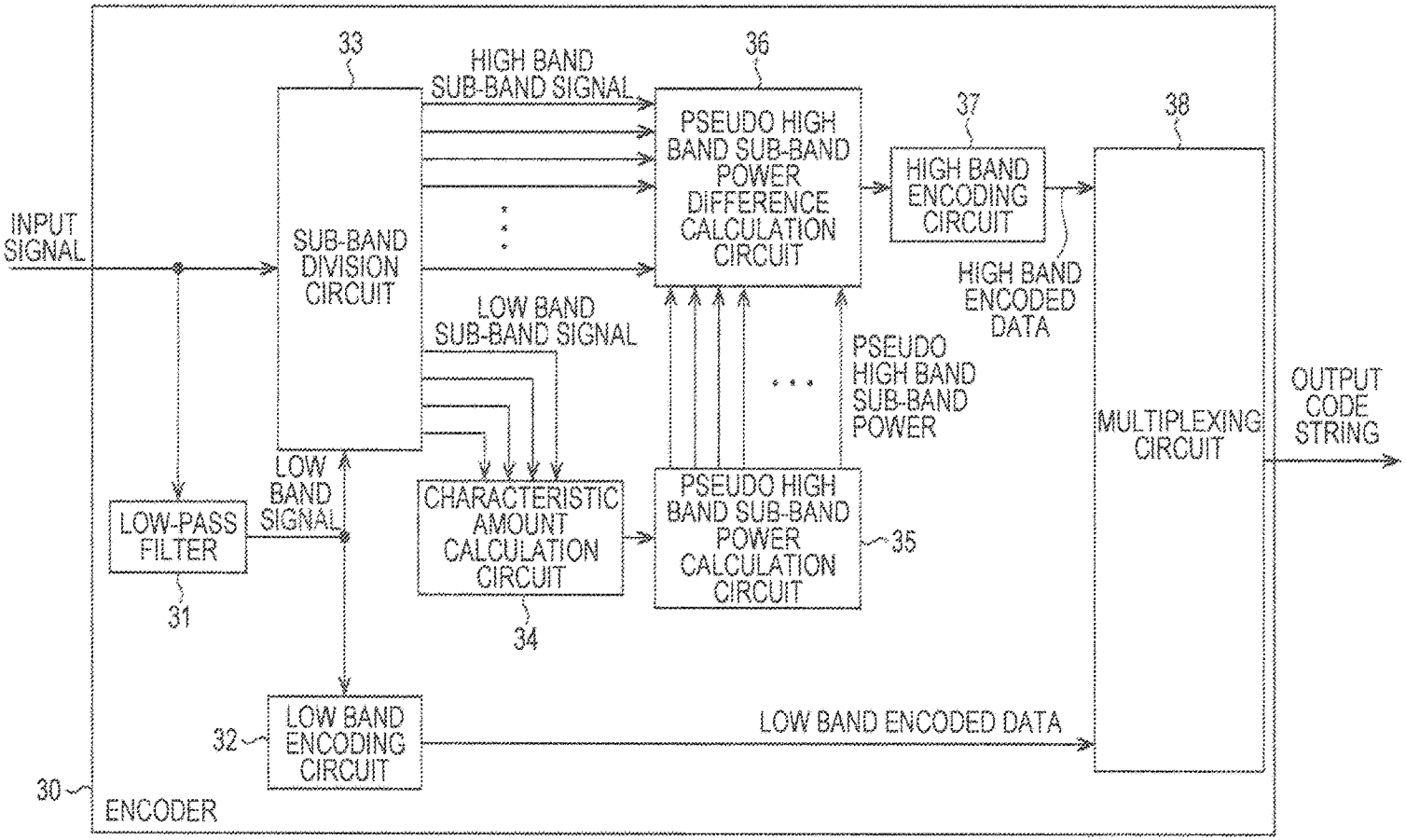
FIG. 18 is a block diagram illustrating a functional configuration example of the encoder.

In this case, the encoder 30, for example, is configured as illustrated in FIG. 18. In addition, in FIG. 18, parts corresponding to parts in FIG. 11 has the same numeral reference and the description thereof is suitably omitted.

The encoder 30 in FIG. 18 is the same expect that the encoder 30 in FIG. 11 and the low band decoding circuit 39 are not provided and the remainder is the same.

In the encoder 30 in FIG. 18, the characteristic amount calculation circuit 34 calculates the low band sub-band power as the characteristic amount by using the low band sub-band signal supplied from the sub-band division circuit 33 and is supplied to the pseudo high band sub-band power calculation circuit 35.

In addition, in the pseudo high band sub-band power calculation circuit 35, a plurality of decoded high band sub-band power estimation coefficients obtained by the predetermined regression analysis is corresponded to a coefficient index specifying the decoded high band sub-band power estimation coefficient to be recorded.

Specifically, sets of a coefficient $A_{ib}(kb)$ and a coefficient $B_{ib}$ for each sub-band used in operation of Equation (2) described above are prepared in advance as the decoded high band sub-band power estimation coefficient. For example, the coefficient $A_{ib}(kb)$ and the coefficient $B_{ib}$ are calculated by an regression analysis using a least-squares method by setting the low band sub-band power to an explanation variable and the high band sub-band power to an explained variable in advance. In the regression analysis, an input signal including the low band sub-band signal and the high band sub-band signal is used as the broadband instruction signal.

The pseudo high band sub-band power calculation circuit 35 calculates the pseudo high band sub-band power of each sub-band of the high band side by using the decoded high band sub-band power estimation coefficient and the characteristic amount from the characteristic amount calculation circuit 34 for each of a decoded high band sub-band power estimation coefficient recorded and supplies the sub-band power to the pseudo high band sub-band power difference calculation circuit 36.

The pseudo high band sub-band power difference calculation circuit 36 compares the high band sub-band power obtained from the high band sub-band signal supplied from the sub-band division circuit 33 with the pseudo high band sub-band power from the pseudo high band sub-band power calculation circuit 35.

In addition, the pseudo high band sub-band power difference calculation circuit 36 supplies the coefficient index of the decoded high band sub-band power estimation coefficient, in which the pseudo high band sub-band power closed to the highest pseudo high band sub-band power is obtained among the result of the comparison and a plurality of decoded high band sub-band power estimation coefficient to the high band encoding circuit 37. That is, the coefficient index of decoded high band sub-band power estimation coefficient from which the high band signal of the input signal to be reproduced in decoding that is the decoded high band signal closest to a true value is obtained.

[Encoding Process of Encoder]

Next, referring to a flow chart in FIG. 19, an encoding process performing by the encoder 30 in FIG. 18 will be described. In addition, processing of step S181 to step S183 are identical with those of step S111 to S113 in FIG. 12. Therefore, the description thereof is omitted.

In step S184, the characteristic amount calculation circuit 34 calculates characteristic amount by using the low band sub-band signal from the sub-band division circuit 33 and supplies the characteristic amount to the pseudo high band sub-band power calculation circuit 35.

Specially, the characteristic amount calculation circuit 34 calculates as a characteristic amount, the low band sub-band power power(ib,J) of the frames J (where, $0 \leq J$) with respect to each sub-band ib (where, $sb-3 \leq ib \leq sb$) in a low band side by performing operation of Equation (1) described above. That is, the low band sub-band power power (ib,J) calculates by digitizing a square mean value of the sample value of each sample of the low band sub-band signal constituting the frames J.

In step S185, the pseudo high band sub-band power calculation circuit 35 calculates the pseudo high band sub-band power based on the characteristic amount supplied from the characteristic amount calculation circuit 34 and supplies the pseudo high band sub-band power to the pseudo high band sub-band power difference calculation circuit 36.

For example, the pseudo high band sub-band power calculation circuit 35 calculates the pseudo high band sub-band power $power_{est}(ib,J)$, which performs above-mentioned Equation (2) by using the coefficient $A_{ib}(kb)$ and the coefficient $B_{ib}$ recorded as the decoded high band sub-band power coefficient in advance and the pseudo high band sub-band power $power_{est}(ib,J)$ which performs the operation the above-mentioned Equation (2) by using the low band sub-band power power(kb,J) (where, $sb-\leq kb \leq sb$).

That is, coefficient $A_{ib}(kb)$ for each sub-band multiplies the low band sub-band power power(kb,J) of each sub-band of the low band side supplied as the characteristic amount and the coefficient $B_{ib}$ is added to the sum of the low band sub-band power by which the coefficient is multiplied and then becomes the pseudo high band sub-band power $power_{est}(ib,J)$. This pseudo high band sub-band power is calculated for each sub-band of the high band side in which the index is sb+1 to eb In addition, the pseudo high band sub-band power calculation circuit 35 performs the calculation of the pseudo high band sub-band power for each decoded high band sub-band power estimation coefficient recorded in advance. For example, it is assumed that the coefficient index allows 1 to K (where, $2 \leq K$) number of decoding high band sub-band estimation coefficient to be prepared in advance. In this case, the pseudo high band sub-band power of each sub-band is calculated for each of the K decoded high band sub-band power estimation coefficients.

In step S186, the pseudo high band sub-band power difference calculation circuit 36 calculates the pseudo high band sub-band power difference based on a high band sub-band signal from the sub-band division circuit 33, and the pseudo high band sub-band power from the pseudo high band sub-band power calculation circuit 35.

Specifically, the pseudo high band sub-band power difference calculation circuit 36 does not perform the same operation as the Equation (1) described above and calculates the high band sub-band power power(ib,J) in the frames J with respect to high band sub-band signal from the sub-band division circuit 33. In addition, in the embodiment, the whole of the sub-band of the low band sub-band signal and the high band sub-band signal is distinguished by using index ib.

Next, the pseudo high band sub-band power difference calculation circuit 36 performs the same operation as the Equation (14) described above and calculates the difference between the high band sub-band power power(ib,J) in the frames J and the pseudo high band sub-band power $power_{est}$ (ib,J). In this case, the pseudo high band sub-band power difference $power_{diff}$(ib,J) is obtained for each decoded high band sub-band power estimation coefficient with respect to each sub-band of the high band side which index is sb+1 to eb.

In step S187, the pseudo high band sub-band power difference calculation circuit 36 calculates the following Equation (15) for each decoded high band sub-band power estimation coefficient and calculates a sum of squares of the pseudo high band sub-band power difference.

[Equation 15]

$$E(J, id) = \sum_{ib=sb+1}^{eb} \{power_{diff}(ib, J, id)\}^2 \tag{15}$$

In addition, in Equation (15), the square sum for a difference E (J, id) is obtained with respect to the decoded high band sub-band power estimation coefficient in which the coefficient index is id and the frames J. In addition, in Equation (15), $power_{diff}$(ib,J,id) is obtained with respect to the decoded high band sub-band power estimation coefficient in which the coefficient index is id decoded high band sub-band power and shows the pseudo high band sub-band power difference ($power_{diff}$(ib,J)) of the pseudo high band sub-band power difference $power_{diff}$(ib,J) of the frames J of the sub-band which the index is ib. The square sum of a difference E(J, id) is calculated with respect to the number of K of each decoded high band sub-band power estimation coefficient.

The square sum for a difference E(J, id) obtained above shows a similar degree of the high band sub-band power calculated from the actual high band signal and the pseudo high band sub-band power calculated using the decoded high band sub-band power estimation coefficient, which the coefficient index is id.

That is, the error of the estimation value is shown with respect to the true value of the high band sub-band power. Therefore, the smaller the square sum for the difference E(J, id), the more the decoded high band signal closed by the actual high band signal is obtained by the operation using the decoded high band sub-band power estimation coefficient. That is, the decoded high band sub-band power estimation coefficient in which the square sum for the difference E(J, id) is minimum is an estimation coefficient most suitable for the frequency band expansion process performed in decoding the output code string.

The pseudo high band sub-band power difference calculation circuit 36 selects the square sum for difference having a minimum value among the K square sums for difference E (J, id) and supplies the coefficient index showing the decoded high band sub-band power estimation coefficient corresponding to the square sum for difference to the high band encoding circuit 37.

In step S188, the high band encoding circuit 37 encodes the coefficient index supplied from the pseudo high band sub-band power difference calculation circuit 36 and supplies obtained high band encoded data to the multiplexing circuit 38.

For example, step S188, an entropy encoding and the like is performed with respect to the coefficient index. Therefore, information amount of the high band encoded data output to the decoder 40 can be compressed. In addition, if high band encoded data is information that an optimal decoded high band sub-band power estimation coefficient is obtained, any information is preferable; for example, the index may be the high band encoded data as it is.

In step S189, the multiplexing circuit 38 multiplexes the low band encoded data supplied from the low band encoding circuit 32 and the high band encoded data supplied from the high band encoding circuit 37 and outputs the output code string and the encoding process is completed.

As described above, the decoded high band sub-band power estimation coefficient mostly suitable to process can be obtained by outputting the high band encoded data obtained by encoding the coefficient index as the output code string in decoder 40 receiving an input of the output code string, together with the low frequency encoded data. Therefore, it is possible to obtain signal having higher quality.

[Functional Configuration Example of Decoder]

Figure 20:
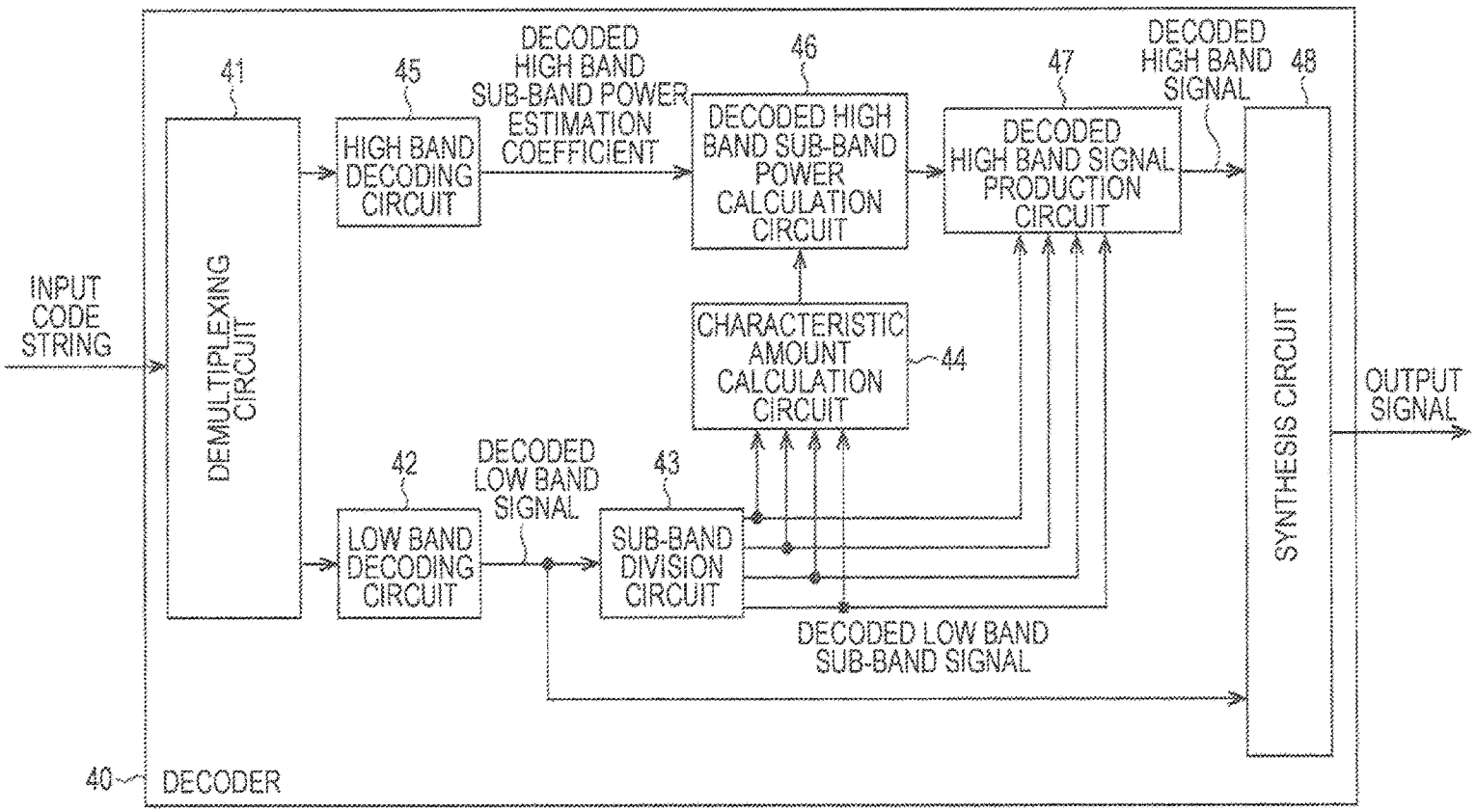
FIG. 20 is a block diagram illustrating a functional configuration example of a decoder.

In addition, the output code string output from the encoder 30 in FIG. 18 is input as the input code string and for example, the decoder 40 for decoding is configuration illustrated in FIG. 20. In addition, in FIG. 20, the parts corresponding to the case FIG. 13 use the same symbol and the description is omitted.

The decoder 40 in FIG. 20 is identical with the decoder 40 in FIG. 13 in that the demultiplexing circuit 41 to the synthesis circuit 48 is configured, but is different from the decoder 40 in FIG. 13 in that the decoded low band signal from the low band decoding circuit 42 is supplied to the characteristic amount calculation circuit 44.

In the decoder 40 in FIG. 20, the high band decoding circuit 45 records the decoded high band sub-band power estimation coefficient identical with the decoded high band sub-band power estimation coefficient in which the pseudo high band sub-band power calculation circuit 35 in FIG. 18 is recorded in advance. That is, the set of the coefficient $A_{ib}$(kb) and coefficient $B_{ib}$ as the decoded high band sub-band power estimation coefficient by the regression analysis is recorded to correspond to the coefficient index.

The high band decoding circuit 45 decodes the high band encoded data supplied from the demultiplexing circuit 41 and supplies the decoded high band sub-band power estimation coefficient indicated by the coefficient index obtained from the result to the decoded high band sub-band power calculation circuit 46.

[Decoding Process of Decoder]

Figure 21:
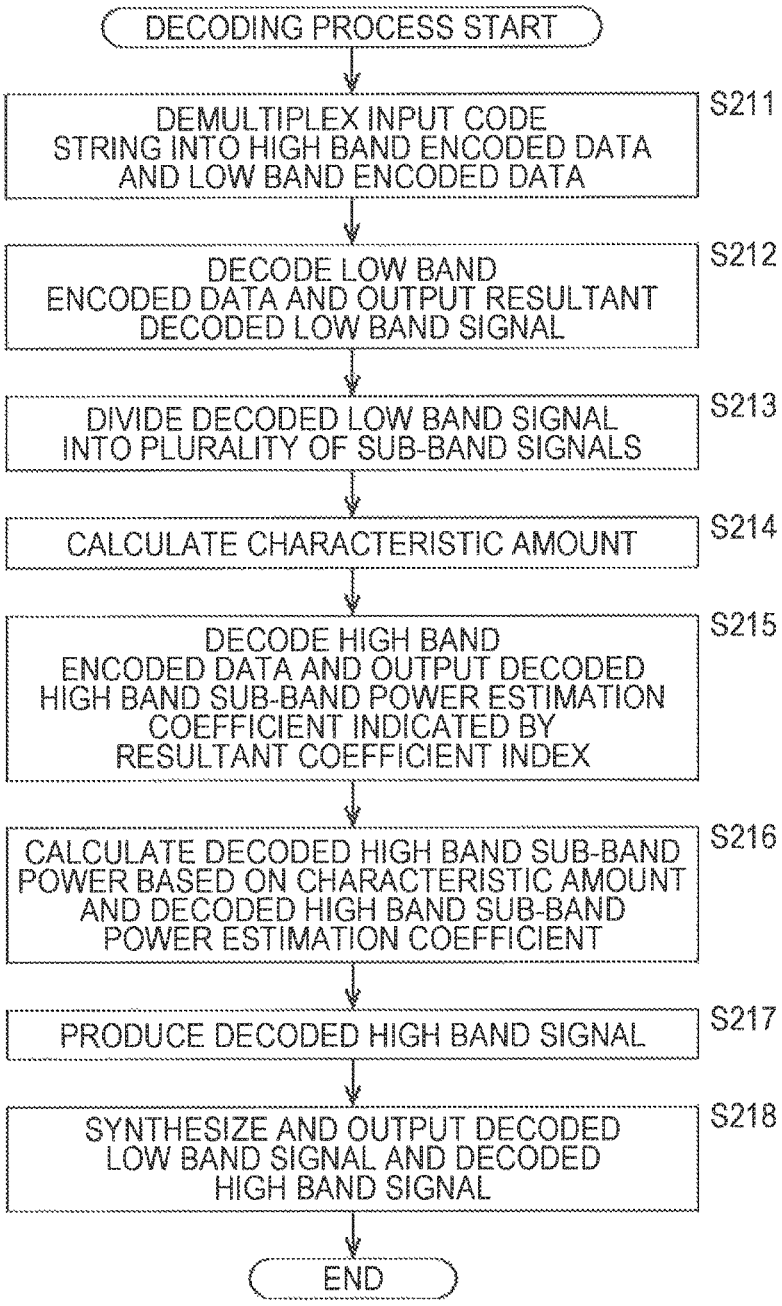
FIG. 21 is a flowchart describing a decoding process.

Next, the decoding process performs by decoder 40 in FIG. 20 will be described with reference to a flowchart in FIG. 21.

The decoding process starts if the output code string output from the encoder 30 is provided as the input code string to the decoder 40. In addition, since the processes of step S211 to step S213 is identical with those of step S131 to step S133 in FIG. 14, the description is omitted.

In step S214, the characteristic amount calculation circuit 44 calculates the characteristic amount by using the decoded low band sub-band signal from the sub-band division circuit 43 and supplies it decoded high band sub-band power calculation circuit 46. In detail, the characteristic amount calculation circuit 44 calculates the characteristic amount of the low band sub-band power power(ib,J) of the frames J(but, 0≤J) by performing operation of the Equation (1) described above with respect to the each sub-band ib of the low band side.

In step S215, the high band decoding circuit 45 performs decoding of the high band encoded data supplied from the demultiplexing circuit 41 and supplies the decoded high band sub-band power estimation coefficient indicated by the coefficient index obtained from the result to the decoded high band sub-band power calculation circuit 46. That is, the decoded high band sub-band power estimation coefficient is output, which is indicated by the coefficient index obtained by the decoding in a plurality of decoded high band sub-band power estimation coefficient recorded to the high band decoding circuit 45 in advance.

In step S216, the decoded high band sub-band power calculation circuit 46 calculates the decoded high band sub-band power based on the characteristic amount supplied from the characteristic amount calculation circuit 44 and the decoded high band sub-band power estimation coefficient supplied from the high band decoding circuit 45 and supplies it to the decoded high band signal production circuit 47.

That, the decoded high band sub-band power calculation circuit 46 performs operation the Equation described above using the coefficient $A_{ib}$(kb) as the decoded high band sub-band power estimation coefficient and the low band sub-band power power(kb,J) and the coefficient $B_{ib}$(where, sb−3≤kb≤sb) as characteristic amount and calculates the decoded high band sub-band power. Therefore, the decoded high band sub-band power is obtained with respect to each sub-band of the high band side, which the index is sb+1 to eb.

In step S217, the decoded high band signal production circuit 47 produces the decoded high band signal based on the decoded low band sub-band signal supplied from the sub-band division circuit 43 and the decoded high band sub-band power supplied from the decoded high band sub-band power calculation circuit 46.

In detail, the decoded high band signal production circuit 47 performs operation of the above-mentioned Equation (1) using the decoded low band sub-band signal and calculates the low band sub-band power with respect to each sub-band of the low band side. In addition, the decoded high band signal production circuit 47 calculates the gain amount G(ib, J) for each sub-band of the high band side by performing operation of the Equation (3) described above using the low band sub-band power and the decoded high band sub-band power obtained.

Further, the decoded high band signal production circuit 47 produces the high band sub-band signal x3(*ib, n*) by performing the operation of the Equations (5) and (6) described above using the gain amount G(ib, J) and the decoded low band sub-band signal with respect to each sub-band of the high band side.

That is, the decoded high band signal production circuit 47 performs an amplitude modulation of the decoded high band sub-band signal x(ib, n) in response to the ratio of the low band sub-band power to the decoded high band sub-band power and thus performs frequency-modulation the decoded low band sub-band signal (x2(*ib, n*) obtained. Therefore, the signal of the frequency component of the sub-band of the low band side is converted to signal of the frequency component of the sub-band of the high band side and the high band sub-band signal x3(*ib, n*) is obtained.

As described above, the processes for obtaining the high band sub-band signal of each sub-band is a process described blow in more detail.

The four sub-bands being a line in the frequency area is referred to as the band block and the frequency band is divided so that one band block (hereinafter, referred to as a low band block) is configured from four sub-bands in which the index existed in the low side is sb to sb−3. In this case, for example, the band including the sub-band in which the index of the high band side includes sb+1 to sb+4 is one band block. In addition, the high band side, that is, a band block including sub-band in which the index is sb+1 or more is particularly referred to as the high band block.

In addition, attention is paid to one sub-band constituting the high band block and the high band sub-band signal of the sub-band (hereinafter, referred to as attention sub-band) is produced. First, the decoded high band signal production circuit 47 specifies the sub-band of the low band block that has the same position relation to the position of the attention sub-band in the high band block.

For example, if the index of the attention sub-band is sb+1, the sub-band of the low band block having the same position relation with the attention sub-band is set as the sub-band that the index is sb−3 since the attention sub-band is a band that the frequency is the lowest in the high band blocks.

As described above, the sub-band, if the sub-band of the low band block sub-band having the same position relationship of the attention sub-band is specific, the low band sub-band power and the decoded low band sub-band signal and the decoded high band sub-band power is used and the high band sub-band signal of the attention sub-band is produced.

That is, the decoded high band sub-band power and the low band sub-band power are substituted for Equation (3), so that the gain amount according to the rate of the power thereof is calculated. In addition, the calculated gain amount is multiplied by the decoded low band sub-band signal, the decoded low band sub-band signal multiplied by the gain amount is set as the frequency modulation by the operation of the Equation (6) to be set as the high band sub-band signal of the attention sub-band.

In the processes, the high band sub-band signal of the each sub-band of the high band side is obtained. In addition, the decoded high band signal production circuit 47 performs the Equation (7) described above to obtain sum of the each high band sub-band signal and to produce the decoded high band signal. The decoded high band signal production circuit 47 supplies the obtained decoded high band signal to the synthesis circuit 48 and the process precedes from step S217 to the step S218 and then the decoding process is terminated.

In step S218, the synthesis circuit 48 synthesizes the decoded low band signal from the low band decoding circuit 42 and the decoded high band signal from the decoded high band signal production circuit 47 and outputs as the output signal.

As described above, since decoder 40 obtained the coefficient index from the high band encoded data obtained from the demultiplexing of the input code string and calculates the decoded high band sub-band power by the decoded high band sub-band power estimation coefficient indicated by using the decoded high band sub-band power estimation coefficient indicated by the coefficient index, it is possible to improve the estimation accuracy of the high band sub-band power. Therefore, it is possible to produce the music signal having high quality.

4. Fourth Embodiment

[Encoding Processes of Encoder]

First, in as described above, the case that only the coefficient index is included in the high band encoded data is described. However, the other information may be included.

For example, if the coefficient index is included in the high band encoded data, the decoding high band sub-band power estimation coefficient that the decoded high band sub-band power closest to the high band sub-band power of the actual high band signal is notified of the decoder 40 side.

Therefore, the actual high band sub-band power (true value) and the decoded high band sub-band power (estimation value) obtained from the decoder 40 produces difference substantially equal to the pseudo high band sub-band power difference $power_{diff}(ib,J)$ calculated from the pseudo high band sub-band power difference calculation circuit 36.

Herein, if the coefficient index and the pseudo high band sub-band power difference of the sub-band is included in the high band encoded data, the error of the decoded high band sub-band power regarding the actual high band sub-band power is approximately known in the decoder 40 side. If so, it is possible to improve the estimation accuracy of the high band sub-band power using the difference.

Figure 22:
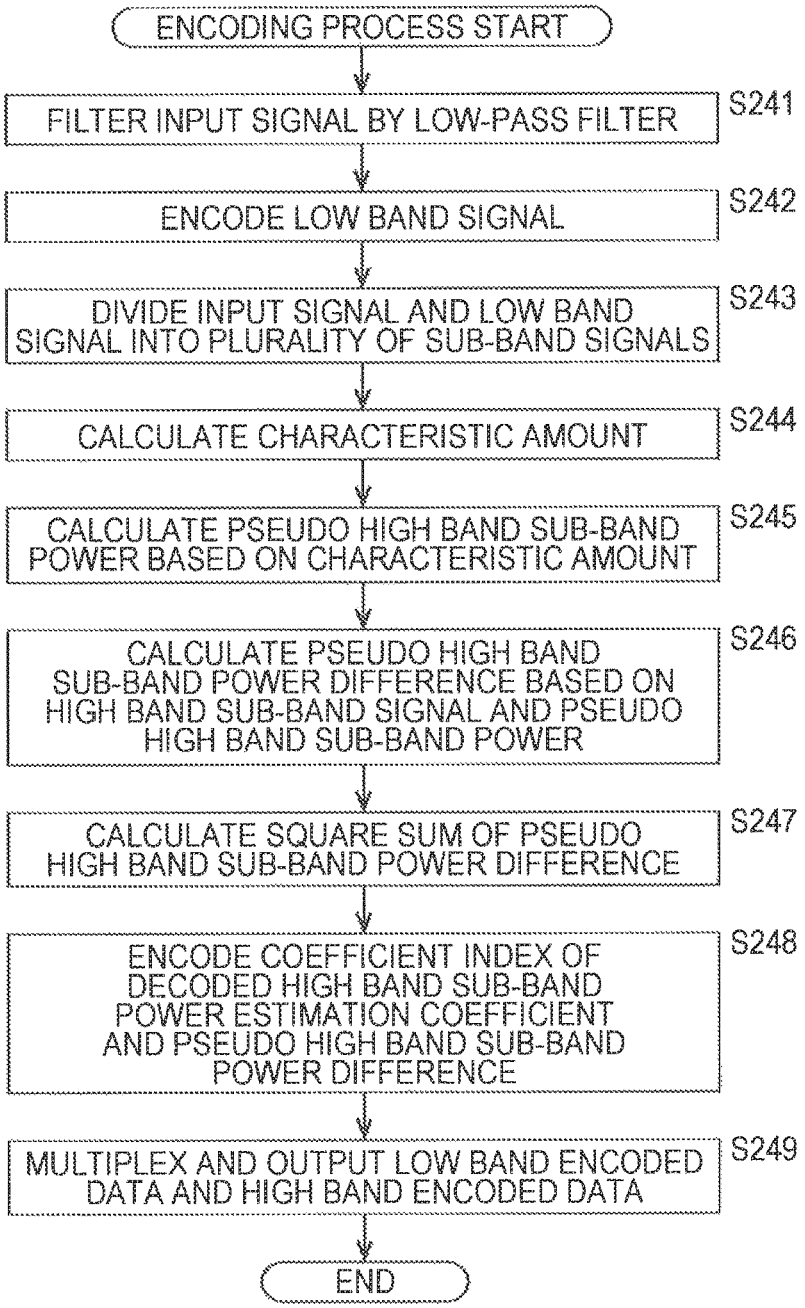
FIG. 22 is a flowchart describing an encoding process.
Figure 23:
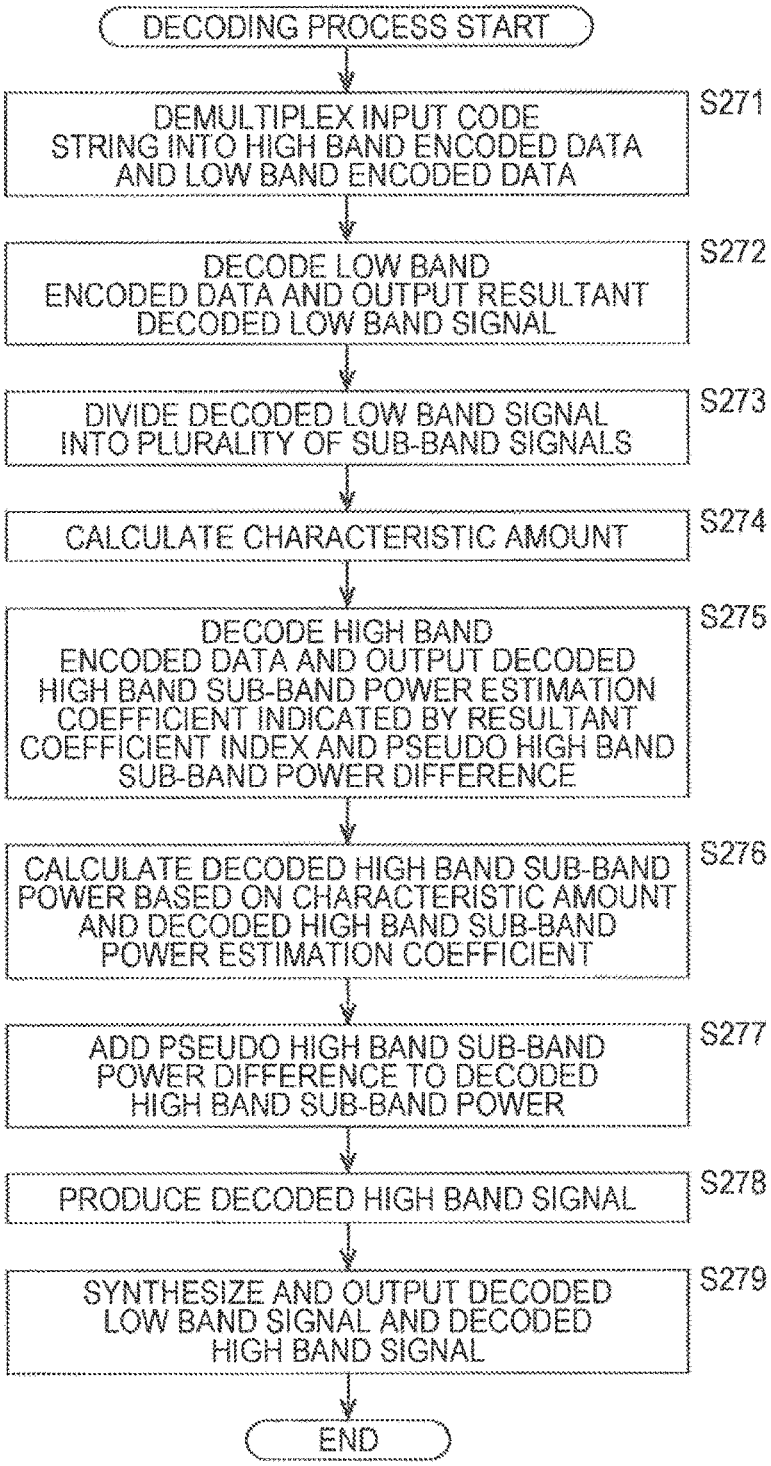
FIG. 23 is a flowchart describing a decoding process.

The encoding process and the decoding process in a case where the pseudo high band sub-band power difference is included in the high band encoded data will be described with reference with a flow chart of FIGS. 22 and 23.

First, the encoding process performed by encoder 30 in FIG. 18 will be described with reference to the flowchart in FIG. 22. In addition, the processes of step S241 to step S246 is identical with those of step S181 to step S186 in FIG. 19. Therefore, the description thereof is omitted.

In step S247, the pseudo high band sub-band power difference calculation circuit 36 performs operation of the Equation (15) described above to calculate sum E (J, id) of squares for difference for each decoded high band sub-band power estimation coefficient.

In addition, the pseudo high band sub-band power difference calculation circuit 36 selects sum of squares for difference where the sum of squares for difference is set as a minimum in the sum of squares for difference among sum E(J, id) of squares for difference and supplies the coefficient index indicating the decoded high band sub-band power estimation coefficient corresponding to the sum of square for difference to the high band encoding circuit 37.

In addition, the pseudo high band sub-band power difference calculation circuit 36 supplies the pseudo high band sub-band power difference $power_{diff}(ib,J)$ of the each sub-band obtained with respect to the decoded high band sub-band power estimation coefficient corresponding to selected sum of squares of residual error to the high band encoding circuit 37.

In step S248, the high band encoding circuit 37 encodes the coefficient index and the pseudo high band sub-band power difference supplied from the pseudo high band sub-band power difference calculation circuit 36 and supplies the high band encoded data obtained from the result to the multiplexing circuit 38.

Therefore, the pseudo high band sub-band power difference of the each sub-band power of the high band side where the index is sb+1 to eb, that is, the estimation difference of the high band sub-band power is supplied as the high band encoded data to the decoder 40.

If the high band encoded data is obtained, after this, encoding process of step S249 is performed to terminate encoding process. However, the process of step S249 is identical with the process of step S189 in FIG. 19. Therefore, the description is omitted.

As described above, if the pseudo high band sub-band power difference is included in the high band encoded data, it is possible to improve estimation accuracy of the high band sub-band power and to obtain music signal having good quality in the decoder 40.

[Decoding Processing of Decoder]

Next, a decoding process performed by the decoder 40 in FIG. 20 will be described with reference to a flowchart in FIG. 23. In addition, the process of step S271 to step S274 is identical with those of step S211 to step S214 in FIG. 21. Therefore, the description thereof is omitted.

In step S275, the high band decoding circuit 45 performs the decoding of the high band encoded data supplied from the demultiplexing circuit 41. In addition, the high band decoding circuit 45 supplies the decoded high band sub-band power estimation coefficient indicated by the coefficient index obtained by the decoding and the pseudo high band sub-band power difference of each sub-band obtained by the decoding to the decoded high band sub-band power calculation circuit 46.

In a step S276, the decoded high band sub-band power calculation circuit 46 calculates the decoded high band sub-band power based on the characteristic amount supplied from the characteristic amount calculation circuit 44 and the decoded high band sub-band power estimation coefficient 216 supplied from the high band decoding circuit 45. In addition, step S276 has the same process as step S216 in FIG. 21.

In step S277, the decoded high band sub-band power calculation circuit 46 adds the pseudo high band sub-band power difference supplied from the high band decoding circuit 45 to the decoded high band sub-band power and supplies the added result as an ultimate decoded high band sub-band power to decoded high band signal production circuit 47. That is, the pseudo high band sub-band power difference of the same sub-band is added to the decoding high band sub-band power of the each calculated sub-band.

In addition, after that, processes of step S278 and step S279 is performed and the decoding process is terminated. However, their processes are identical with step S217 and step S218 in FIG. 21. Therefore, the description will be omitted.

By doing the above, the decoder 40 obtains the coefficient index and the pseudo high band sub-band power from the high band encoded data obtained by the demultiplexing of the input code string. In addition, decoder 40 calculates the decode high band sub-band power using the decoded high band sub-band power estimation coefficient indicated by the coefficient index and the pseudo high band sub-band power difference. Therefore, it is possible to improve accuracy of the high band sub-band power and to reproduce music signal having high sound quality.

In addition, the difference of the estimation value of the high band sub-band power producing between encoder 30 and decoder 40, that is, the difference (hereinafter, referred to as an difference estimation between device) between the pseudo high band sub-band power and decoded high band sub-band power may be considered.

In this case, for example, the pseudo high band sub-band power difference serving as the high band encoded data is corrected by the difference estimation between devices and the estimation difference between devices is included in the high band encoded data, the pseudo high band sub-band power difference is corrected by the estimation difference between apparatus in decoder 40 side. In addition, the estimation difference between apparatus may be recorded in decoder 40 side in advance and the decoder 40 may make correction by adding the estimation difference between devices to the pseudo high band sub-band power difference. Therefore, it is possible to obtain the decoded high band signal closed to the actual high band signal.

5. Fifth Embodiment

In addition, in the encoder 30 in FIG. 18, it is described that the pseudo high band sub-band power difference calculation circuit 36 selects the optimal index from a plurality of coefficient indices using the square sum E(J,id) of for a difference. However, the circuit may select the coefficient index using the index different from the square sum for a difference.

For example, as an index selecting a coefficient index, mean square value, maximum value and an average value of a residual error of the high band sub-band power and the pseudo high band sub-band power may be used. In this case, the encoder 30 in FIG. 18 performs encoding process illustrated in a flowchart in FIG. 24.

Figure 24:
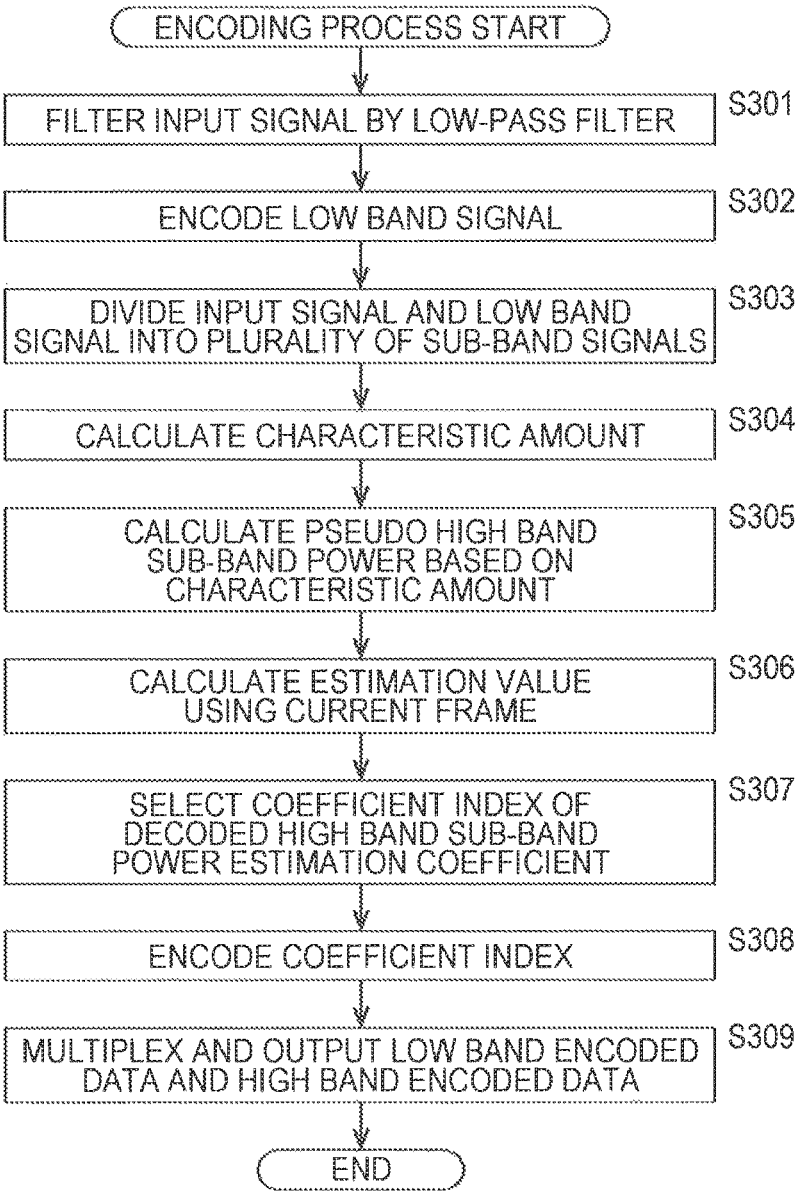
FIG. 24 is a flowchart describing an encoding process.

An encoding process using the encoder 30 will described with reference to a flowchart in FIG. 24. In addition, processes of step S301 to step S305 are identical with those of step S181 to step S185 in FIG. 19. Therefore, the description will be omitted. If the processes of step S301 to step S305 are performed, the pseudo high band sub-band power of each sub-band is calculated for each K number of decoded high band sub-band power estimation coefficient.

In step S306, the pseudo high band sub-band power difference calculation circuit 36 calculates an estimation value Res(id,J) using a current frame J to be processed for each K number of decoded high band sub-band power estimation coefficient.

In detail, the pseudo high band sub-band power difference calculation circuit 36 calculates the high band sub-band power power(ib,J) in frames J by performing the same operation as the Equation (1) described above using the high band sub-band signal of each sub-band supplied from the sub-band division circuit 33. In addition, in an embodiment of the present invention, it is possible to discriminate all of the sub-band of the low band sub-band signal and the high band sub-band using index ib.

If the high band sub-band power power(ib,J) is obtained, the pseudo high band sub-band power difference calculation circuit 36 calculates the following Equation (16) and calculates the residual square mean square value $Res_{std}$(id,J).

[Equation 16]

$$Res_{std}(id, J) = \sum_{ib=sb+1}^{eb} \{\text{power}(ib, J) - \text{power}_{est}(ib, id, J)\}^2 \tag{16}$$

That is, the difference between the high band sub-band power power(ib,J) and the pseudo high band sub-band power $\text{power}_{est}$(ib,id,J) is obtained with respect to each sub-band on the high band side where the index sb+1 to eb and square sum for the difference becomes the residual square mean value $Res_{std}$(id, J). In addition, the pseudo high band sub-band power $\text{power}_{rest}$(ibh,id,J) indicates the pseudo high band sub-band power of the frames J of the sub-band where the index is ib, which is obtained with respect to the decoded high band sub-band power estimation coefficient where index is ib.

Continuously, the pseudo high band sub-band power difference calculation circuit 36 calculates the following Equation (17) and calculates the residual maximum value $Res_{max}$(id,J).

[Equation 17]

$$Res_{max}(id,J)=\max_{ib}[|\text{Power}(b,J)-\text{power}_{est}(ib,id,J)|] \tag{17}$$

In addition, in an Equation (17), $\max_{ib}\{|\text{power}(ib,J)-\text{power}_{est}(ib,id,J)|\}$ indicates a maximum value among absolute value of the difference between the high band sub-band power power(ib,J) of each sub-band where the index is sb+1 to eb and the pseudo high band sub-band power $\text{power}_{est}$(ib,id,J). Therefore, a maximum value of the absolute value of the difference between the high band sub-band power power(ib,J) in the frames J and the pseudo high band sub-band power $\text{power}_{est}$(ib,id,J) is set as the residual difference maximum value $Res_{max}$(id,J).

In addition, the pseudo high band sub-band power difference calculation circuit 36 calculates the following Equation (18) and calculates the residual average value $Res_{ave}$(id,J).

[Equation 18]

$$Res_{ave}(id, J) = \left|\left(\sum_{ib=sb+1}^{eb} \{\text{power}(ib, J) - \text{power}_{est}(ib, id, J)\}\right) \Big/ (eb - sb)\right| \tag{18}$$

That is, for each sub-band on the high band side in which the index is sb+1 to eb, the difference between the high band sub-band power power(ib,J) of the frames J and the pseudo high band sub-band power $\text{power}_{est}$(ib,id,J) is obtained and the sum of the difference is obtained. In addition, the absolute value of a value obtained by dividing the sum of the obtained difference by the number of the sub-bands (eb−sb) of the high band side is set as the residual average value $Res_{ave}$(id,J). The residual average value $Res_{ave}$(id,J) indicates a size of the average value of the estimation error of each sub-band that a symbol is considered.

In addition, if the residual square mean $Res_{std}$(id,J), the residual difference maximum value $Res_{max}$(id,J), and the residual average value $Res_{ave}$(id,J) are obtained, the pseudo high band sub-band power difference calculation circuit 36 calculates the following Equation (19) and calculates an ultimate estimation value Res(id,J).

[Equation 19]

$$\mathrm{Res}(id,J)=\mathrm{Res}_{std}(id,J)+W_{max}\times\mathrm{Res}_{max}(id,J)+W_{ave}\times\mathrm{Res}_{ave}(id,J) \quad (19)$$

That is, the residual square average value $\mathrm{Res}_{std}$(id,J), the residual maximum value $\mathrm{Res}_{max}$(id,J) and the residual average value $\mathrm{Res}_{ave}$(id,J) are added with weight and set as an ultimate estimation value Res(id,J). In addition, in the Equation (19), $W_{max}$ and $W_{ave}$ is a predetermined weight and for example, $W_{max}$=0.5, $W_{ave}$=0.5.

The pseudo high band sub-band power difference calculation circuit 36 performs the above process and calculates the estimation value Res(id,J) for each of the K numbers of the decoded high band sub-band power estimation coefficient, that is, the K number of the coefficient index id.

In step S307, the pseudo high band sub-band power difference calculation circuit 36 selects the coefficient index id based on the estimation value Res for each of the obtained (id,J) coefficient index id.

The estimation value Res(id,J) obtained from the process described above shows a similarity degree between the high band sub-band power calculated from the actual high band signal and the pseudo high band sub-band power calculated using the decoded high band sub-band power estimation coefficient which is the coefficient index id. That is, a size of the estimation error of the high band component is indicated.

Accordingly, as the evaluation Res(id,J) become low, the decoded high band signal closer to the actual high band signal is obtained by an operation using the decoded high band sub-band power estimation coefficient. Therefore, the pseudo high band sub-band power difference calculation circuit 36 selects the estimation value which is set as a minimum value among the K numbers of the estimation value Res(id,J) and supplies the coefficient index indicating the decoded high band sub-band power estimation coefficient corresponding to the estimation value to the high band encoding circuit 37.

If the coefficient index is output to the high band encoding circuit 37, after that, the processes of step S308 and step S309 are performed, the encoding process is terminated. However, since the processes are identical with step S188 in FIG. 19 and step S189, the description thereof will be omitted.

As described above, in the encoder 30, the estimation value Res(id,J) calculated by using the residual square average value $\mathrm{Res}_{std}$(id,J), the residual maximum value $\mathrm{Res}_{max}$(id,J) and the residual average value $\mathrm{Res}_{ave}$(id,J) is used, and the coefficient index of the an optimal decoded high band sub-band power estimation coefficient is selected.

If the estimation value Res(id,J) is used, since an estimation accuracy of the high band sub-band power is able to be evaluated using the more estimation standard compared with the case using the square sums for difference, it is possible to select more suitable decoded high band sub-band power estimation coefficient. Therefore, when using, the decoder 40 receiving the input of the output code string, it is possible to obtain the decoded high band sub-band power estimation coefficient, which is mostly suitable to the frequency band expansion process and signal having higher sound quality.

Modification Example 1

In addition, if the encoding process described above is performed for each frame of the input signal, There may be a case where the coefficient index different in each consecutive frame is selected in a stationary region that the time variation of the high band sub-band power of each sub-band of the high band side of the input signal is small.

That is, since the high band sub-band power of each frame has almost identical values in consecutive frames constituting the standard region of the input signal, the same coefficient index should be continuously selected in their frame. However, the coefficient index selected for each frame in a section of the consecutive frames is changed and thus the high band component of the voice reproduced in the decoder 40 side may be no long stationary. If so, incongruity in auditory occurs in the reproduced sound.

Accordingly, if the coefficient index is selected in the encoder 30, the estimation result of the high band component in the previous frame in time may be considered. In this case, encoder 30 in FIG. 18 performs the encoding process illustrated in the flowchart in FIG. 25.

Figure 25:
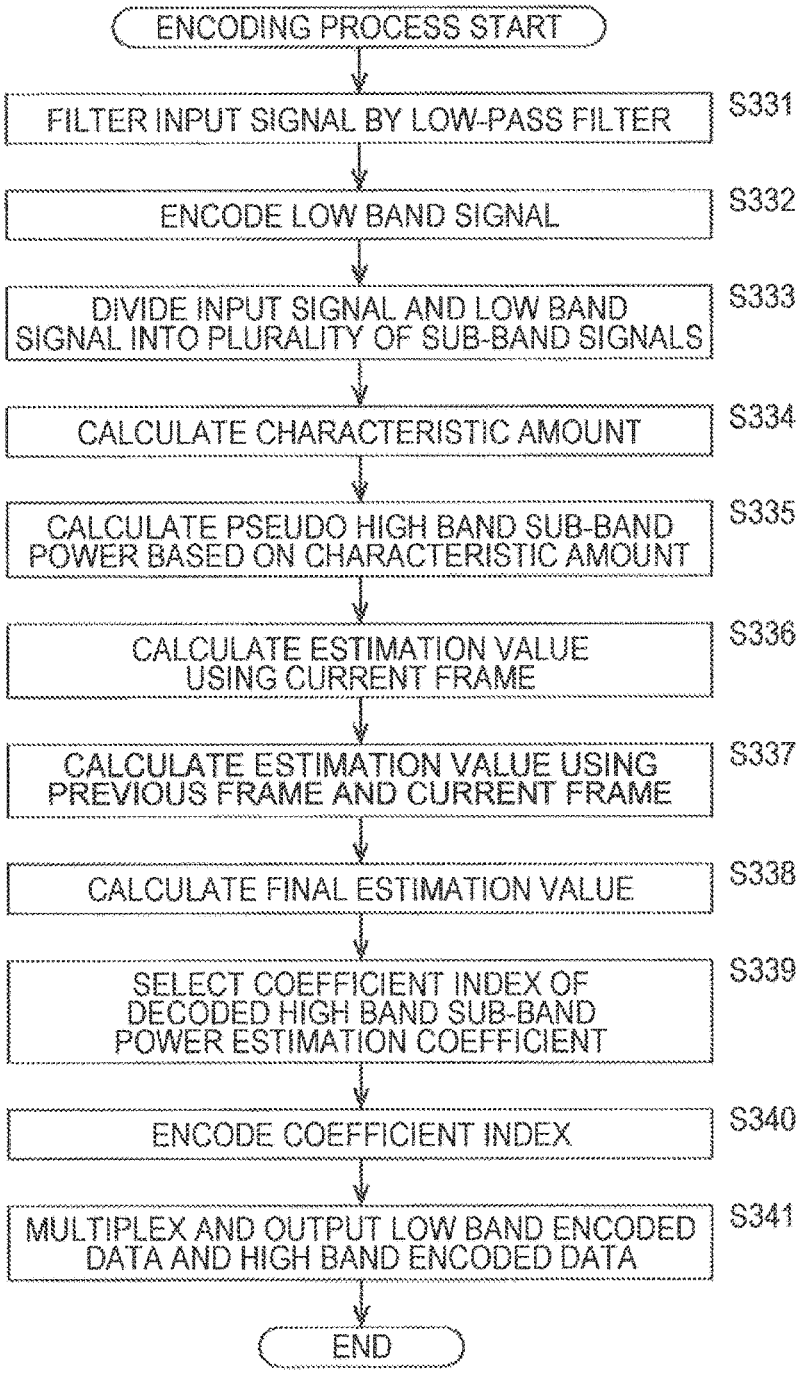
FIG. 25 is a flowchart describing an encoding process.

As described below, an encoding process by the encoder 30 will be described with reference to the flowchart in FIG. 25. In addition, the processes of step S331 to step S336 are identical with those of step S301 to step S306 in FIG. 24. Therefore, the description thereof will be omitted.

The pseudo high band sub-band power difference calculation circuit 36 calculates the estimation value ResP(id,J) using a past frame and a current frame in step S337.

Specifically, the pseudo high band sub-band power difference calculation circuit 36 records the pseudo high band sub-band power of each sub-band obtained by the decoded high band sub-band power estimation coefficient of the coefficient index selected finally with respect to frames J−1 earlier than frame J to be processed by one in time. Herein, the finally selected coefficient index is referred to as a coefficient index output to the decoder 40 by encoding using the high band encoding circuit 37.

As described below, in particular, the coefficient index id selected in frame (J−1) is set to as $\mathrm{id}_{selected}$(J−1). In addition, the pseudo high band sub-band power of the sub-band that the index obtained by using the decoded high band sub-band power estimation coefficient of the coefficient index $\mathrm{id}_{selected}$(J−1) is ib (where, sb+1≤ib≤eb) is continuously explained as $\mathrm{power}_{est}$(ib,$\mathrm{id}_{selected}$(J−1),J−1).

The pseudo high band sub-band power difference calculation circuit 36 calculates firstly following Equation (20) and then the estimation residual square mean value $\mathrm{ResP}_{std}$(id,J).

[Equation 20]

$$ResP_{std}(id,J)=\sum_{ib=sb+1}^{eb}\{\mathrm{power}_{est}(ib,id_{selected}(J-1),J-1)-\mathrm{power}_{est}(ib,id,J)\}^2 \quad (20)$$

That is, the difference between the pseudo high band sub-band power $\mathrm{power}_{est}$(ib,$\mathrm{id}_{selected}$(J−),J−1) of the frame J−1 and the pseudo high band sub-band power −$\mathrm{power}_{est}$(ib,id,J) of the frame J is obtained with respect to each sub-band of the high band side where the index is sb+1 to eb. In addition, the square sum for difference thereof is set as estimation error difference square average value $\mathrm{ResP}_{std}$(id,J). In addition, the pseudo high band sub-band power −($\mathrm{power}_{est}$(ib,id,J) shows the pseudo high band sub-band power of the frames (J) of the sub-band which the index is ib which is obtained with respect to the decoded high band sub-band power estimation coefficient where the coefficient index is id.

Since this estimation residual square value $ResP_{std}(id,J)$ is the of square sum for the difference of pseudo high band sub-band power between frames that is continuous in time, the smaller the estimation residual square mean $ResP_{std}(id,J)$ is, the smaller the time variation of the estimation value of the high band component is.

Continuously, the pseudo high band sub-band power difference calculation circuit 36 calculates the following Equation (21) and calculates the estimation residual maximum value $ResP_{max}(id,J)$.

[Equation 21]

$$ResP_{max}(id, J) = \max_{ib}\{|power_{est}(ib, id_{selected}(J-1), J-1) - power_{est}(ib, id, J)|\} \quad (21)$$

In addition, in the Equation (21), $\max_{ib}\{|power_{est}(ib, id_{selected}(J-1),J-1)-power_{est}(ib,id,J)|\}$ indicates the maximum absolute value of the difference between the pseudo high band sub-band power $power_{est}(ib,id_{selected}(J-1),J-1)$ of each sub-band in which the index is sb+1 to eb and the pseudo high band sub-band power $power_{est}(ib,id,J)$. Therefore, the maximum value of the absolute value of the difference between frames which is continuous in time is set as the estimation residual error difference maximum value $ResP_{max}((id,J)$.

The smaller the estimation residual error maximum value $ResP_{max}(id,J)$ is, the closer estimation result of the high band component between the consecutive frames is closed.

If the estimation residual maximum value $ResP_{max}(id,J)$ is obtained, next, the pseudo high band sub-band power difference calculation circuit 36 calculates the following Equation (22) and calculates the estimation residual average value $ResP_{ave}$ (id,J.

[Equation 22]

$$ResP_{ave}(id, J) = \left|\left(\sum_{ib=sb+1}^{eb} \{power_{est}(ib, id_{selected}(J-1), J-1) - power_{est}(ib, id, J)\}\right) / (eb - sb)\right| \quad (22)$$

That is, the difference between the pseudo high band sub-band power $power_{est}(ib,id_{selected}(J-1),J-1)$ of the frame (J−1) and the pseudo high band sub-band power $power_{est}$ (ib,id,J) of the frame J is obtained with respect to each sub-band of the high band side when the index is sb+1 to eb. In addition, the absolute value of the value obtained by dividing the sum of the difference of each sub-band by the number of the sub-bands (eb−sb) of the high band side is set as the estimation residual average $ResP_{ave}(id,J)$. The estimation residual error average value $ResP_{ave}(id,J)$ shows the size of the average value of the difference of the estimation value of the sub-band between the frames where the symbol is considered.

In addition, if the estimation residual square mean value $ResP_{std}$ (id,J), the estimation residual error maximum value $ResP_{max}(id,J)$ and the estimation residual average value $ResP_{ave}(id,J)$ are obtained, the pseudo high band sub-band power difference calculation circuit 36 calculates the following Equation (23) and calculates the average value ResP(id,J).

[Equation 23]

$$ResP(id, J) = ResP_{std}(id, J) + W_{max} \times ResP_{max}(id, J) + W_{ave} \times ResP_{ave}(id, J) \quad (23)$$

That is, the estimation residual square value $ResP_{std}(id,J)$, the estimation residual error maximum value $ResP_{max}(id,J)$ and the estimation residual average value $ResP_{ave}(id,J)$ are added with weight and set as the estimation value ResP(id, J). In addition, in Equation (23), $W_{max}$ and $W_{ave}$ are a predetermined weight, for example, $W_{max}$=0.5, $W_{ave}$=0.5.

Therefore, if the evaluation value ResP(id,J) using the past frame and the current value is calculated, the process proceeds from the step S337 to S338.

In step S338, the pseudo high band sub-band power difference calculation circuit 36 calculates the Equation (24) and calculates the ultimate estimation value $Res_{all}(id,J)$.

[Equation 24]

$$Res_{all}(id,J)=Res(id,J)+W_p(J)\times ResP(id,J) \quad (24)$$

That is, the obtained estimation value Res(id,J) and the estimation value ResP(id,J) are added with weight. In addition, in the Equation (24), $W_p(J)$, for example, is a weight defined by the following Equation (25).

[Equation 25]

$$W_p(J) = \begin{cases} \frac{-power_r(J)}{50} + 1 & (0 \le power_r(J) \le 50) \\ 0 & (otherwise) \end{cases}. \quad (25)$$

In addition, power (J) in the Equation (25) is a value defined by the following Equation (26).

[Equation 26]

$$power_r(J) = \sqrt{\left(\sum_{ib=sb+1}^{eb} \{power(ib, J) - power(ib, J-1)\}^2\right) / (eb - sb).} \quad (26)$$

This $power_r(J)$ shows the average of the difference between the high band sub-band powers of frames (J−1) and frames J. In addition, according to the Equation (25), when $power_r(J)$ is a value of the predetermined range in the vicinity of 0, the smaller the power=(J), $W_p(J)$ is closer to 1 and when power, (J) is larger than a predetermined range value, it is set as 0.

Herein, when power, (J) is a value of a predetermined range in the vicinity of 0, the average of the difference of the high band sub-band power between the consecutive frames becomes small to a degree. That is, the time variation of the high band component of the input signal is small and the current frames of the input signal become steady region.

As the high band component of the input signal is steady, the weight $W_p(J)$ becomes a value is close to 1, whereas as the high band component is not steady, the weight ($W_p(J)$ becomes a value close to 0. Therefore, in the estimation value $Res_{all}(id,J)$ shown in Equation (24), as the time variety of the high band component of the input signal becomes small, the coefficient of determination of the estimation value ResP (id, J) considering the comparison result and the estimation result of the high band component as the evaluation standards in the previous frames become larger.

Therefore, in a steady region of the input signal, the decoded high band sub-band power estimation coefficient obtained in the vicinity of the estimation result of the high band component in previous frames is selected and in the decoder 40 side, it is possible to more naturally reproduce the sound having high quality. Whereas in a non-steady region of the input signal, a term of estimation value ResP(id,J) in the estimation value $Res_{all}$(id,J) is set as 0 and the decoded high band signal closed to the actual high band signal is obtained.

The pseudo high band sub-band power difference calculation circuit 36 calculates the estimation value $Res_{all}$(id,J) for each of the K number of the decoded high band sub-band power evaluation coefficient by performing the above-mentioned processes.

In step S339, the pseudo high band sub-band power difference calculation circuit 36 selects the coefficient index id based on the estimation value $Res_{all}$(id,J) for each obtained decoded high band sub-band power estimation coefficient.

The estimation value $Res_{all}$(id,J) obtained from the process described above linearly combines the estimation value Res(id,J) and the estimation value ResP(id,J) using weight. As described above, the smaller the estimation value Res (id,J), a decoded high band signal closer to an actual high band signal can be obtained. In addition, the smaller the estimation value ResP(id,J), a decoded high band signal closer to the decoded high band signal of the previous frame can be obtained.

Therefore, the smaller the estimation value $Res_{all}$(id,J), a more suitable decoded high band signal is obtained. Therefore, the pseudo high band sub-band power difference calculation circuit 36 selects the estimation value having a minimum value in the K number of the estimation $Res_{all}$ (id,J) and supplies the coefficient index indicating the decoded high band sub-band power estimation coefficient corresponding to this estimation value to the high band encoding circuit 37.

If the coefficient index is selected, after that, the processes of step S340 and step S341 are performed to complete the encoding process. However, since these processes are the same as the processes of step S308 and step S309 in FIG. 24, the description thereof will be omitted.

As described above, in the encoder 30, the estimation value $Res_{all}$(id,J) obtained by linearly combining the estimation value Res(id,J) and the estimation value ResP(id,J) is used, so that the coefficient index of the optimal decoded high band sub-band power estimation coefficient is selected.

If the estimation value $Res_{all}$(id,J) is used, as the case uses the estimation value Res(id,J), it is possible to select a more suitable decoded high band sub-band power estimation coefficient by more many estimation standards. However, if the estimation value $Res_{all}$(id,J) is used, it is possible to control the time variation in the steady region of the high band component of signal to be reproduced in the decoder 40 and it is possible to obtain a signal having high quality.

Modification Example 2

By the way, in the frequency band expansion process, if the sound having high quality is desired to be obtained, the sub-band of the lower band side is also important in term of the audibility. That is, among sub-bands on the high band side as the estimation accuracy of the sub-band close to the low band side become larger, it is possible to reproduce sound having high quality.

Herein, when the estimation value with respect to each decoded high band sub-band power estimation coefficient is calculated, a weight may be placed on the sub-band of the low band side. In this case, the encoder 30 in FIG. 18 performs the encoding process shown in the flowchart in FIG. 26.

Figure 26:
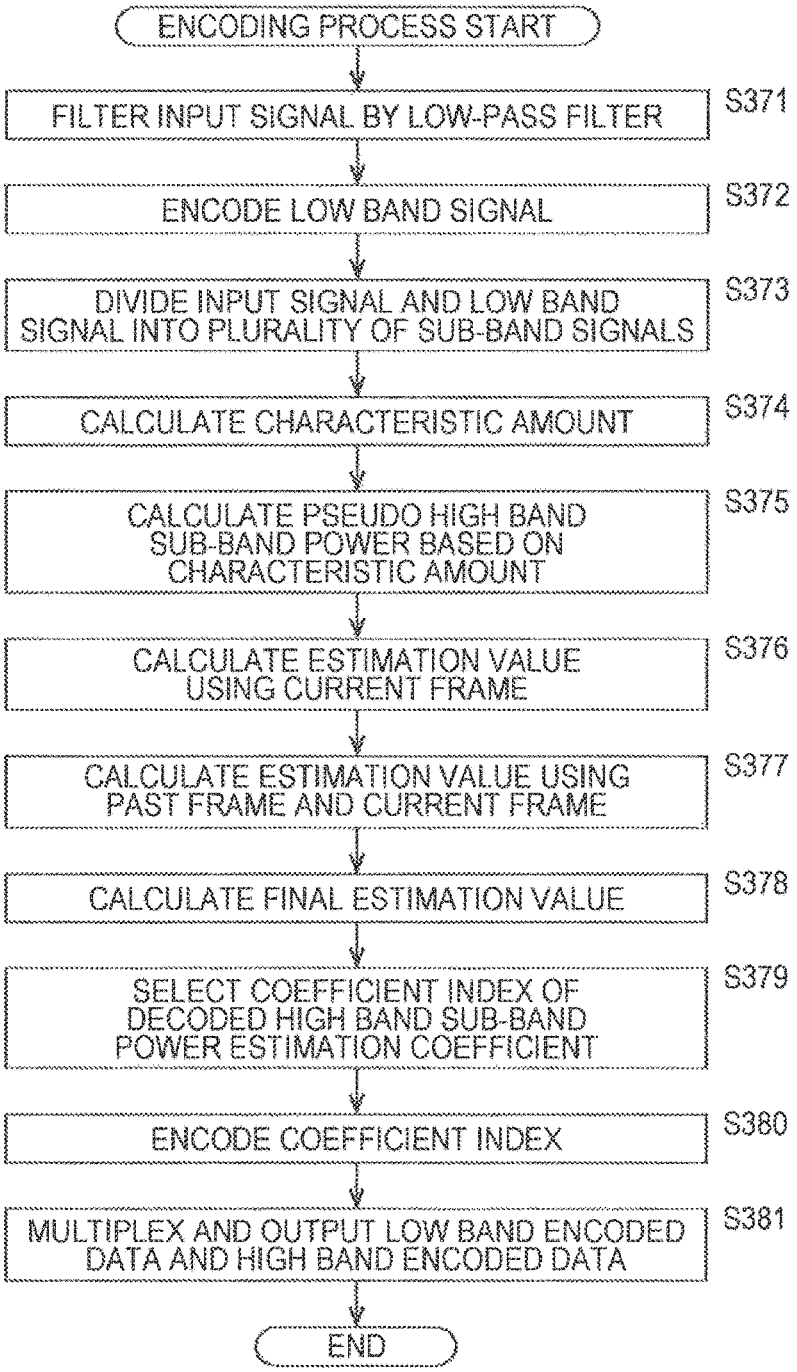
FIG. 26 is a flowchart describing an encoding process.

Hereinafter, the encoding process by the encoder 30 will be described with reference to the flowchart in FIG. 26. In addition, the processes of steps S371 to step S375 are identical with those of step S331 to step S335 in FIG. 25. Therefore, the description thereof will be omitted.

In step S376, the pseudo high band sub-band power difference calculation circuit 36 calculates estimation value $ResW_{band}$(id,J) using the current frame J to be processed for each of the K number of decoded high band sub-band power estimation coefficient.

Specially, the pseudo high band sub-band power difference calculation circuit 36 calculates high band sub-band power power(ib,J) in the frames J performing the same operation as the above-mentioned Equation (1) using the high band sub-band signal of each sub-band supplied from the sub-band division circuit 33.

If the high band sub-band power power(ib,J) is obtained, the pseudo high band sub-band power difference calculation circuit 36 calculates the following Equation 27 and calculates the residual square average value $Res_{std}W_{band}$(id,J)

[Equation 27]

$$Res_{std}W_{band}(ib, J) = \sum_{ib=sb+1}^{eb} \{W_{band}(ib) \times \{\text{power}(ib, J) - \text{power}_{est}(ib, id, J)\}\}^2. \quad (27)$$

That is, the difference between the high band sub-band power power(ib,J) of the frames (J) and the pseudo high band sub-band power ($power_{est}$(ib,id,J) is obtained and the difference is multiplied by the weight $W_{band}$(ib) for each sub-band, for each sub-band on the high band side where the index is sb+1 to eb. In addition, the sum of square for difference by which the weight $W_{band}$(ib) is multiplied is set as the residual error square average value $Res_{std}W_{band}$ (id,J).

Herein, the weight $W_{band}$(ib) (where, sb+1≤ib≤eb is defined by the following Equation 28. For example, the value of the weight $W_{band}$(ib) becomes as large as the sub-band of the low band side.

[Equation 28]

$$W_{band}(ib) = \frac{-3 \times ib}{7} + 4 \quad (28)$$

Next, the pseudo high band sub-band power difference calculation circuit 36 calculates the residual maximum value $Res_{max}W_{band}$(id,J). Specifically, the maximum value of the absolute value of the values multiplying the difference between the high band sub-band power power(ib,J) of each sub-band where the index is sb+1 to eb and the pseudo high band sub-band power $power_{est}$(ib,id,J) by the weight $W_{band}$ (ib) is set as the residual error difference maximum value $Res_{max}W_{band}$(id,J)

In addition, the pseudo high band sub-band power difference calculation circuit 36 calculates the residual error average value $Res_{ave}W_{band}(id,J)$.

Specially, in each sub-band where the index is sb+1 to eb, the difference between the high band sub-band power power (ib,J) and the pseudo high band sub-band $power_{est}$ (ib,id,J) is obtained and thus weight $W_{band}(ib)$ is multiplied so that the sum total of the difference by which the weight $W_{band}(ib)$ is multiplied, is obtained. In addition, the absolute value of the value obtained by dividing the obtained sum total of the difference into the sub-band number (eb−sb) of the high band side is set as the residual error average value $Res_{ave}W_{band}(id,J)$ In addition, the pseudo high band sub-band power difference calculation circuit 36 calculates the evaluation value $ResW_{band}(id,J)$. That is, the sum of the residual squares mean value $Res_{std}W_{band}(id,J)$, the residual error maximum value $Res_{max}W_{band}(id,J)$ that the weight ($W_{max}$) is multiplied, and the residual error average value $Res_{ave}W_{band}(id,J)$ by which the weight ($W_{ave}$) is multiplied, is set as the average value $ResW_{band}(id,J)$.

In step S377, the pseudo high band sub-band power difference calculation circuit 36 calculates the average value $ResPW_{band}(id,J)$ using the past frames and the current frames.

Specially, the pseudo high band sub-band power difference calculation circuit 36 records the pseudo high band sub-band power of each sub-band obtained by using the decoded high band sub-band power estimation coefficient of the coefficient index selected finally with respect to the frames J−1 before one frame earlier than the frame (J) to be processed in time.

The pseudo high band sub-band power difference calculation circuit 36 first calculates the estimation residual error average value $ResP_{std}W_{band}(id,J)$. That is, for each sub-band on the high band side in which the index is sb+1 to eb, the weight $W_{band}(ib)$ is multiplied by obtaining the difference between the pseudo high band sub-band power $power_{est}(ib, id_{selected}(J-1),J-1)$ and the pseudo high band sub-band $power_{est}(ib,id,J)$. In addition, the squared sum of the difference from which the weigh $W_{band}(ib)$ is calculated, is set as the estimation error difference average value $ResP_{est}W_{band}(id,J)$.

The pseudo high band sub-band power difference calculation circuit 36 continuously calculates the estimation residual error maximum value $ResP_{max}W_{band}(id,J)$. Specially, the maximum value of the absolute value obtained by multiplying the difference between the pseudo high band sub-band power $power_{est}(ib,id_{selected}(J-1),J-1)$ of each sub-band in which the index is sb+1 to eb and the pseudo high band sub-band power $-power_{est}(ib,id,J)$ by the weight $W_{band}(ib)$ is set as the estimation residual error maximum value $ResP_{max}W_{band}(id,J)$.

Next, the pseudo high band sub-band power difference calculation circuit 36 calculates the estimation residual error average value $ResP_{ave}W_{band}(id,J)$. Specially, the difference between the pseudo high band sub-band $power_{est}(ib,id_{selected}(J-1),J-1)$ and the pseudo high band sub-band power $power_{est}(ib,id,J)$ is obtained for each sub-band where the index is sb+1 to eb and the weight $W_{band}(ib)$ is multiplied. In addition, the sum total of the difference by which the weight $W_{band}(ib)$ is multiplied is the absolute value of the values obtained by being divided into the number (eb−sb) of the sub-bands of the high band side. However, it is set as the estimation residual error average value $ResP_{ave}W_{band}(id,J)$.

Further, the pseudo high band sub-band power difference calculation circuit 36 obtains the sum of the estimation residual error square average value $R_{es}P_{std}\ W_{band}(id, J)$ of the estimation residual error maximum value $ResP_{max}W_{band}(id,J)$ by which the weight $W_{max}$ is multiplied and the estimation residual error average value $ResP_{ave}W_{band}(id,J)$ by which the weight $W_{ave}$ is multiplied and the sum is set as the estimation value $ResPW_{band}(id,J)$ In step S378, the pseudo high band sub-band power difference calculation circuit 36 adds the evaluation value $ResW_{band}(id,J)$ to the estimation value $ResPW_{band}(id,J)$ by which the weight $W_p(J)$ of the Equation (25) is multiplied to calculate the final estimation value $Res_{all}W_{band}(id,J)$. This estimation value $Res_{all}W_{band}(id,J)$ is calculated for each of the K number decoded high band sub-band power estimation coefficient.

In addition, after that, the processes of step S379 to step S381 are performed to terminate the encoding process. However, since their processes are identical to those of with step S339 to step S341 in FIG. 25, the description thereof is omitted. In addition, the estimation value $Res_{all}W_{band}(id,J)$ is selected to be a minimum in the K number of coefficient index in step S379.

As described above, in order to place the weight in the sub-band of the low band side, it is possible to obtain sound having further high quality in the decoder 40 side by providing the weight for each of the sub-band.

In addition, as described above, the selection of the number of the decoded high band sub-band power estimation coefficient has been described as being performed based on the estimation value $Res_{all}W_{band}(id,J)$ However, the decoded high band sub-band power evaluation coefficient may be selected based on the estimation value $ResW_{band}(id,J)$.

Modification Example 3

In addition, since the auditory of person has a property that properly perceives a larger frequency band of the amplitude (power), the estimation value with respect to each decoded high band sub-band power estimation coefficient may be calculated so that the weight may be placed on the sub-band having a larger power.

Figure 27:
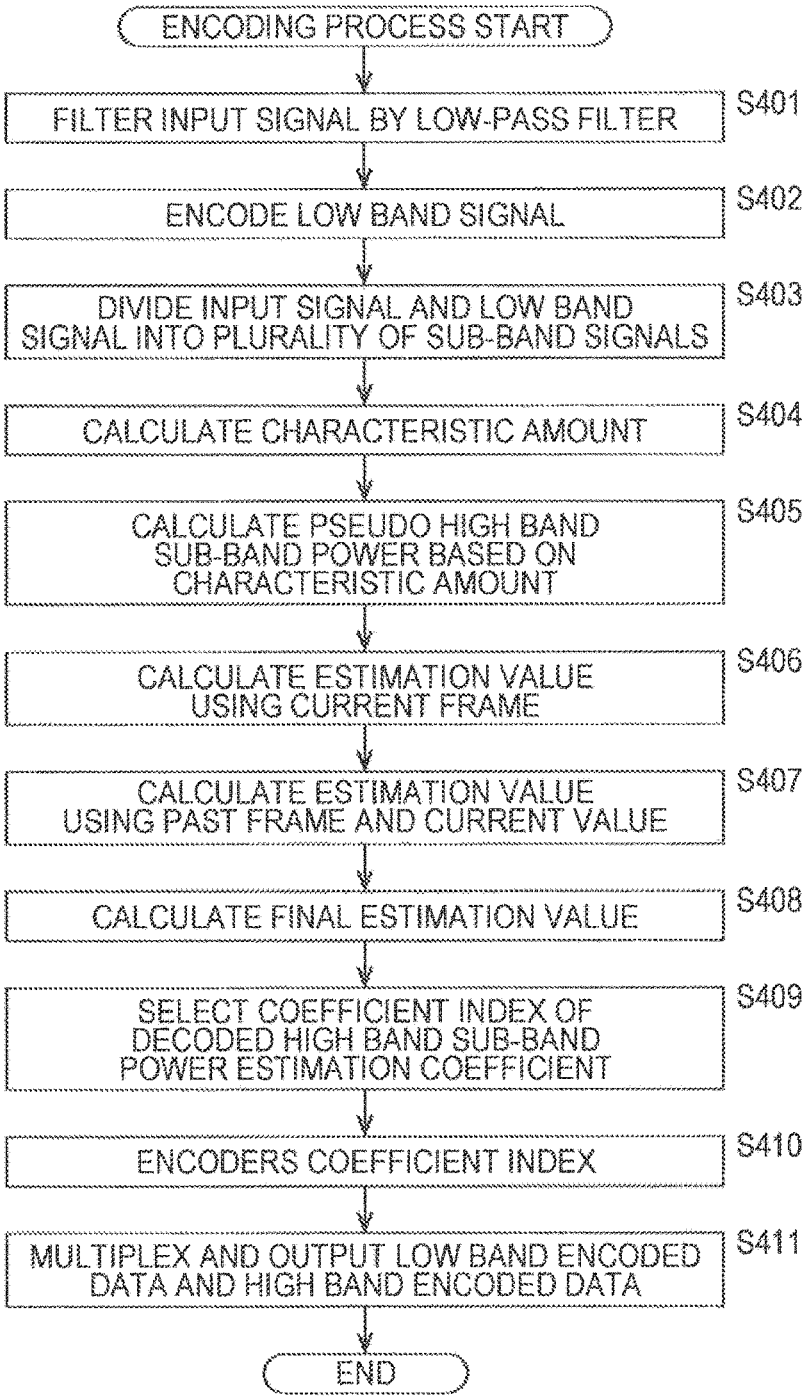
FIG. 27 is a flowchart describing an encoding process.

In this case, the encoder 30 in FIG. 18 performs an encoding process illustrated in a flowchart in FIG. 27. The encoding process by the encoder 30 will be described below with reference to the flowchart in FIG. 27. In addition, since the processes of step S401 to step S405 are identical with those of step S331 to step S335 in FIG. 25, the description thereof will be omitted.

In step S406, the pseudo high band sub-band power difference calculation circuit 36 calculates the estimation value $ResW_{power}(id,J)$ using the current frame J to be processed for the K number of decoded high band sub-band power estimation coefficient.

Specifically, the pseudo high band sub-band power difference calculation circuit 36 calculates the high band sub-band power power (ib,J) in the frames J by performing the same operation as the Equation (1) described above by using a high band sub-band signal of each sub-band supplied from the sub-band division circuit 33.

If the high band sub-band power power(ib,J) is obtained, the pseudo high band sub-band power difference calculation circuit 36 calculates the following Equation (29) and calculates the residual error squares average value $Res_{std}W_{power}(id,J)$.

[Equation 29]

$$Res_{std}W_{power}(id, J) = \sum_{ib=sb+1}^{eb} \{W_{power}(ib, J) \times \{\text{power}(ib, J) - \text{power}_{est}(ib, id, J)\}\}^2 \quad (29)$$

That is, the difference between the high band sub-band power $\text{power}_{est}$(ib,J) and the pseudo high band sub-band power power, (ib,id,J) is obtained and the weight $W_{power}$ (power(ib,J) for each of the sub-bands is multiplied by the difference thereof with respect to each band of the high band side in which the index is sb+1 to eb. In addition, the square sum of the difference by which the weight $W_{power}$(power (ib,J) is multiplied by set as the residual error squares average value $Res_{std}W_{power}$(id,J).

Herein, the weight $W_{power}$(power(ib,J) (where, sb+1≤ib≤eb), for example, is defined as the following Equation (30). As the high band sub-band power power(ib,J) of the sub-band becomes large, the value of weight $W_{power}$ (power(ib,J) becomes larger.

[Equation 30]

$$W_{power}(\text{power}(ib, J)) = \frac{3 \times \text{power}(ib, J)}{80} + \frac{35}{8} \quad (30)$$

Next, the pseudo high band sub-band power difference calculation circuit 36 calculates the residual error maximum value $Res_{max}W_{power}$(id,J). Specially, the maximum value of the absolute value multiplying the difference between the high band sub-band power power(ib,J) of the each sub-band that the index is sb+1 to eb and the pseudo high band sub-band power $\text{power}_{est}$(ib,id,J) by the weight $W_{power}$ (power(ib,J)) is set as the residual error maximum value $Res_{max}W_{power}$(id,J).

In addition, the pseudo high band sub-band power difference calculation circuit 36 calculates the residual error average value $Res_{ave}W_{power}$ (id,J).

Specially, in each sub-band where the index is sb+1 to eb, the difference between the high band sub-band power power (ib,J) and the pseudo high band sub-band power $\text{power}_{est}$ (ib,id,J) is obtained and the weight by which ($W_{power}$(power (ib,J) is multiplied and the sum total of the difference that the weight $W_{power}$(power(ib,J)) is multiplied is obtained. In addition, the absolute value of the values obtained by dividing the sum total of the obtained difference into the number of the high band sub-band and eb−sb) is set as the residual error average $Res_{ave}W_{power}$(id,J).

Further, the pseudo high band sub-band power difference calculation circuit 36 calculates the estimation value $ResW_{power}$(id,J). That is, the sum of residual squares average value $Res_{std}W_{power}$(id,J), the residual error difference value $Res_{max}W_{power}$(id,J) by which the weight (W=) is multiplied and the residual error average value $Res_{ave}W_{power}$(id,J) by which the weight ($W_{ave}$) is multiplied, is set as the estimation value $ResW_{power}$(id,J)

In step S407, the pseudo high band sub-band power difference calculation circuit 36 calculates the estimation value $ResPW_{power}$(id,J) using the past frame and the current frames.

Specifically, the pseudo high band sub-band power difference calculation circuit 36 records the pseudo high band sub-band power of each sub-band obtained by using the decoded high band sub-band power estimation coefficient of the coefficient index selected finally with respect to the frames (J−1) before one frame earlier than the frame J to be processed in time.

The pseudo high band sub-band power difference calculation circuit 36 first calculates the estimation residual square average value $ResP_{std}W_{power}$ (id,J). That is, the difference between the pseudo high band sub-band power $\text{power}_{est}$(ib,idJ) and the pseudo high band sub-band power ($\text{power}_{est}$(ib,$id_{selected}$(J−1),J−1) is obtained to multiply the weight $W_{power}$(power(ib,J), with respect to each sub-band the high-band side in which the index is sb+1 and eb. The square sum of the difference that the weight $W_{power}$(power (ib,J) is multiplied is set as the estimation residual square average value $ResP_{std}W_{power}$(id,J)

Next, the pseudo high band sub-band power difference calculation circuit 36 calculates the estimation residual error maximum value $ResP_{max}W_{power}$(id,J). Specifically, the absolute value of the maximum value of the values multiplying the difference between the pseudo high band sub-band power $\text{power}_{est}$(ib,$id_{selected}$(J−1),J−1) of each sub-band in which the index is sb+1 to as eb and the pseudo high band sub-band power $\text{power}_{est}$(ib,id,J) by the weight $W_{power}$ (power(ib,J) is set as the estimation residual error maximum value $ResP_{max}W_{power}$(id,J).

Next, the pseudo high band sub-band power difference calculation circuit 36 calculates the estimation residual error average value $ResP_{ave}W_{power}$(id,J). Specifically, the difference between the pseudo high band sub-band power $\text{power}_{est}$(ib,$id_{selected}$(J−1),J−1) and the pseudo high band sub-band power $\text{power}_{est}$(ib,id,J) is obtained with respect to each sub-band in which the index is sb+1 to eb and the weight $W_{power}$(power(ib,J) is multiplied. In addition, the absolute values of the values obtained by dividing the sum total of the multiplied difference of the weight $W_{power}$(power(ib,J) into the number (eb−sb) of the sub-band of high band side is set as the estimation residual error average value $ResP_{ave}W_{power}$(id,J)

Further, the pseudo high band sub-band power difference calculation circuit 36 obtains the sum of the estimation residual squares mean value $ResP_{std}W_{power}$(id,J), the estimation residual error maximum value $R_{es}P_{max}W_{power}$(id,J) by which the weight ($W_{max}$) is multiplied and the estimation residual error average value $ResP_{ave}W_{power}$(id,J) that the weight ($W_{ave}$) is multiplied is obtained and the sum is set as the estimation value $R_{es}PW_{power}$(id,J)

In step S408, the pseudo high band sub-band power difference calculation circuit 36 adds the estimation value ResWpower(id,J) to the estimation value $ResPW_{power}$(id,J) by which the weight $W_p$(J) of the Equation (25) is multiplied to calculate the final estimation value $Res_{all}W_{power}$(id,J). The estimation value $Res_{all}W_{power}$(id,J) is calculated from each K number of the decoded high band sub-band power estimation coefficient.

In addition, after that, the processes of step S409 to step S411 are performed to terminate the encoding process. However, since these processes are identical with those of step S339 to step S341 in FIG. 25, the description thereof is omitted. In addition, in step S409, the coefficient index in which the estimation value $Res_{all}W_{power}$(id,J) is set as a minimum is selected among the K number of the coefficient index.

As described above, in order for weight to be placed on the sub-band having a large sub-band, it is possible to obtain sound having high quality by providing the weight for each sub-band in the decoder 40 side.

In addition, as described above, the selection of the decoded high band sub-band power estimation coefficient has been described as being performed based on the estimation value $Res_{all}W_{power}$(id,J). However, the decoded high band sub-band power estimation coefficient may be selected based on the estimation value $ResW_{power}$(id,J)

6. Sixth Embodiment

[Configuration of Coefficient Learning Apparatus]

By the way, a set of a coefficient $A_{ib}$(kb) as the decoded high band sub-band power estimation coefficient and a coefficient $B_{ib}$ is recorded in a decoder 40 in FIG. 20 to correspond to the coefficient index. For example, if the decoded high band sub-band power estimation coefficient of 128 coefficient index is recorded in decoder 40, a large area is needed as the recording area such as memory for recording the decoded high band sub-band power estimation coefficient thereof.

Figure 28:
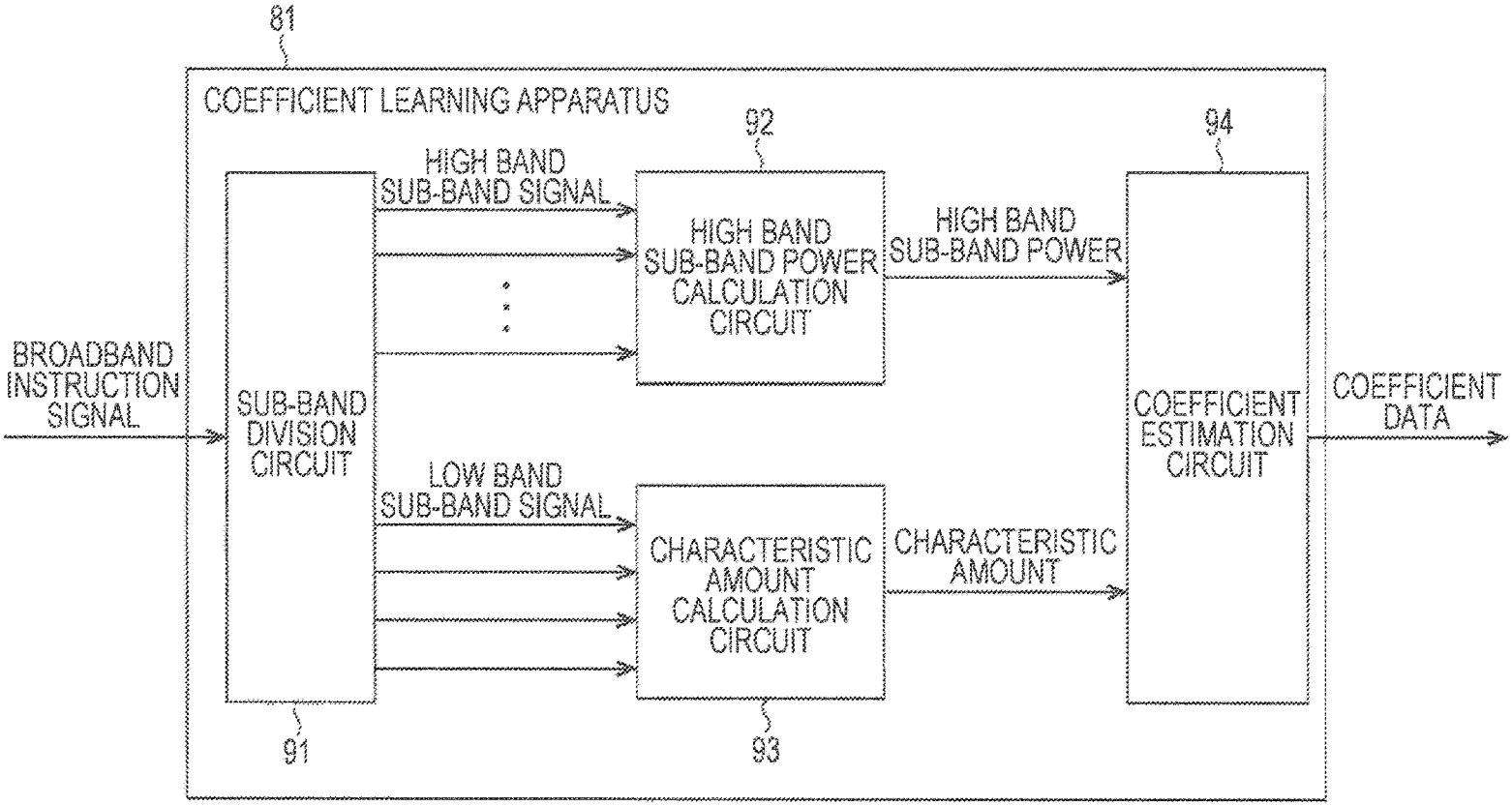
FIG. 28 is a view illustrating a configuration example of a coefficient learning apparatus.

Herein, a portion of a number of the decoded high band sub-band power estimation coefficient is set as common coefficient and the recording area necessary to record the decoded high band sub-band power estimation coefficient may be made smaller. In this case, the coefficient learning apparatus obtained by learning the decoded high band sub-band power estimation coefficient, for example, is configured as illustrated in FIG. 28.

The coefficient learning apparatus 81 includes a sub-band division circuit 91, a high band sub-band power calculation circuit 92, a characteristic amount calculation circuit 93 and a coefficient estimation circuit 94.

A plurality of composition data using learning is provided in a plurality of the coefficient learning apparatus 81 as a broadband instruction signal. The broadband instruction signal is a signal including a plurality of sub-band component of the high band and a plurality of the sub-band components of the low band.

The sub-band division circuit 91 includes the band pass filter and the like, divides the supplied broadband instruction signal into a plurality of the sub-band signals and supplies to the signals the high band sub-band power calculation circuit 92 and the characteristic amount calculation circuit 93. Specifically, the high band sub-band signal of each sub-band of the high band side in which the index is sb+1 to eb is supplied to the high band sub-band power calculation circuit 92 and the low band sub-band signal of each sub-band of the low band in which the index is sb−3 to sb is supplied to the characteristic amount calculation circuit 93.

The high band sub-band power calculation circuit 92 calculates the high band sub-band power of each high band sub-band signal supplied from the sub-band division circuit 91 and supplies it to the coefficient estimation circuit 94. The characteristic amount calculation circuit 93 calculates the low band sub-band power as the characteristic amount, the low band sub-band power based on each low band sub-band signal supplied from the sub-band division circuit 91 and supplies it to the coefficient estimation circuit 94.

The coefficient estimation circuit 94 produces the decoded high band sub-band power estimation coefficient by performing a regression analysis using the high band sub-band power from the high band sub-band power calculation circuit 92 and the characteristic amount from the characteristic amount calculation circuit 93 and outputs to decoder 40.

[Description of Coefficient Learning Process]

Next, a coefficient learning process performed by a coefficient learning apparatus 81 will be described with reference to a flowchart in FIG. 29.

In step S431, the sub-band division circuit 91 divides each of a plurality of the supplied broadband instruction signal into a plurality of sub-band signals. In addition, the sub-band division circuit 91 supplies a high band sub-band signal of the sub-band that the index is sb+1 to eb to the high band sub-band power calculation circuit 92 and supplies the low band sub-band signal of the sub-band that the index is sb−3 to sb to the characteristic amount calculation circuit 93.

In step S432, the high band sub-band power calculation circuit 92 calculates the high band sub-band power by performing the same operation as the Equation (1) described above with respect to each high band sub-band signal supplied from the sub-band division circuit 91 and supplies it to the coefficient estimation circuit 94.

In step S433, the characteristic amount calculation circuit 93 calculates the low band sub-band power as the characteristic amount by performing the operation of the Equation (1) described above with respect each low band sub-band signal supplied from the sub-band division circuit 91 and supplies to it the coefficient estimation circuit 94.

Accordingly, the high band sub-band power and the low band sub-band power are supplied to the coefficient estimation circuit 94 with respect to each frame of a plurality of the broadband instruction signal.

In step S434, the coefficient estimation circuit 94 calculates a coefficient $A_{ib}$(kb) and a coefficient $B_{ib}$ by performing the regression of analysis using least-squares method for each of the sub-band ib (where, sb+1≤ib≤eb) of the high band in which the index is sb+1 to eb.

In the regression analysis, it is assumed that the low band sub-band power supplied from the characteristic amount calculation circuit 93 is an explanatory variable and the high band sub-band power supplied from the high band sub-band power calculation circuit 92 is an explained variable. In addition, the regression analysis is performed by using the low band sub-band power and the high band sub-band power of the whole frames constituting the whole broadband instruction signal supplied to the coefficient learning apparatus 81.

In step S435, the coefficient estimation circuit 94 obtains the residual vector of each frame of the broadband instruction signal using a coefficient $A_{ib}$ (kb and a coefficient ($B_{ib}$) for each of obtained sub-band ib.

For example, the coefficient estimation circuit 94 obtains the residual error by subtracting the sum of total of the lower band sub-band power power(kb, J) (where, sb−3≤kb≤sb) that is acquired by the coefficient is $AibA_{ib}$(kb) thereto coefficient $B_{ib}$ multiplied from the high band power ((power (ib, J) for each of the sub-band ib (where, sb+1≤ib≤eb) of the frame J and. In addition, vector including the residual error of each sub-band ib of the frame J is set as the residual vector.

In addition, the residual vector is calculated with respect to the frame constituting the broadband instruction signal supplied to the coefficient learning apparatus 81.

In step S436, the coefficient estimation circuit 94 normalizes the residual vector obtained with respect to each frame. For example, the coefficient estimation circuit 94 normalizes, for each sub-band ib, the residual vector by obtaining variance of the residual of the sub-band ib of the residual vector of the whole frame and dividing a residual error of the sub-band ib in each residual vector into the square root of the variance.

In step S437, the coefficient estimation circuit 94 clusters the residual vector of the whole normalized frame by the k-means method or the like.

For example, the average frequency envelope of the whole frame obtained when performing the estimation of the high band sub-band power using the coefficient $A_{ib}$(kb) and the coefficient $B_{ib}$ is referred to as an average frequency envelope SA. In addition, it is assumed that a predetermined frequency envelope having larger power than the average frequency envelope SA is frequency envelope SH and a predetermined frequency envelope having smaller power than the average frequency envelope SA is frequency envelope SL.

In this case, each residual vector of the coefficient in which the frequency envelope close to the average frequency envelop SA, the frequency envelop SH and the frequency envelop SL is obtained, performs clustering of the residual vector so as to be included in a cluster CA, a cluster CH, and a cluster CL. That is, the residual vector of each frame performs clustering so as to be included in any one of cluster CA, a cluster CH or a cluster CL.

In the frequency band expansion process for estimating the high band component based on a correlation of the low band component and the high band component, in terms of this, if the residual vector is calculated using the coefficient $A_{ib}$ (kb) and the coefficient $B_{ib}$ obtained from the regression analysis, the residual error increases as much as large as the sub-band of the high band side. Therefore, the residual vector is clustered without changing, the weight is placed in as much as sub-band of the high band side to perform process.

In this contrast, in the coefficient learning apparatus 81, variance of the residual error of each sub-band is apparently equal by normalizing the residual vector as the variance of the residual error of the sub-band and clustering can be performed by providing the equal weight to each sub-band.

In step S438, the coefficient estimation circuit 94 selects as a cluster to be processed of any one of the cluster CA, the cluster CH and the cluster CL.

In step S439, the coefficient estimation circuit 94 calculates $A_{ib}$(kb) and the coefficient $B_{ib}$ of each sub-band ib (where, $sb+1 \leq ib \leq eb$) by the regression analysis using the frames of the residual vector included in the cluster selected as the cluster to be processed.

That is, if the frame of the residual vector included in the cluster to be processed is referred to as the frame to be processed, the low band sub-band power and the high band sub-band power of the whole frame to be processed is set as the exploratory variable and the explained variable and the regression analysis used the least-squares method is performed. Accordingly, the coefficient $A_{ib}$(kb) and the coefficient $B_{ib}$ is obtained for each sub-band ib.

In step S440, the coefficient estimation circuit 94 obtains the residual vector using the coefficient $A_{ib}$(kb) and the coefficient $B_{ib}$ obtained by the process of step S439 with respect the whole frame to be processed. In addition, in step S440, the same process as the step S435 is performed and thus the residual vector of each frame to be processed is obtained.

In step S441, the coefficient estimation circuit 94 normalizes the residual vector of each frame to be processed obtained by process of step S440 by performing the same process as step S436. That is, normalization of the residual vector is performed by dividing the residual error by the variance for each the sub-band.

In step S442, the coefficient estimation circuit 94 clusters the residual vector of the whole normalized frame to be processed using k-means method or the like. The number of this cluster number is defined as following. For example, in the coefficient learning apparatus 81, when decoded high band sub-band power estimation coefficients of 128 coefficient indices are produced, 128 is multiplied by the frame number to be processed and the number obtained by dividing the whole frame number is set as the cluster number. Herein, the whole frame number is referred to as sum of the whole frame of the broadband instruction signal supplied to the coefficient learning apparatus 81.

In step S443, the coefficient estimation circuit 94 obtains a center of gravity vector of each cluster obtained by process of step S442.

For example, the cluster obtained by the clustering of the step S442 corresponds to the coefficient index and in the coefficient learning apparatus 81, the coefficient index is assigned for each cluster to obtain the decoded high band sub-band power estimation coefficient of the each coefficient index.

Specifically, in step S438, it is assumed that the cluster CA is selected as a cluster to be processed and F clusters are obtained by clustering in step S442. When one cluster CF of F clusters is focused, the decoded high band sub-band power estimation coefficient of a coefficient index of the cluster CF is set as the coefficient $A_{ib}$(kb) in which the coefficient $A_{ib}$(kb) obtained with respect to the cluster CA in step S439 is a linear correlative term. In addition, the sum of the vector performing a reverse process (reverse normalization) of a normalization performed at step S441 with respect to center of gravity vector of the cluster CF obtained from step S443 and the coefficient $B_{ib}$ obtained at step S439 is set as the coefficient $B_{ib}$ which is a constant term of the decoded high band sub-band power estimation coefficient. The reverse normalization is set as the process multiplying the same value (root square for each sub-band) as when being normalized with respect to each element of center of gravity vector of the cluster CF when the normalization, for example, performed at step S441 divides the residual error into the toot square of the variance for each sub-band.

That is, the set of the coefficient $A_{ib}$(kb) obtained at step S439 and the coefficient $B_{ib}$ obtained as described is set as the decoded high band sub-band power estimation coefficient of the coefficient index of the cluster CF. Accordingly, each of the F clusters obtained by clustering commonly has the coefficient $A_{ib}$(kb) obtained with respect to the cluster CA as the linear correlation term of the decoded high band sub-band power estimation coefficient.

In step S444, the coefficient learning apparatus 81 determines whether the whole cluster of the cluster CA, the cluster CH and the cluster CL is processed as a cluster to be processed. In addition, in step S444, if it is determined that the whole cluster is not processed, the process returns to step S438 and the process described is repeated. That is, the next cluster is selected to be processed and the decoded high band sub-band power estimation coefficient is calculated.

In this contrast, in step S444, if it is determined that the whole cluster is processed, since a predetermined number of the decoded high band sub-band power to be obtained is calculated, the process proceeds to step S445.

In step S445, the coefficient estimation circuit 94 outputs and the obtained coefficient index and the decoded high band sub-band power estimation coefficient to decoder 40 and thus the coefficient learning process is terminated.

For example, in the decoded high band sub-band power estimation coefficients output to decoder 40, there are several same coefficients $A_{ib}$(kb) as linear correlation term. Herein, the coefficient learning apparatus 81 corresponds to the linear correlation term index (pointer) which is information that specifies the coefficient $A_{ib}$(kb) to the coefficient $A_{ib}$(kb) common to thereof and corresponds the coefficient Bu, which is the linear correlation index and the constant term to the coefficient index.

In addition, the coefficient learning apparatus 81 supplies the corresponding linear correlation term index (pointer) and a coefficient $A_{ib}$(kb), and the corresponding coefficient index and the linear correlation index (pointer) and the coefficient $B_{ib}$ to the decoder 40 and records them in a memory in the high band decoding circuit 45 of the decoder 40. Like this, when a plurality of the decoded high band sub-band power estimation coefficients are recorded, if the linear correlation term index (pointer) is stored in the recording area for each decoded high band sub-band power estimation coefficient with respect to the common linear correlation term, it is possible to reduce the recording area remarkably.

In this case, since the linear correlation term index and to the coefficient $A_{ib}$(kb) are recorded in the memory in the high band decoding circuit 45 to correspond to each other, the linear correlation term index and the coefficient $B_{ib}$ are obtained from the coefficient index and thus it is possible to obtain the coefficient $A_{ib}$(kb) from the linear correlation term index.

In addition, according to a result of analysis by the applicant, even though the linear correlation term of a plurality of the decoded high band sub-band power estimation coefficients is communized in a three-pattern degree, it has known that deterioration of sound quality of audibility of sound subjected to the frequency band expansion process does not almost occur. Therefore, it is possible for the coefficient learning apparatus 81 to decrease the recording area required in recording the decoded high band sub-band power estimation coefficient without deteriorating sound quality of sound after the frequency band expansion process.

As described above, the coefficient learning apparatus 81 produces the decoded high band sub-band power estimation coefficient of each coefficient index from the supplied broadband instruction signal, and output the produced coefficient.

Figure 29:
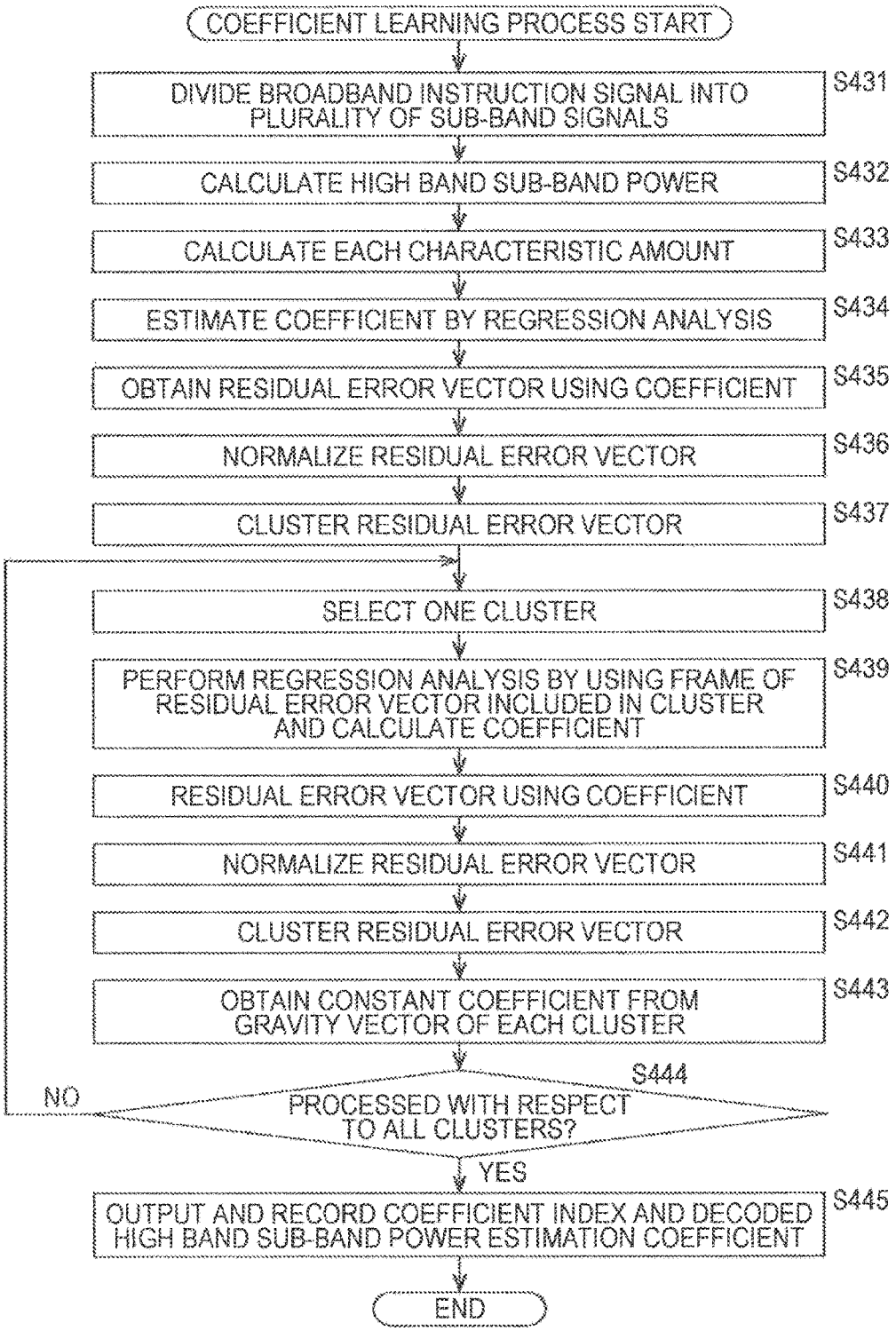
FIG. 29 is a flowchart describing a coefficient learning process.

In addition, in the coefficient learning process in FIG. 29, the description is made that the residual vector is normalized. However, the normalization of the residual vector may not be performed in one or both of step S436 and step S441.

In addition, the normalization of the residual vector is performed and thus communization of the linear correlation term of the decoded high band sub-band power estimation coefficient may not be performed. In this case, the normalization process is performed in step S436 and then the normalized residual vector is clustered in the same number of clusters as that of the decoded high band sub-band power estimation coefficient to be obtained. In addition, the frames of the residual error included in each cluster are used to perform the regression analysis for each cluster and the decoded high band sub-band power estimation coefficient of each cluster is produced.

7. Seventh Embodiment

[High Efficiency Encoding of Coefficient Index String]

In addition, as described above, the coefficient index for obtaining the decoded high band sub-band power estimation coefficient is included in the high band encoded data (bit stream) and is transmitted to the decoder 40 for each frame. However, in this case, the bit amount of the coefficient index string included in the bit stream increases and the encoding efficiency decreases. That is, it is possible to perform encoding or decoding of sound having a good efficiency.

Herein, when the coefficient index string is included in the bit stream, the coefficient index string is encoded by including time information in which the coefficient index is changed and the value of the changed coefficient index without including the value of the coefficient index of each frame as it is, so that the bit amount may be decreased.

Figure 30:
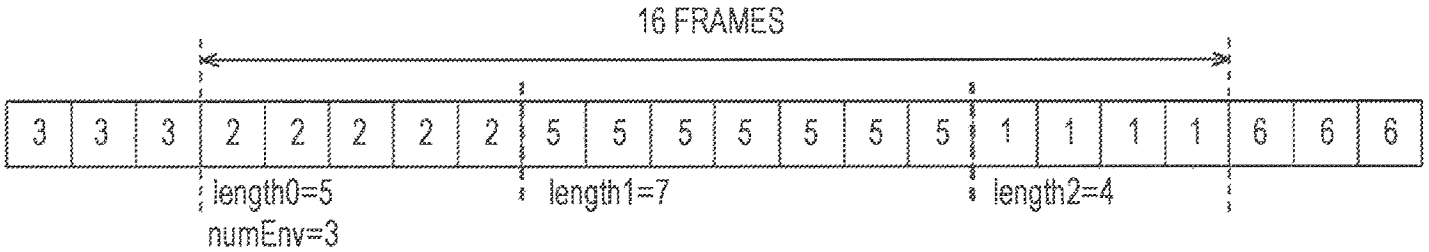
FIG. 30 is a view describing an encoding amount reduction of a coefficient index string.

That is, as described above, one coefficient index per frame is set as the high band encoded data and is included in the bit stream. However, when a real world signal, in particular, a stationary signal is encoded, there are many cases in which the coefficient index is continuous with the same value in a time direction as in FIG. 30. An information amount reduction method of time direction of the coefficient index is invented using characteristic.

Specifically, there is a method that transmits time information on which the index is switched and the index value thereof every plural (for example, 16) frames.

Two pieces of time information are considered as follows.

(a) The length and the number of indices (see FIG. 30) are transmitted.

Figure 31:
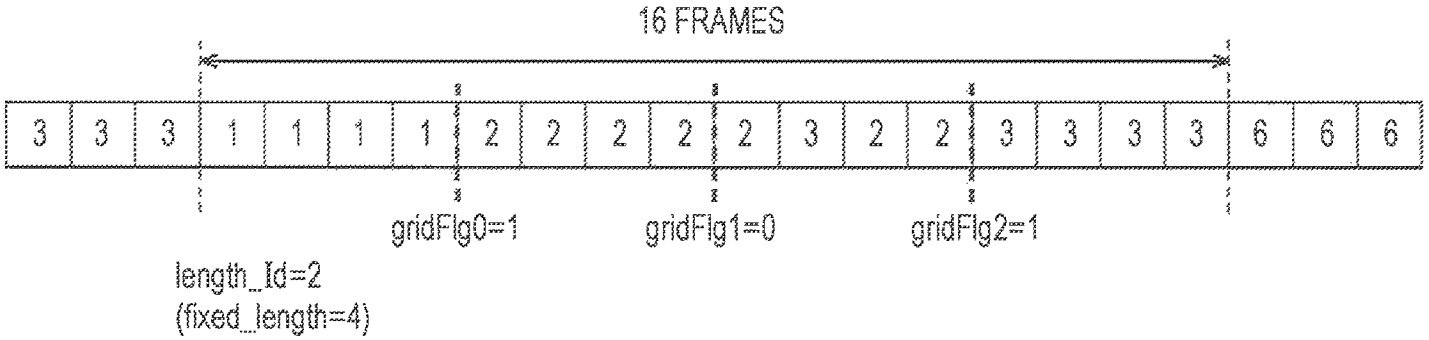
FIG. 31 is a view describing an encoding amount reduction of a coefficient index string.

(b) The index of the length and a switching flag are transmitted (see FIG. 31).

In addition, it is possible to correspond each or both of (a) and (b) to one index as described below.

A detailed embodiment in a case where each (a) and (b), and both of thereof is selectively used will be described.

First, (a) a case where the length and the number of the indices are transmitted, will be described.

Figure 32:
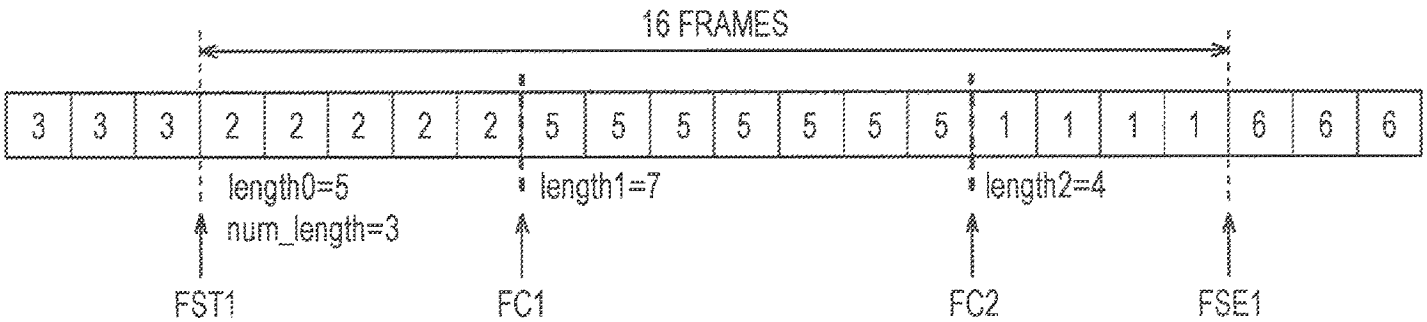
FIG. 32 is a view describing an encoding amount reduction of a coefficient index string.

For example, as described in FIG. 32, it is assumed that an output code string (bitstream) including the low band encoded data and the high band encoded data is output from the encoder as unit of a plurality frames. In addition, in FIG. 32, a transverse direction shows time and one rectangle shows one frame. In addition, the numerical value within the rectangle showing a frame shows the coefficient index specifying the decoded high band sub-band power estimation coefficient of the frame.

In an example of FIG. 32, the output code string is output as a unit every 16 frames. For example, it is assumed that the section from a position FST1 to a position FSE1 is the section to be processed and it is considered that the output code string of 16 frames included in the section to be processed is output.

First, the section to be processed is divided into the segments (hereinafter, referred to as consecutive frame segments) including consecutive frames where the same coefficient index is selected. That is, it is assumed that the boundary position of the frames adjacent to each other is a boundary position of each consecutive frame segment in which a different coefficient index is selected.

In the example, the section to be processed is divided into three segments, that is, a segment from a position FST1 to a position FC1, a segment from a position FC1 to an position FC2, and a segment from a position FC2 to a position FSE1.

For example, the coefficient index "2" is selected in each frame in consecutive frame segments from the position FST1 to the position FC1.

Therefore, when the section to be processed is divided into consecutive frame segments, data including the number information indicating the number of consecutive frame segments within the section to be processed, a coefficient index selected at each consecutive frame segment and segment information indicating the length of each consecutive frame segment is produced.

For example, in an example in FIG. 32, since the section to be processed is divided into three consecutive frame segments, information indicating the number of the consecutive frame segments "3" is set as the number information and is expressed as "num_length=3" in FIG. 32. For example, segment information of an initial consecutive frame segment in the frame to be processed is set as length "5" considering frames of the consecutive frame segment to be an unit and is expressed as "length0=5" in FIG. 32.

In addition, each piece of segment information can be specified whether it is included in any segment information of the consecutive frame segments from the lead of the section to be processed. That is, the segment information includes information specifying the position of consecutive frame segments in the section to be processed.

Therefore, in the section to be processed, when data including the number information, the coefficient index and the segment information is produced, this data is encoded to be set as the high band encoded data. In this case, when the same coefficient index is continuously selected in a plurality of frames, since it is not necessary to transmit the coefficient index for each frame, it is possible to reduce the data amount of bitstream transmitted and to perform encoding and decoding more efficiently.

[Functional Configuration Example of Encoder]

Figure 33:
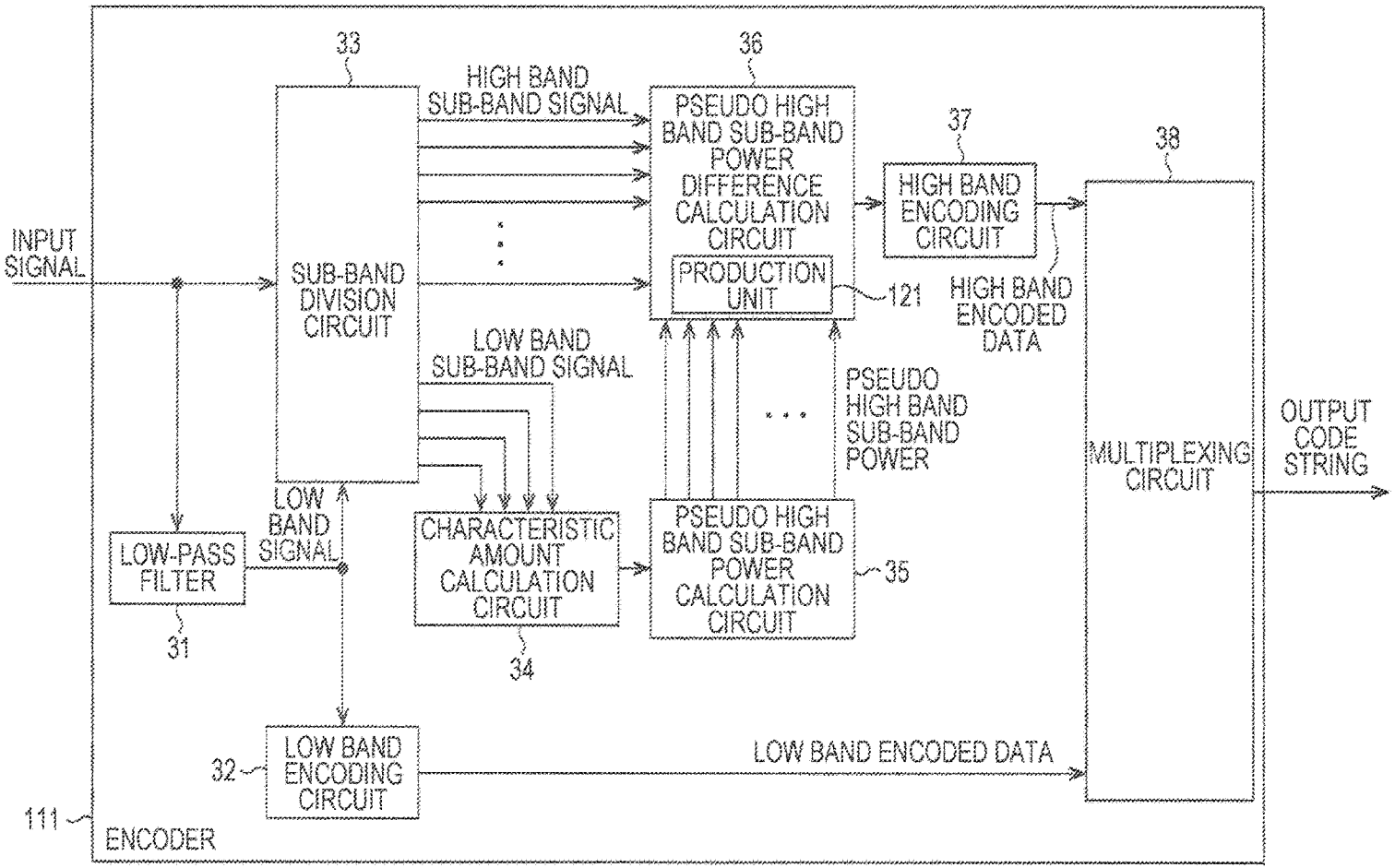
FIG. 33 is a block diagram illustrating a functional configuration example of an encoder.

When high band encoded data including the number information, the coefficient index and the segment information is produced, for example, the encoder is configured as illustrated in FIG. 33. In addition, in FIG. 33, the same symbol is provided in part corresponding to a case in FIG. 18 and thus the description thereof is appropriately omitted.

An encoder 111 in FIG. 33 and the encoder 30 in FIG. 18 are different in that the production unit 121 is disposed in the pseudo high band sub-band power difference calculation circuit 36 of the encoder 111 and other configurations are the same.

The production unit 121 of the pseudo high band sub-band power difference calculation circuit 36 produces data including the number information, the coefficient index and the segment information based on selection result of the coefficient index in each frame in the section to be processed and supplies the produced data to the high band encoding circuit 37.

[Description of Encoding Processing]

Next, an encoding process performed by the encoder 111 will be described with respect to a flowchart in FIG. 34. The encoding process is performed for each of a predetermined number of frames, that is, a section to be processed.

Figure 19:
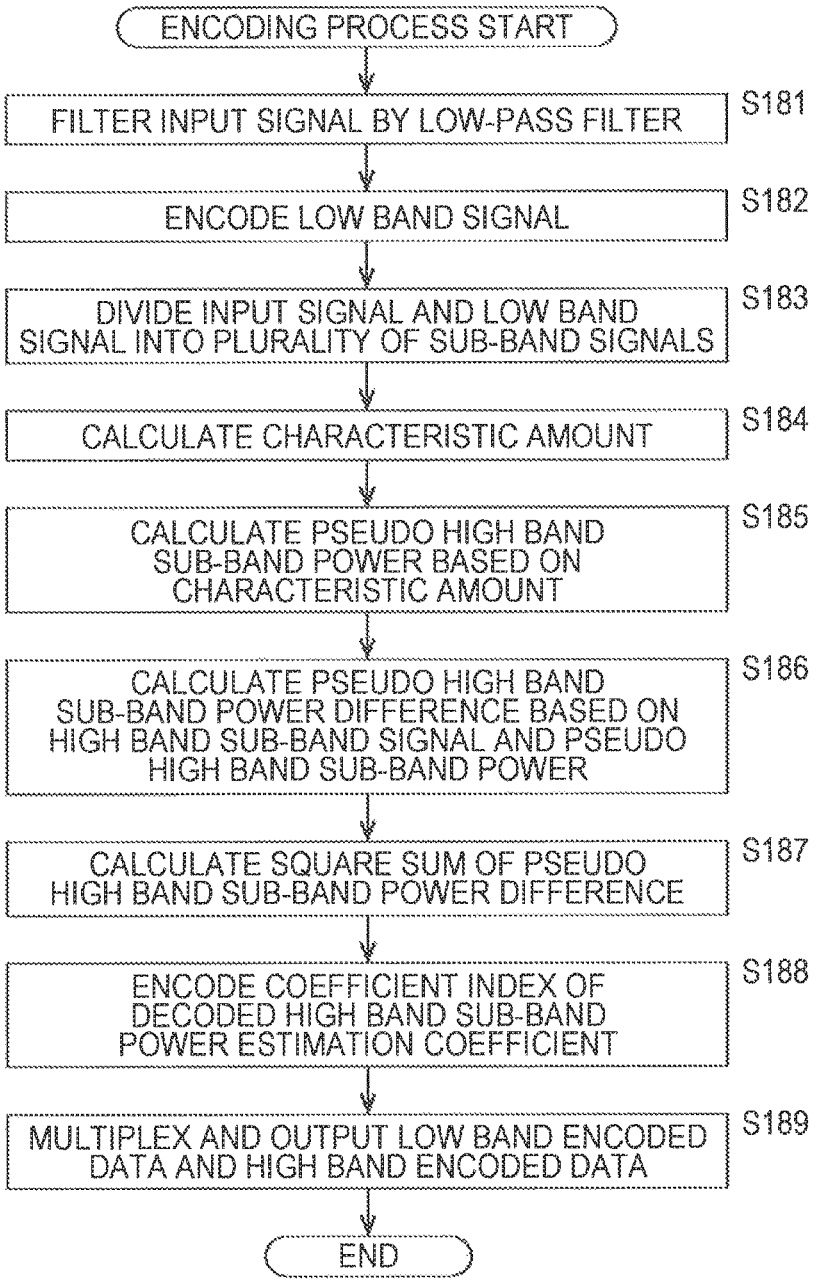
FIG. 19 is a flowchart describing of encoding processing.

In addition, since the processes of step S471 to step S477 are identical with those of step 3181 to step S187 in FIG. 19, the description thereof is omitted. In the processes of step S471 to step S477, each frame constituting the section to be processed is set as a frame to be processed in order and a sum of squares E(J,id) of the pseudo high band sub-band power difference is calculated for each decoded high band sub-band power estimation coefficient with respect to the frame to be processed.

In step S478, the pseudo high band sub-band power difference calculation circuit 36 selects the coefficient index based on the sum of squares (a sum of squares for difference) of the pseudo high band sub-band power difference for each decoding high band sub-band power estimation coefficient calculated with respect to the frame to be processed.

That is, the pseudo high band sub-band power difference calculation circuit 36 selects the sum of squares for the difference having a minimum value among a plurality of the sums of squares for difference and sets the coefficient index indicating the decoded high band sub-band power estimation coefficient corresponding to the sum of squares for difference as the selected coefficient index.

In step S479, the pseudo high band sub-band power difference calculation circuit 36 determines whether the only process of the length of a predetermined frame is performed. That is, it is determined whether the coefficient index is selected with respect to the whole frame constituting the section to be processed.

In step S479, when it is determined that the process of the length of a predetermined frame is still not performed, the process returns to step S471 and the process described above is repeated. That is, among the section to be processed, the frame that is not still processed is set as the frame to be processed next and the coefficient index of the frame is selected.

In the contrast, in step S479, if it is determined that the process of the length of a predetermined frame is performed, that is, if the coefficient index is selected with respect to the whole frame in the section to be processed, the process proceeds to step S480.

In step S480, the production unit 121 produces the data including the coefficient index, the segment formation, and the number information based on the selection result of the coefficient index of each frame within the section to be processed and supplies the produced data to the high band encoding circuit 37.

For example, in the example in FIG. 32, the production unit 121 divides the section to be processed from the position FST1 to the position FSE1 into three consecutive frame segments. In addition, the production unit 121 produces the data including the number information "num_length=3" showing "3" of the number of the consecutive frame segments, the segment information "length0=5", "length1=7", and "length2=4" showing the length of each consecutive frame segment and the coefficient index "2", "5" and "1" of the consecutive frame segment thereof.

In addition, the coefficient index of each of the consecutive frame segments corresponds to the segment information and it is possible to specify which of the consecutive frame segment includes the coefficient index.

Figure 34:
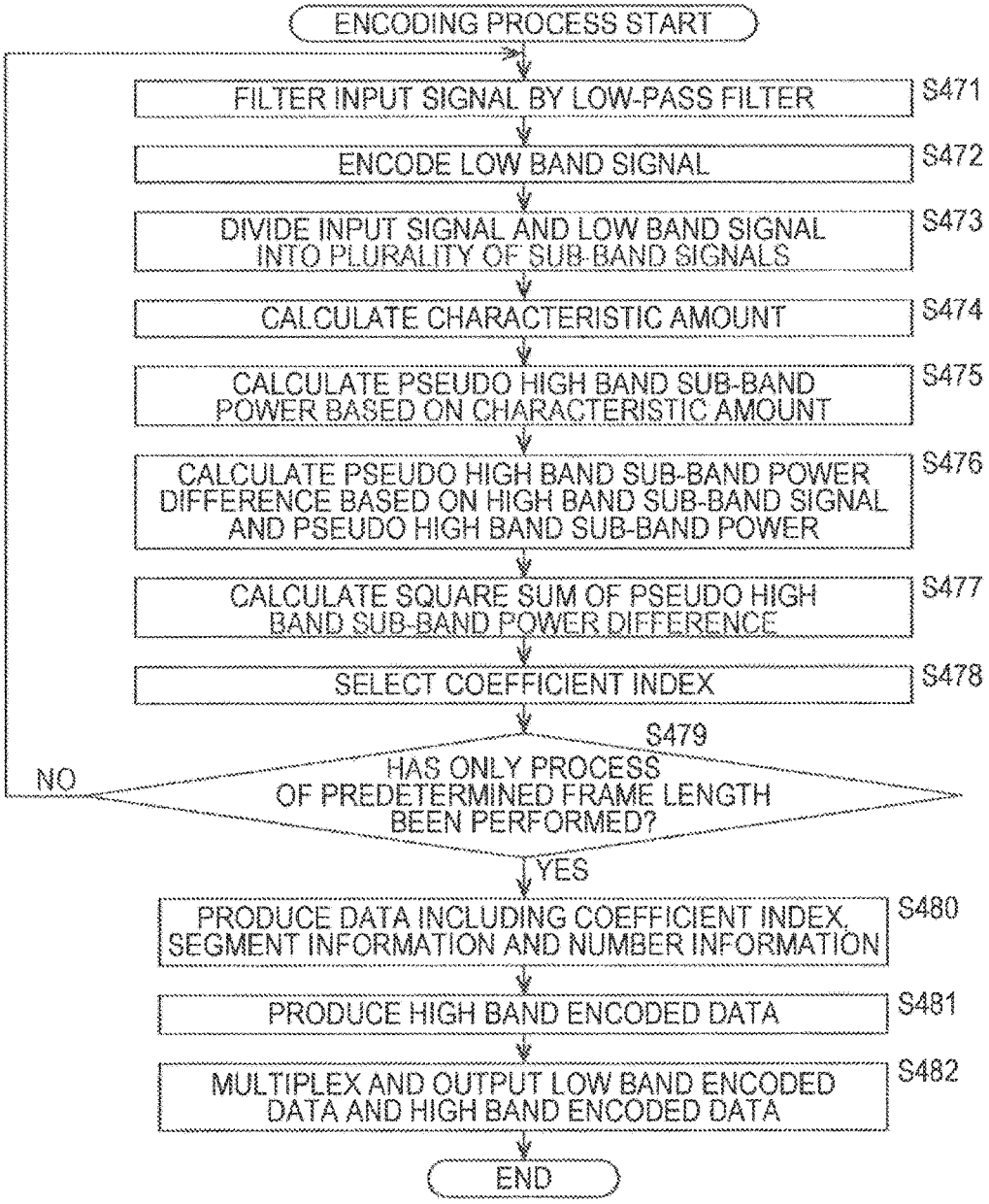
FIG. 34 is a flowchart describing an encoding process.

Referring again to the flowchart in FIG. 34, in step S481, the high band encoding circuit 37 encodes the data including the coefficient index, the segment information and the number information supplied from the production unit 121 and produces the high band encoded data. The high band encoding circuit 37 supplies the produced high band encoded data to the multiplexing circuit 38.

For example, in step S481, an entropy encoding is performed on some or all of the information of the coefficient index, the segment information and the number information. In addition, if the high band encoded data is information from which the optimal decoded high band sub-band power estimation coefficient is obtained, any information is preferable, for example, the data including the coefficient index, the segment information and the number information may be set at the high band encoded data as it is.

In step S482, the multiplexing circuit 38 multiplexes the low band encoded data supplied from the low band encoding circuit 32 and the high band encoded data supplied from the high band encoding circuit 37, and outputs the output code string obtained from the result and then the encoding process is terminated.

Therefore, the decoded high band sub-band power estimation coefficient most suitable for performing the frequency band expansion process can be obtained in the decoder receiving the input of the output code string by outputting the high band encoded data as the output code string together with the low band encoded data. Therefore, it is possible to obtain the signal having better sound quality.

In addition, in the encoder 111, one coefficient index is selected with respect to the consecutive frame segments including one or more frames, and the high band encoded data including the coefficient index thereof is output. For this reason, when the same coefficient index is continuously selected, it is possible to reduce the encoding amount of the output code string and to perform encoding or decoding of sound more efficiently.

[Functional Configuration Example of Decoder]

Figure 35:
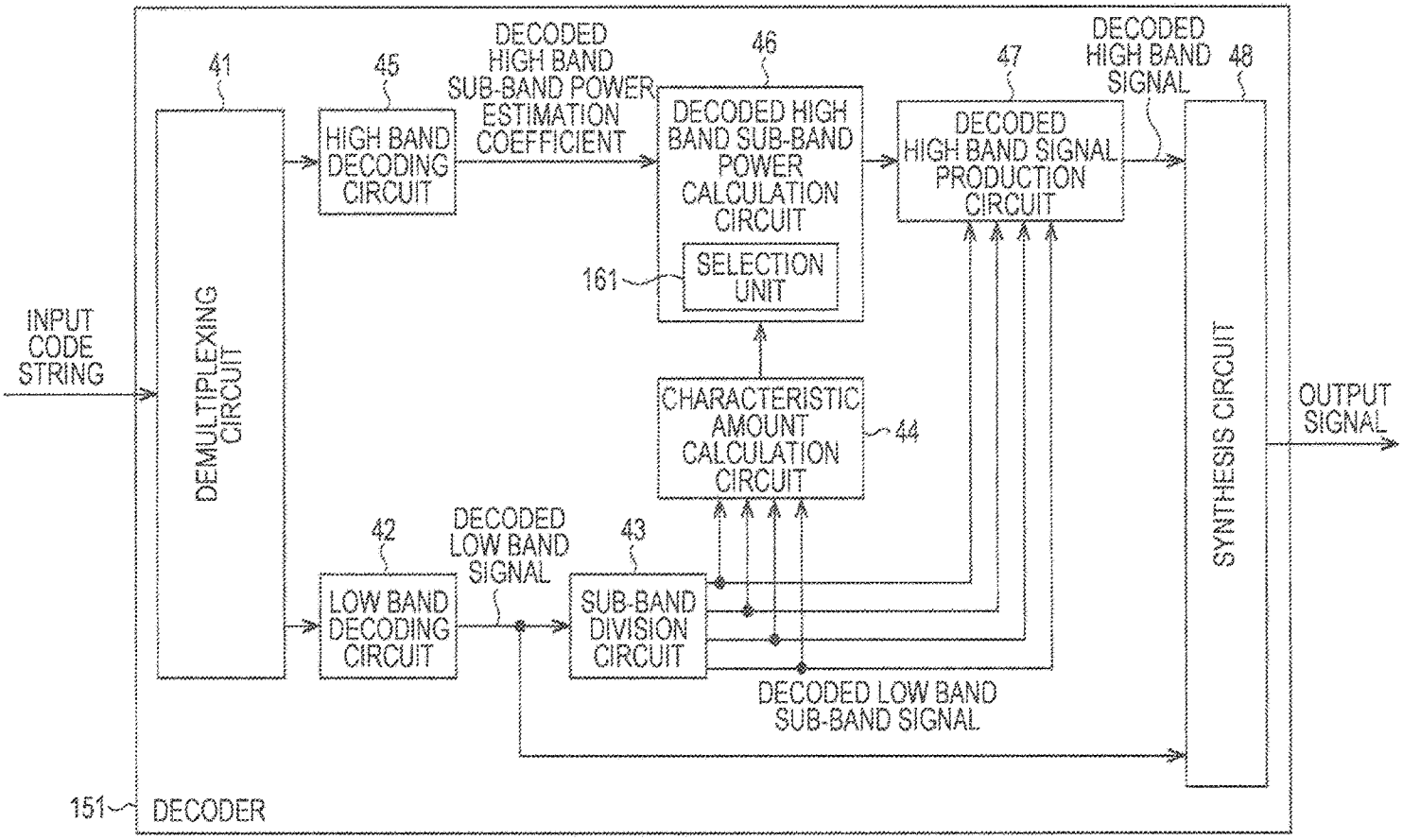
FIG. 35 is a block diagram illustrating a functional configuration example of a decoder.

The decoder that inputs as the output code string output from the encoder 111 in FIG. 33 decodes it, for example, is configured as illustrated in FIG. 35. In addition, in FIG. 35, the same symbol is provided for parts corresponding to the case in FIG. 20. Therefore, the description thereof is appropriately omitted.

The decoder 151 in FIG. 35 is same as the decoder 40 in FIG. 20 in that it includes the demultiplexing circuit 41 to the synthesis circuit 48, but is different from the decoder 40 in FIG. 20 in that the selection unit 161 is disposed in the decoded high band sub-band power calculation circuit 46.

In the decoder 151, when the high band encoded data is decoded by the high band decoding circuit 45, the segment information and the number information obtained from the result, and the decoded high band sub-band power estimation coefficient specified by the coefficient index obtained by decoding of the high band encoded data are supplied to the selection unit 161.

The selection unit 161 selects the decoded high band sub-band power estimation coefficient used in calculating the decoded high band sub-band power based on the segment information and the number information supplied from the high band decoding circuit 45 with respect to the frame to be processed.

[Description of Decoding Process]

Next, a decoding process performed by the decoder 151 in FIG. 35 will be described with reference to a flowchart in FIG. 36.

The decoding process starts when the output code string output from the encoder 111 is supplied as the input code string to the decoder 151, and is performed for each of the predetermined number of frames, that is, the section to be processed. In addition, since the process of step S511 is the same process as that of step S211 in FIG. 21, the description thereof is omitted.

In step S512, the high band decoding circuit 45 performs the decoding of the high band encoded data supplied from the demultiplexing circuit 41 and supplies the decoded high band sub-band power estimation coefficient, the segment information and the number information to the selection unit 161 of the decoded high band sub-band power calculation circuit 46.

That is, the high band decoding circuit 45 reads the decoded high band sub-band power estimation coefficient indicated by the coefficient index obtained by decoding of the high band encoded data among the decoded high band sub-band power estimation coefficient recorded in advance and causes the decoded high band sub-band power estimation coefficient to correspond to the segment information. In addition, the high band decoding circuit 45 supplies the corresponding decoded high band sub-band power estimation coefficient, the segment information and the number information to the selection unit 161.

In step S513, the low band decoding circuit 42 decodes the low band encoded data of the frame to be processed by setting one frame to a frame to be processed in the low band encoded data of each frame of the section to be processed supplied from the demultiplexing circuit 41. For example, each frame of the section to be processed is selected as a frame to be processed from the lead to a tail of the section to be processed in this order and the decoding with respect to the low band encoded data of the frame to be processed is performed.

The low band decoding circuit 42 supplies the decoded low band signal obtained by the decoding of the low band encoded data to the sub-band division circuit 43 and the synthesis circuit 48.

When the low band encoded data is decoded, after that, the processes of step S514 and step S515 are performed and thus the characteristic amount is calculated from the decoded low band sub-band signal. However, since the processes thereof are the same as those of step S213 and step S214 in FIG. 21, the description thereof is omitted.

In step S516, the selection unit 161 selects the decoded high band sub-band power estimation coefficient of the frame to be processed from the decoded high band sub-band power estimation coefficient supplied from the high band decoding circuit 45 based on the segment information and the number information supplied from the high band decoding circuit 45.

For example, in an example in FIG. 32, when the seventh frame from the lead of the section to be processed is set to be processed, the selection unit 161 specifies the consecutive frame segment in which the frame to be processed is included from the number information "num_length=3", the segment information "length0=5" and "length1=7".

In this case, since the consecutive frame segment of the lead in the section to be processed includes 5 frames and a second consecutive frame segment includes 7 frames, it will be understood that seventh frames from the lead of the section to be processed are included in a second consecutive frame segment from the lead of the section to be processed. Therefore, the selection unit 161 selects the decoded high band sub-band power estimation coefficient specified by the coefficient index "5" which corresponds to the segment information of the second consecutive frame segment as the decoded high band sub-band power estimation coefficient of frames to be processed.

When the decoded high band sub-band power estimation coefficient of the frames to be processed is selected, after that, the processes of step S517 to step S519 are performed. However, since the processes thereof are the same as those of step S216 to step S218 in FIG. 21, the description thereof is omitted.

In the processes of step S517 to step S519, the selected decoded high band sub-band power estimation coefficient is used to produce decoded high band signal of the frames to be processed and the produced decoded high band signal and the decoded low band signal are synthesized and output.

In step S520, the decoder 151 determines whether the process of a predetermined frame length is performed. That is, it is determined whether the output signal including the decoded high band signal and the decoded low band signal is produced with respect to the whole frame constituting the section to be processed.

In step S520, when it is determined that the process of a predetermined frames length is not performed, the process returns to step S513 and the processes described above are repeated. That is, the frame that is not still processed in spite of being processing is set as frames to be processed next to produce the output signal of the frames.

In the contrast, in step S520, it is determined that the process of a predetermined frame length is performed, that is, if the output signal is produced with respect to the whole frames in the section to be processed is produced, the decoding processing is terminated.

As described above, according to the decoder 151, since the coefficient index is obtained from the high band encoded data obtained by a demultiplexing of the input code string and thus the decoded high band sub-band power is calculated by using the decoded high band sub-band power estimation coefficient indicated by the coefficient index, it is possible to improve estimation accuracy of the high band sub-band power. Therefore, it is possible to reproduce the sound signal having high quality.

In addition, since one coefficient index with respect to the consecutive frame segment including one or more frames is included in the high band encoded data, it is possible to obtain the output signal having good efficiency from the input code string which has less data amount.

8. Eighth Embodiment

[High Efficiency Encoding of Coefficient Index String>

Next, a case in which an encoding amount of the high band encoded data is reduced by forwarding the index (b) of length (b) described above and the switching flag and improves efficiency of the encoding or decoding of the sound will be described. For example, in this case, as illustrated in FIG. 37, a plurality of frames are set as unit and thus the output code string (bitstream) including the low band encoded data and the high band encoded data is output from the encoder.

Figure 37:
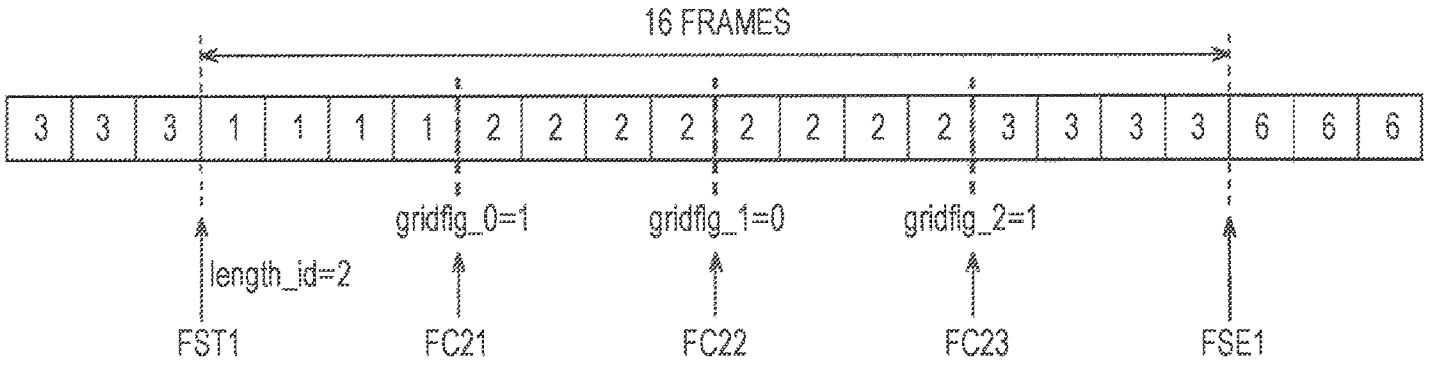
FIG. 37 is a view describing an encoding amount reduction of a coefficient index string.

In addition, in FIG. 37, a lateral direction illustrates time and one rectangle illustrates one frame. In addition, the numerical value in the rectangle illustrating frames indicates the coefficient index specifying the decoded high band sub-band power estimation coefficient of the frames. In addition, in FIG. 37, parts corresponding to a case in FIG. 32 are designated with the same symbol. Therefore, the description thereof is omitted.

In an example in FIG. 37, 16 frames are set as a unit to output the output code string. For example, the segment from the position FST1 to the position FSE1 is set as the section to be processed and thus the output code string of 16 frames included in the section to be processed is output.

Specifically, first, the section to be processed is equally divided into the segments (hereinafter, referred to as a fixed length segment) including a predetermined number of frames. Herein, the coefficient index selected from each frame in the fixed length segment is the same and the length of the fixed length segment is defined such that the length of the fixed length segment is the longest.

In the example in FIG. 37, the length of the fixed length segment (hereinafter, simply, referred to as a fixed length) is set as 4 frames and the section to be processed is equally divided into 4 fixed length segments. That is, the section to be processed is divided into an segment from the position FST1 to position FC21, a segment from the position FC21 to the position FC22, an segment from the position FC22 to the position FC23 and an integral from the position FC23 to the position FSE1. The coefficient index in these fixed length segments is set as the coefficient index "1", "2", "2", "3" in this order from the fixed length segment of the lead of the section to be processed.

Therefore, when the section to be processed is divided into several fixed length segments, the data including a fixed length index indicating a fixed length of the fixed length segment of the section to be processed, a coefficient index and a switching index are produced.

Herein, the switching flag is referred to as information indicating whether the coefficient index is changed at the boundary position of the fixed length segment, that is, a finish frame of a predetermined fixed frame and a leading frame of the next fixed length segment of the fixed length segment. For example, i-th (i=0, 1, 2 . . . ) switching flag gridflg_i is set as "1" when the coefficient index is changed and is set as "0" when the coefficient index is not changed in the boundary position of (i+1)th- and (i+2)th-fixed length segment from the lead of the section to be processed.

In the example in FIG. 37, since the coefficient index "1" of a first fixed length segment and the coefficient index "2" of the second fixed length segment is different from each other, the value of the switching flag (gridflg_0) of the boundary position (the position FC21) of the first fixed length segment of the section to be processed is set as "1". In addition, since the coefficient index "2" of the second fixed length segment and the coefficient index "2" of a third fixed length segment is the same, the value of the switching flag gridflg_1 of the position FC22 is set as "0".

In addition, the value of the fixed length index is set as the value obtained from the fixed length. Specially, for example, the fixed length index (length_id is set as a value satisfying the fixed length fixed length=$16/2^{length_id}$. In an example in FIG. 37, since the fixed length fixed_length=4 is satisfied, the fixed length index length_id=2 is satisfied.

When the section to be processed is divided into the fixed length segment and the data including a fixed length index, a coefficient index and a switching flag is produced, the data is encoded to be set as the high band encoded data.

In the example in FIG. 37, the data including a switching flag in the position FC21 to the position FC23 (gridflg_0=1, gridflg_1=0, and gridflg_2=1, the fixed length index "2" and the coefficient of each fixed length segment "1", "2" and "3" is encoded and thus is set as the high band encoded data.

Herein, the switching flag of the boundary position of each fixed length segment specifies which number of the switching of the boundary position is located in from the lead of the section to be processed. That is, the switching flag may include information for specifying the boundary position of the fixed length segment in the section to be processed.

In addition, each coefficient index included in the high band encoded data is disposed in sequence in which the coefficient thereof is selected, that is, the fixed length segment is disposed side by side in order. For example, in an example of FIG. 37, the coefficient index is disposed in order of "1", "2" and "3" and thus the coefficient index thereof is included in the data.

In addition, in an example in FIG. 37, the coefficient index of a second and third fixed length segment from the lead of the section to be processed is "2", but in the high band encoded data, the coefficient index "2" is set such that only 1 thereof is included. When the coefficient index of the continuous fixed length segment is the same, that is, the switching flag in the boundary position of the continuous fixed length segment is 0, the same coefficient index as many as the number of the fixed length segment is not included in the high band encoded data, but one coefficient index is included in the high band encoded data.

As described above, when the high band encoded data is produced from data including the fixed index, the coefficient index, and the switching flag, it is possible to reduce the data amount of the bitstream to be transmitted because it is not necessary to transmit the coefficient index for receptive frames.

Accordingly, it is possible to perform encoding and decoding more efficiently.

[Functional Configuration Example of Encoders]

Figure 38:
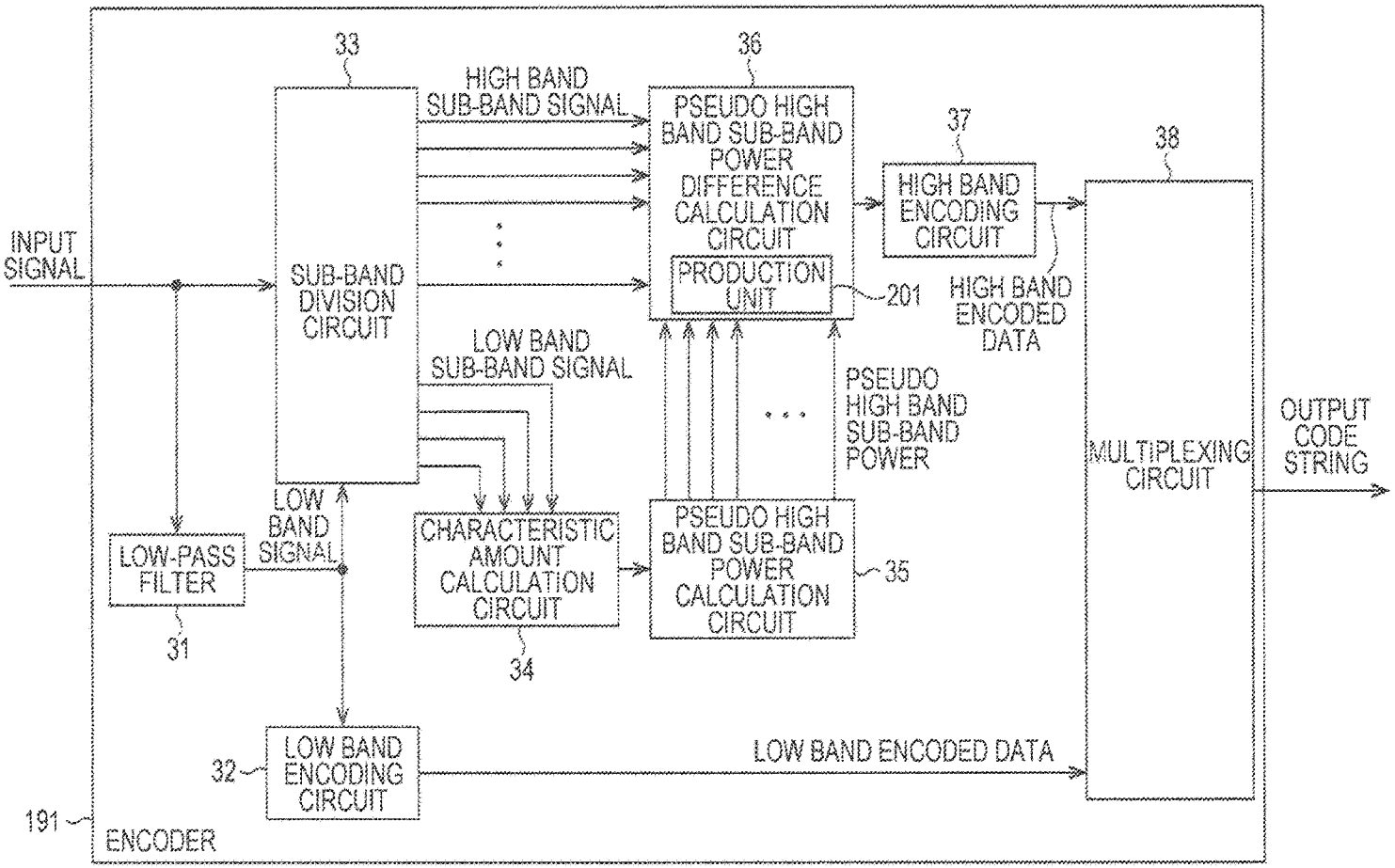
FIG. 38 is a block diagram illustrating a functional configuration example of a decoder.

The high band encoded data including the fixed length index, the coefficient index and the switching flag described above is produced, for example, the encoder is configured as illustrated in FIG. 38. In addition, in FIG. 38, parts corresponding to those in FIG. 18 have the same symbol. Therefore, the description thereof is appropriately omitted.

The encoder 191 in FIG. 38 and the encoder 30 in FIG. 18 have different configurations in that the production unit 201 is disposed in the pseudo high band sub-band power difference calculation circuit 36 of the encoder 191 and other configurations are the same.

The production unit 201 produces data including the fixed length index, the coefficient index and the switching flag based on the selection result of the coefficient index in each frame in the section to be processed and supplies the produced data to the high band encoding circuit 37.

[Description of Encoding Process]

Next, an encoding process performed by the encoder 191 will be described with reference to the flowchart in FIG. 39. The encoding process is performed for each of the predetermined number of the frames, that is, the each section to be processed.

In addition, since the processes of step S551 to step S559 are identical with those of step S471 to step S479 in FIG. 34, the description thereof is omitted. In the processes of step S551 to step S559, each frame constituting the section to be processed is set as the frame to be processed in order and the coefficient index is selected with respect to the frame to be processed.

In step S559, when it is determined that only a process of a predetermined frame length is performed, the process proceeds to step S560.

In step S560, the production unit 201 produces data including the fixed length index, the coefficient index and the switching flag based on the selection result of the coefficient index of each frame to be processed and supplies the produced data to the high band encoding circuit 37.

For example, in the example in FIG. 37, the production unit 201 sets the fixed length as four frames to divide the section to be processed from the position FST1 to the position FSE1 into 4 fixed length segments. In addition, the production unit 201 produce data including the fixed length index "2", the coefficient index "1", "2" and "3" and the switching flag "1", "0", and "1".

In addition, in FIG. 37, the coefficient indices of the second and the third fixed length segment from the lead of the section to be processed are "2" equally. However, since the fixed length segments are continuously disposed, only one of the coefficient indices "2" is included in data output from the production unit 201.

Figure 39:
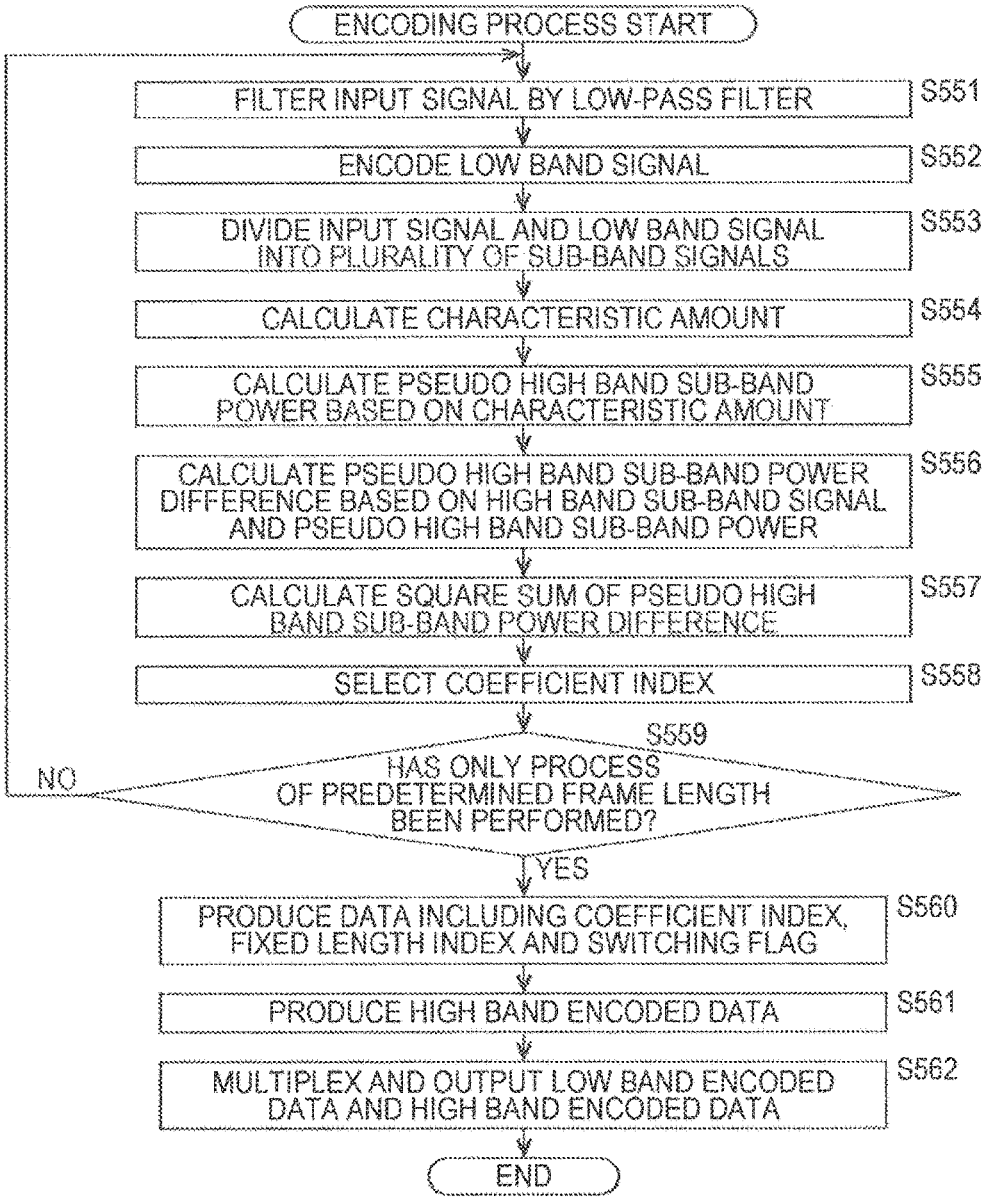
FIG. 39 is a flowchart describing an encoding process.

Referring again to the description of the flowchart in FIG. 39, in step S561, the high band encoding circuit 37 encodes data including the coefficient index, and the switching flag supplied from the production unit 201 and produces the high band encoded data. The high band encoding circuit 37 supplies the produced high band encoded data to the multiplexing circuit 38. For example, the entropy encoding is performed as needed with respect to the some or all of the information fixed length index, the coefficient index and the switching flag.

When the process of step S561 is performed, after that, the process of step S562 is performed to terminate the encoding process. Since the process of step S562 has the same process as in step S482 in FIG. 34. Therefore, the description is omitted.

Therefore, the decoded high band sub-band power estimation coefficient most suitable for performing the frequency band expansion process can be obtained in the decoder receiving the input of the output code string by outputting the high band encoded data as the output code string together with the low band encoded data. Therefore, it is possible to obtain the signal having a good quality.

In addition, in the encoder 191, one coefficient index is selected with respect to one or more fixed length segments and the high band encoded data including the coefficient index is output. Therefore, in particular, when the same coefficient index is continuously selected, it is possible to reduce the encoding amount of the output code string and to perform the encoding or decoding sound more efficiently.

[Functional Configuration Example of Decoder]

Figure 40:
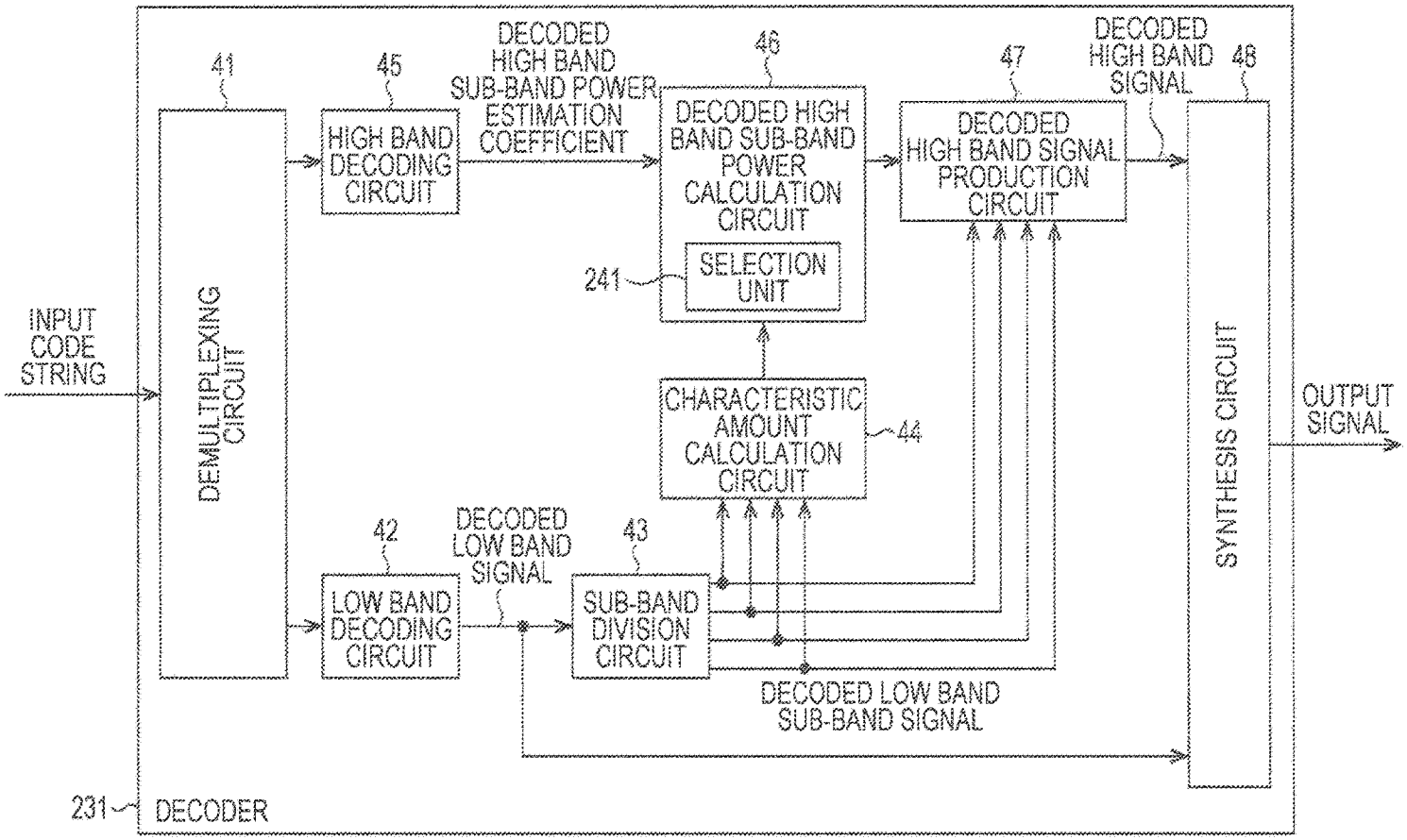
FIG. 40 is a block diagram illustrating a functional configuration example of a decoder.

In addition, the output code string output from the encoder 191 in FIG. 38 is input as the input code string and the decoder, which performs decoding, for example, is configured as in FIG. 40. The same symbol is used in FIG. 40 for parts corresponding to the case in FIG. 20 and the description is adequately omitted.

The decoder 231 in FIG. 40 is identical with the decoder 40 in FIG. 20 in that it includes the demultiplexing circuit 41 to the synthesis circuit 48, but is different from the decoder 40 in FIG. 20 in that the selection unit 241 is disposed in the decoded high band sub-band power calculation circuit 46.

In the decoder 231, when the high band encoded data is decoded by the high band decoding circuit 45, the fixed length index and the switch flag obtained from the result, and decoded high band sub-band power estimation coefficient specified by the coefficient index obtained by decoding the high band encoded data are supplied to the selection unit 241.

The selection unit 241 selects the decoded high band sub-band power estimation coefficient used in calculating the decoded high band sub-band power with respect to the frames to be processed based on the fixed length index and the switching flag supplied from the high band decoding circuit 45.

[Description of Decoding Process]

Next, a decoding process performed by the decoder 231 in FIG. 40 will be described with reference to the flowchart in FIG. 41.

The decoding process starts when the output code string output from the encoder 191 is supplied to the decoder 231 as the input code string and is performed for each the predetermined number of the frames, that is, the section to be processed. In addition, since the process of step S591 is identical with that of step S511 in FIG. 36, the description thereof is omitted.

In step S592, the high band decoding circuit 45 performs the decoding of the high band encoded data supplied from the demultiplexing circuit 41, supplies the decoded high band sub-band power estimation coefficient the fixed index and the switching flag to the selection unit 241 of the decoded high band sub-band power calculation circuit 46.

That is, the high band decoding circuit 45 reads the decoded high band sub-band power estimation coefficient indicated by the coefficient index obtained by the decoding of the high band encoded data in the decoded high band sub-band power estimation coefficient recorded in advance. In this case, the decoded high band sub-band power estimation coefficient is arranged in the same sequence as the sequence in which the coefficient index is arranged. In addition, high band decoding circuit 45 supplies the decoded high band sub-band power estimation coefficient, the fixed length index and the switching flag to the selection unit 241.

When the high band encoded data is decoded, after that, the process of step S593 to step S595 is performed. However, since the processes are the same as step S513 to step S515 in FIG. 36, the description thereof is omitted.

In step S596, the selection unit 241 selects the decoded high band sub-band power estimation coefficient of the frame to be processed from the decoded high band sub-band power estimation coefficient supplied from the high band decoding circuit 45 based on the fixed length index and the switching flag supplied from the high band decoding circuit 45.

For example, in an example in FIG. 37, when the fifth frame from the lead of the section to be processed is set to be processed, the selection unit 241 specifies which fixed length segment the frame to be processed from the lead in the section to be processed includes from the fixed length index 2. In this case, since the fixed length is "4", the fifth frame is specified as being included in the second fixed length segment.

Next, the selection unit 241 specifies that a second decoded high band sub-band power estimation coefficient from the lead is a decoded high band sub-band power estimation coefficient of the frame to be processed in the decoded high band sub-band power estimation coefficient provided in a sequence from the switching flag (gridflg_0=1) of the position FC21. That is, since the switching flag is "1", and thus coefficient index is changed before and after the position FC21, the second decoded high band sub-band power estimation coefficient from the lead is specified as the decoded high band sub-band power estimation coefficient of the frame to be processed. In this case, the decoded high band sub-band power estimation coefficient specified by the coefficient index "2" is selected.

In addition, in the example of FIG. 37, when the ninth frame from the lead of the section to be processed is set to be processed, the selection unit 241 specifies which fixed length segment from the lead in the section to be processed includes the frame to be processed from the fixed length index "2". In this case, since the fixed length is "4", ninth frame is specified as being included in the third fixed length segment.

Next, the selection unit 241 specifies that the second decoded high band sub-band power estimation coefficient from the lead is the decoded high band sub-band power estimation coefficient of frame to be processed in the decoded high band sub-band power estimation coefficient provided in a sequence from the switching flag gridflg_1=0 of the position FC22. That is, since the switching flag is "0" and thus what is not changed in the index before and after the position FC22 is specified, the second decoded high band sub-band power estimation coefficient from the lead is specified as the decoded high band sub-band power estimation coefficient of the frames to be processed. In this case, the decoded high band sub-band power estimation coefficient specified by the coefficient index "2" is selected.

When the decoded high band sub-band power estimation coefficient of the frames to be processed is selected, the processes of step S597 to step S600 are performed to complete the decoding processing. However, since the processes are identical with those of step S517 to step S520 in FIG. 36, the description thereof is omitted.

In the processes of step S597 to step S600, the selected decoded high band sub-band power estimation coefficient is used to produce the decoded high band signal of the frame to be processed, the produced decoded high band signal and the decoded low band signal are synthesized and is output.

As described above, according to decoder 231, since the coefficient index is obtained from the high band encoded data obtained by demultiplexing of the input code string and thus the decoded high band sub-band power estimation coefficient indicated by the coefficient index is used to produce the decoded high band sub-band power and thus, it is possible to improve estimation accuracy of the high band sub-band power. Therefore, it is possible to reproduce a music signal having better sound quality.

Further, since one coefficient index is included in the high band encoded data with respect to one or more fixed length segment, it is possible to obtain the output signal from the input code string of the lesser data amount more efficiently.

9. Ninth Embodiment

[Functional Configuration Example of Encoder]

In addition, as described above, a method (hereinafter, referred to as a variable length method) of producing data including a coefficient index, an segment information and a number information is produced as data for obtaining the high band component of sound and a method of producing data including the fixed length index, the coefficient index and the switching flag (hereinafter, referred to as a fixed length method) was described.

The method thereof can also reduce the encoding amount of the high band encoded data similarly. However, it is possible to further reduce the encoding amount of the high band encoded data by selecting less encoding amount among the these methods for each of the processing sections.

Figure 42:
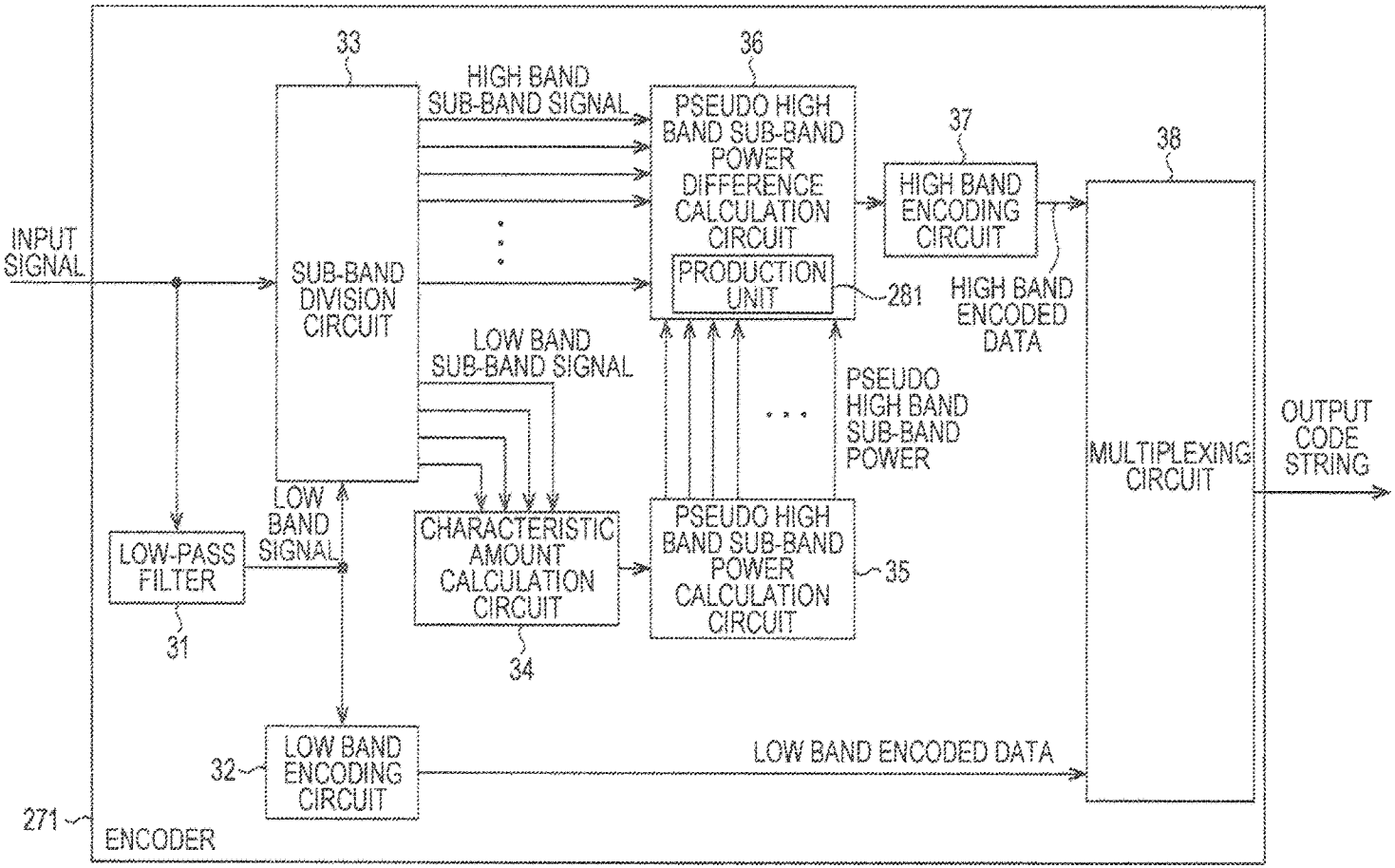
FIG. 42 is a block diagram illustrating a functional configuration example of an encoder.

In this case, the encoder is configured as illustrated in FIG. 42. In addition, in FIG. 42, the same symbol is used for parts corresponding to a case in FIG. 18. Therefore, the description is suitably omitted.

The encoder 271 in FIG. 42 and the encoder 30 in FIG. 18 are different from each other in that the production unit 281 is disposed in the pseudo high band sub-band power difference calculation circuit 36 of the encoder 271 and the remainder of configuration has the same configuration.

The production unit 281 produces data for obtaining the high band encoded data by a method selected in which the switching of the variable length method or the fixed length method is performed based on the selection result of the coefficient index in each frame in the section to be processed, and supplies the data to the high band encoding circuit 37.

[Description of Encoding Process]

Figure 43:
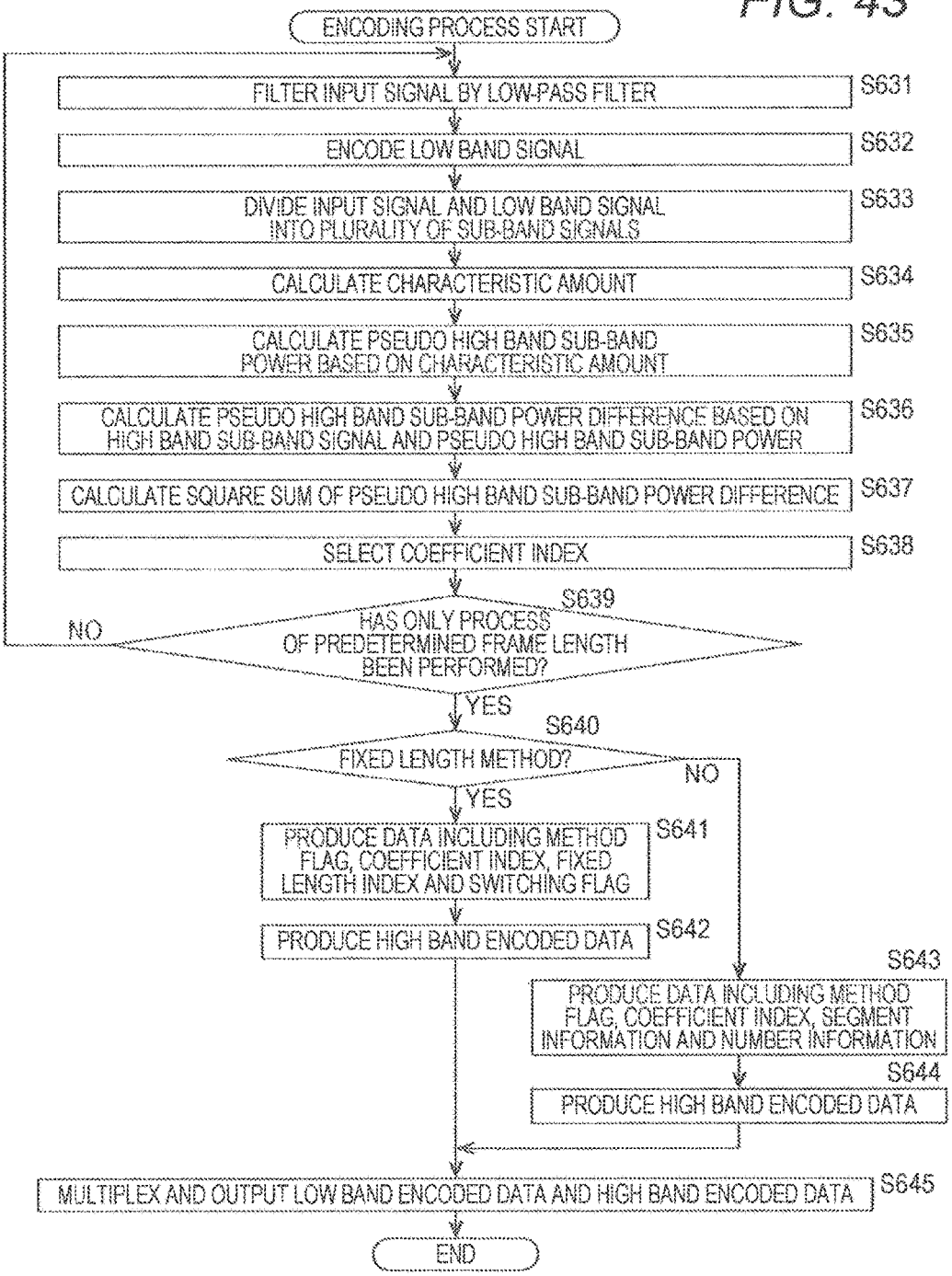
FIG. 43 is a flowchart describing an encoding process.

Next, an encoding process performed by the encoder 271 will be described with reference to the flowchart in FIG. 43. The encoding process is performed for each of the predetermined number of the frames, that is, the section to be processed.

In addition, the processes of step S631 to step S639 are identical with those of step S471 to step S479 in FIG. 34, therefore, the description thereof is omitted. In the processes of step S631 to step S639, each frame constituting the section to be processed is set as frames to be processed in a sequence and the coefficient index is selected with respect to frames to be processed.

In step S639, when it is determined that only the process of a predetermined frame length is performed, the process proceeds to step S640.

In step S640, the production unit 281 determines whether the method, which produces the high band encoded data, is set as the fixed length method.

That is, the production unit 281 compares the encoding amount of the high band encoded data at the time of being produced by the fixed length method with the encoding amount at the time of being produced by the variable length method. In addition, the production unit 281 determines that the fixed length method is set when the encoding amount of the high band encoded data of the fixed length method is less than the encoding amount of the high band encoded data of the variable length method.

In step S640, when it is determined that the fixed length method is set, the process proceeds to step S641. In step S641, the production unit 281 produces data including a method flag to the effect the fixed length method is selected, a fixed length index, a coefficient index and a switching flag and supplies it to the high band encoding circuit 37.

In step S642, the high band encoding circuit 37 encodes data including a method flag, a fixed length index, a coefficient index and the switching flag supplied from the production unit 281 and produces the high band encoded data. The high band encoding circuit 37 supplies the produced high band encoded data to the multiplexing circuit 38 and then the process proceeds to the step S645.

Unlike this, in step S640, when it is determined that the fixed length method is not set, that is, it is determined that the variable length method is set, the process proceeds to step S643. In step S643, the production unit 281 produces data including a method flag to the effect that the variable length method is selected, a coefficient index, segment information, and number information, and supplies the produced data to the high band encoding circuit 37.

In step S644, the high band encoding circuit 37 encodes data including a method flag, a coefficient index, an segment information and number information supplied from the production unit 281 and produces the high band encoded data. The high band encoding circuit 37 supplies the produced high band encoded data to the multiplexing circuit 38 and then the process proceeds to step S645.

In step S642 or step S644, when the high band encoded data is produced, and then the process of step S645 is performed to complete the encoding process. However, since the processes are identical with those of step S482 in FIG. 34, the description thereof is omitted.

As described above, it is possible to reduce the encoding amount of the output code string and to perform encoding or decoding of sound more efficiently by producing the high-band encoded data by selecting the system in which an encoding amount for each section to be processed is less, between a fixed length system and a variable length system.

[Functional Configuration Example of Decoder]

Figure 44:
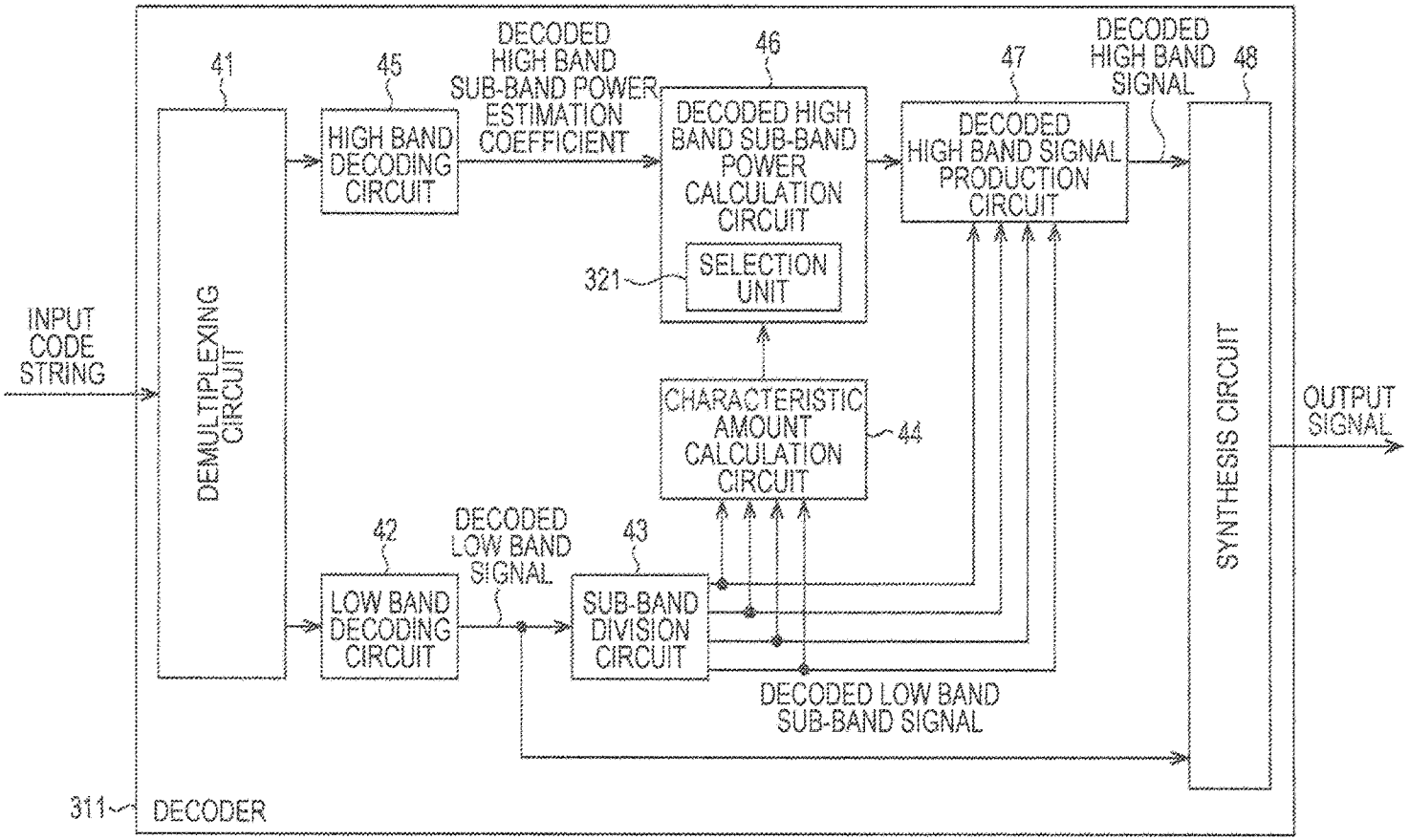
FIG. 44 is a block diagram illustrating a functional configuration example of a decoder.

In addition, the decoder that inputs and decodes the output code string output from the encoder 271 in FIG. 42 as the input code string, for example, is configured as in FIG. 44. In addition, in FIG. 44, the same symbols are used for parts corresponding to a case in FIG. 20. Therefore, the description thereof is omitted.

The decoder 311 in FIG. 44 is the same as the decoder 40 in FIG. 20 in that it includes the demultiplexing circuit 41 to the synthesis circuit 48, but is different from the decoder 40 in FIG. 20 in that the selection unit 321 is disposed in the decoded high band sub-band power calculation circuit 46.

In the decoder 311, when the high band encoded data is decoded by the high band decoding circuit 45, the data obtained from the result and the decoded high band sub-band power estimation coefficient specified by the coefficient index obtained by decoding of the high band encoded data are supplied to the selection unit 321.

The selection unit 321 specifies whether the high band encoded data of the section to be processed is produced by which method of the fixed length method or the variable length based on data supplied from the high band decoding circuit 45. In addition, the selection unit 321 selects the decoding high band sub-band power estimation coefficient used in calculating the decoded high band sub-band power with respect to the frames to be processed based on the specified result of the method producing the high band encoded data and data supplied from the high band decoding circuit 45.

[Description of Decoding Process]

Figure 45:
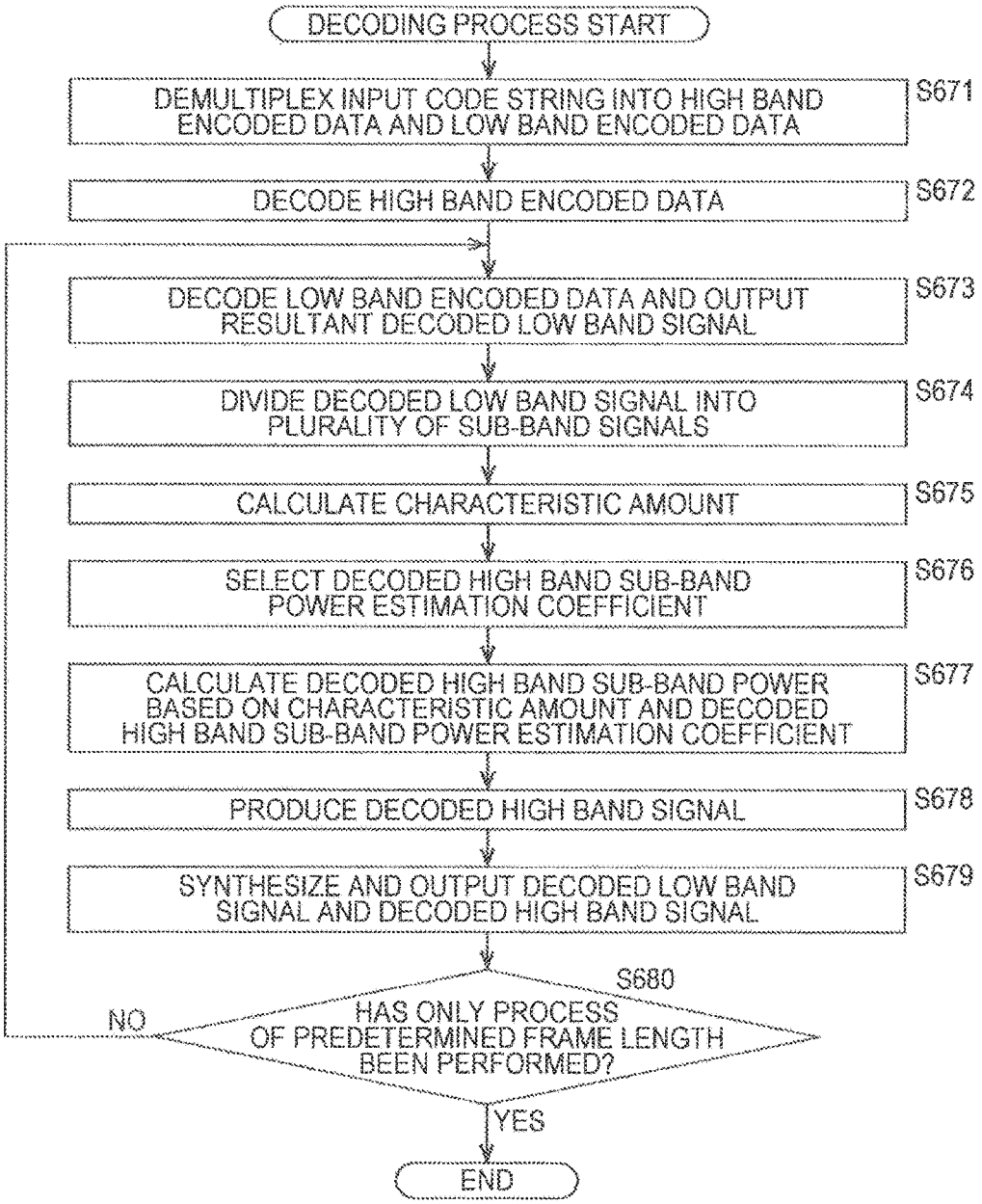
FIG. 45 is a flowchart describing a decoding process.

Next, a decoding process performing by the decoder 311 in FIG. 44 will be described with reference to the flowchart in FIG. 45.

The decoding processing starts when the output code string output from the encoder 271 is supplied to the decoder 311 as the input code string and is performed for each of the predetermined number of the frames, that is, the section to be processed. In addition, since the process of step S671 is identical with that of step S591 in FIG. 41, the description is omitted.

In a step S672, the high band decoding circuit 45 performs the decoding of the high band encoded data supplied from the demultiplexing circuit 41 and supplies data obtained from the result and the decoded high band sub-band power estimation coefficient to the selection unit 321 of the decoded high band sub-band power calculation circuit 46.

That is, the high band decoding circuit 45 reads the decoded high band sub-band power estimation coefficient indicated by the coefficient index obtained by the decoding of the high band encoded data among the decoded high band sub-band power estimation coefficients recorded in advance. In addition, the high band decoding circuit 45 supplies the decoded high band sub-band power estimation coefficient and data obtained by the decoding of the high band encoded data to the selection unit 321.

In this case, when the fixed length system by the system flag is indicated, a decoded high band sub-band power estimation coefficient, a method flag, a fixed length index and the switch flag are supplied to the selection unit 321. In addition, when the method flag indicates the variable length method, the decoded high band sub-band power estimation coefficient, the method flag, the segment information and the number information is supplied to the selection unit 321.

After the high band encoded data is decoded, the processes of step S673 to step S675 are performed. However, the processes are the same as step S593 to step S595 in FIG. 41, the description thereof is omitted.

In step S676, the selection unit 321 selects the decoded high band sub-band power estimation coefficient of the frame to be processed from the decoding high band sub-band power estimation coefficient supplied from the high band decoding circuit 45 based on data supplied from the high band decoding circuit 45.

Figure 41:
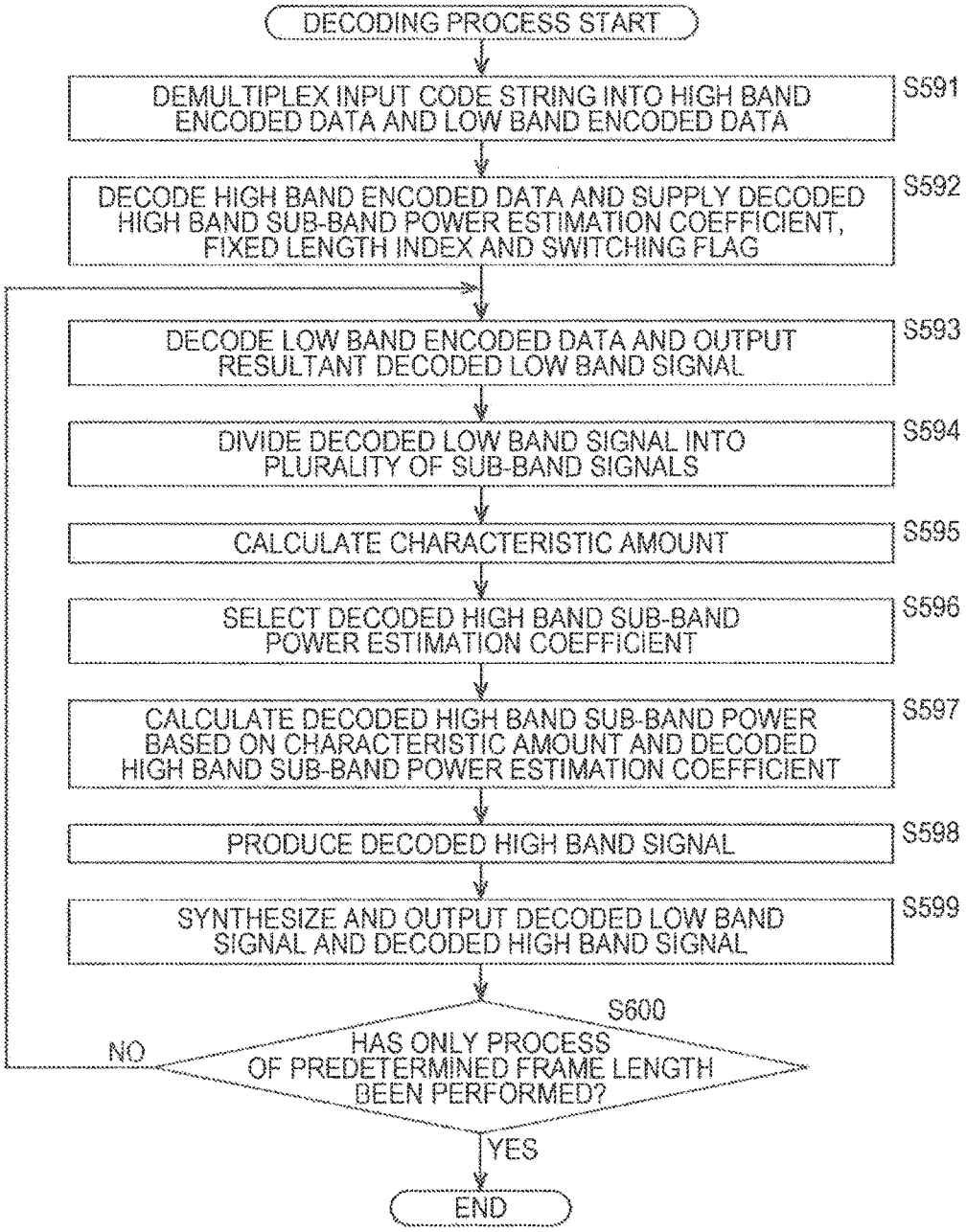
FIG. 41 is a flowchart describing a decoding process.

For example, when the method flag supplied from the high band decoding circuit 45 indicates the fixed length method, the same process as step S596 in FIG. 41 is performed and the decoded high band sub-band power estimation coefficient is selected from the fixed length index and the switching flag. Unlike this, when the variable length method is indicated by the method flag supplied from the high band decoding circuit 45, the same process as in step S516 in FIG. 36 is performed, the decoded high band sub-band power estimation coefficient is selected from the segment information and the number information.

When the decoding high frequency sub-band power estimation coefficient of the frames to be processed is selected, after that, the processes of step S677 to S680 are performed, the decoding processes are completed. However, since the processed is identical with those of step S597 to step S600 in FIG. 41, the description thereof is omitted.

The decoded high band sub-band power estimation coefficient selected is used and thus the decoded high band signal of the frames to be processed is produced in the processes of step S677 to step S680 and the produced decoded high band signal and decoded low band signal is synthesized and output.

As described, the high band encoded data is produced by the method where the encoding amount is less than the fixed length method and the variable length method. Since one coefficient index with respect to one or more frames is included in the high band encoded data, it is possible to obtain the output signal having good efficiency from the input code string with less data amount.

10. Tenth Embodiment

[High Performance Encoding of Coefficient Indexing String]

Now, in the coding method of encoding sound, information for decoding data of predetermined frames is recycled as information for decoding data of frame later the frame. In this case, a mode where the recycling of information in time direction is performed and mode where recycling is inhibited are selected.

Herein, information reused in time direction is set as the index and the like. Specially, for example, a plurality of frames are set as unit and thus the output code string including the low band encoded data and the high band encoded data is output from the encoder as illustrating in FIG. 46.

Figure 46:
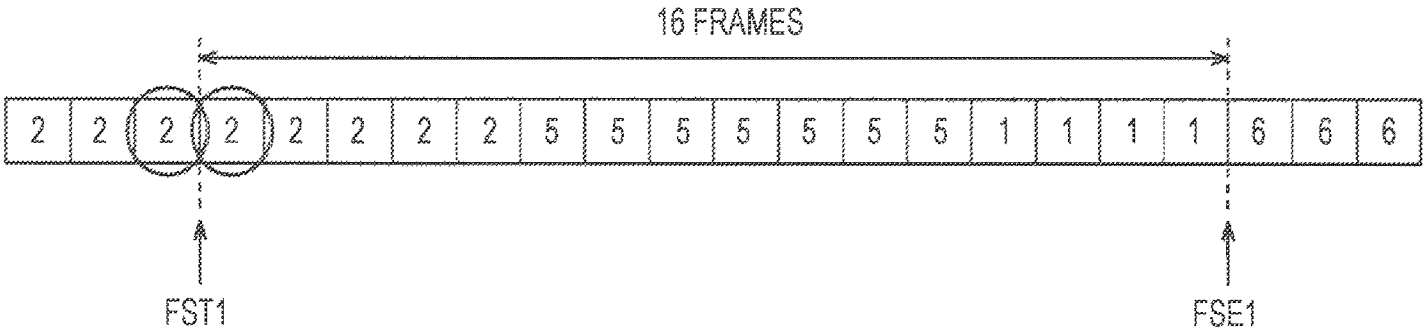
FIG. 46 is a diagram describing recycling of a coefficient index.

In addition, in FIG. 46, a lateral direction shows time and one rectangle shows one frame. In addition, a numeral in the rectangle showing the frame indicates the coefficient index specifying the decoded high band sub-band power estimation coefficient of the frame. In addition, in FIG. 46, the same symbols are used for parts corresponding to a case in FIG. 32. The description thereof is omitted.

An example in FIG. 46, 16 frames are set as a unit to output the output code string. For example, an segment from a position FST1 to a position FSE1 is set as an section to be processed and thus the output code string of 16 frames included in the section to be processed is output.

In this case, in the mode where the recycling of information is performed, when the coefficient index of the leading frame of the section to be processed is identical with that of one previous frame, the recycling flag "1" to the effect that the coefficient index is recycled is included in the high band encoded data. In an example in FIG. 46, since coefficient index of leading frame of the section to be processed and that of the previous frame are both "2", the recycling flag is set as "1".

When the recycling flag is set as "1", since the coefficient index of a last frame of a previous section to be processed is recycled, the coefficient index of an initial frame of the section to be processed is not included in the high band encoded data of the section to be processed.

Unlike this, when the coefficient index of the leading frame of the section to be processed is different from that of a frame before one of the frames, the recycling flag "0" to the effect that the coefficient index is not recycled is included in the high band encoded data. In this case, since the reuse of the coefficient index is not possible, the coefficient index of the initial frame to be processed is included in the high band encoded data.

In addition, in the mode where the information recycling is inhibited, the recycling flag is not included in the high band encoded data. When the recycling flag is used, it is possible to reduce the encoding amount of output code string and to perform encoding or decoding of sound more efficiently.

In addition, information recycled by the recycling flag may be any information without the coefficient index is limited.

[Description of Decoding Processing]

Next, encoding and decoding processes performed in a case where the reuse flag is used will be described. First, a case where the high band encoded data is produced by the variable length method will be described. In this case, the encoding process and the decoding process are performed by the encoder 111 in FIG. 33 and the decoder 151 in FIG. 35.

An encoding processing by the encoder 111 will be described with reference to the flowchart in FIG. 47. This encoding process is performed for each of the predetermined number of the frames, that is, the section to be processed.

Since the processes of step S711 to step S719 are identical with those of step S471 to step S479 in FIG. 34, the description thereof is omitted. In the processes of step S711 to step S719, each frame constituting the section to be processed is set as the frame to be processed in a sequence and the coefficient index is selected with respect to the frame to be processed.

In step S719, when only process of a predetermined frame length is determined, the process proceeds to step S720.

In step S720, the production unit 121 determines whether the recycling of information is performed. For example, when the mode where the recycling of information is performed by a user is assigned, it is determined that the recycling of information is performed.

In step S720, when it is determined that the recycling of information is performed, the process proceeds to S721.

In step S721, the production unit 121 produces data including the recycling flag, the coefficient index as segment information and the number information based on the selection result of the coefficient index of each frame in the section to be processed and supplies the produced data to the high band encoding circuit 37.

For example, in an example in FIG. 32, since the coefficient index of the leading frame of the section to be processed is "2", whereas the coefficient index of the frame just before the frame is "3" and the recycling flag is set as "0" without the recycling of the coefficient index.

The production unit 121 produces data including the recycling flag "0" and the number information "num_length=3" and, the segment information of each consecutive frame segment "length0=5", "length1=7", and "length2=4", and the coefficient index of the consecutive frame segment thereof "2", "5" and "1".

In addition, when recycling flag is set as "1", data where is not included in the coefficient index of the initial consecutive frame of the section to be processed is produced. For example, in the example in FIG. 32, when the recycling flag of the section to be processed is set as "1", data including the reuse flag and the number information, the segment information "length0=5", "length1=7" and "length2=4", and the coefficient index "5", and "1".

In step S722, the high band encoding circuit 37 encodes data including the recycling flag, the coefficient index, the segment information, the coefficient information and the number information provided from the production unit 121 and produces the high band encoded data. The high band encoding circuit 37 supplies the produced high band encoded data to the multiplexing circuit 38 and then the process proceeds to step S725.

Unlike this, in step S720, when it is determined that the recycling of information is not performed, that is, when the mode where the recycling of information is inhibited by a user is assigned, the process proceeds to step S723.

In step S723, the production unit 121 produces data including the coefficient index, the segment information, and the number information based on the selection result of the coefficient index of each frame in the section to be processed and supplies them to the high band encoding circuit 37. The process of step S723 identical with that of step S480 in FIG. 34 is performed.

In step S724, the high band encoding circuit 37 encodes data including the coefficient index, the segment information and the number information supplied from the production unit 121 and produces the high band encoded data. The high band encoding circuit 37 supplies the produced high band encoded data to the multiplexing circuit 38 and then the process proceeds to step S725.

In step S722 or step S724, after the high band encoded data is produced, the process of step S725 is performed to terminate the encoding process. However, since the process is identical with that of step S482 in FIG. 34, the description thereof is omitted.

As described above, when the mode where the reuse of information is performed is assigned, it is possible to reduce the encoding amount of the output code string by producing the high band encoded data including the reuse flag and to perform encoding or decoding of sound more efficiently.

[Description of Decoding Processing]

Figure 48:
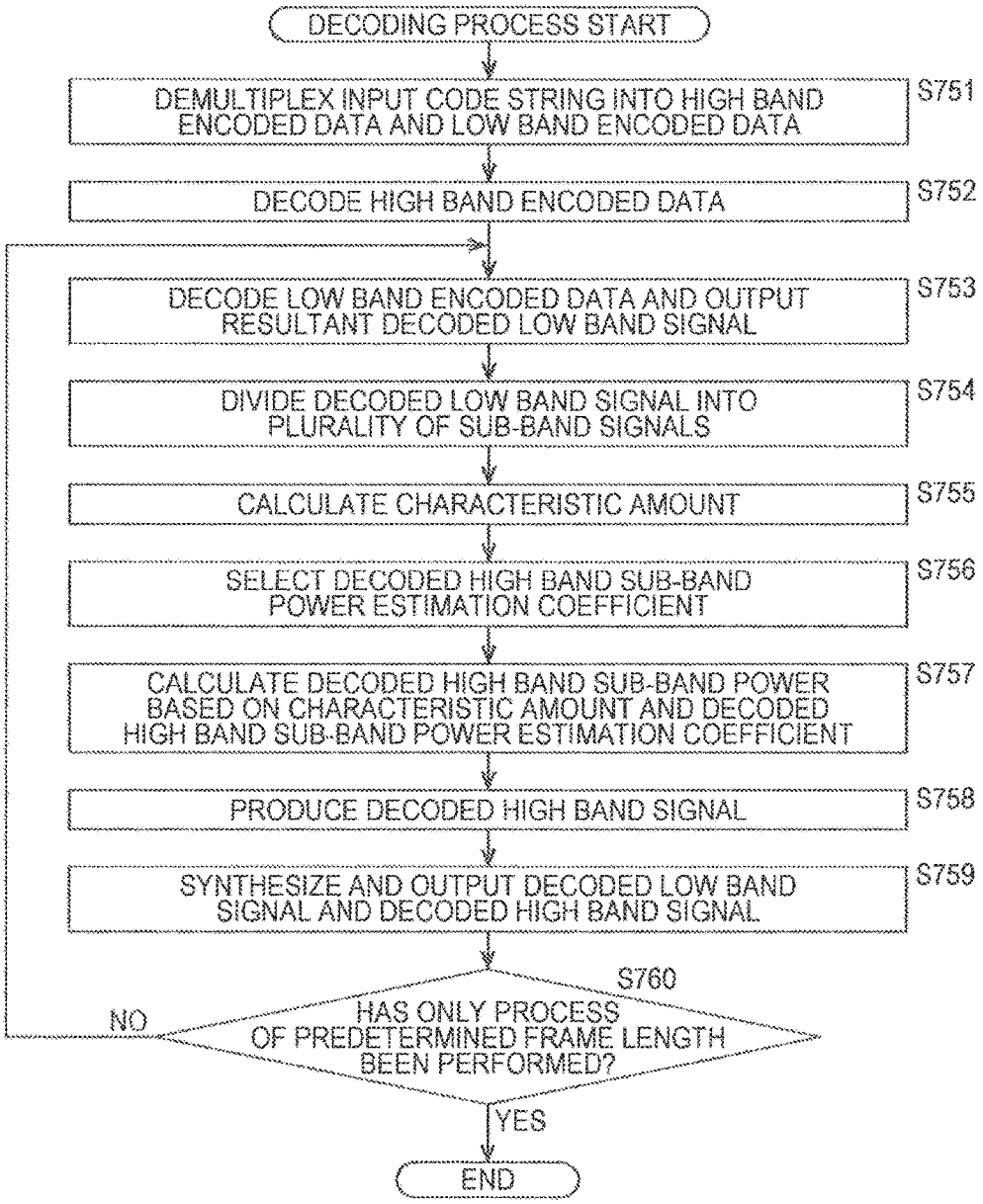
FIG. 48 is a flowchart describing a decoding process.

Next, a decoding process performed by the decoder 151 in FIG. 35 will be described with reference to a flowchart in FIG. 48.

Figure 47:
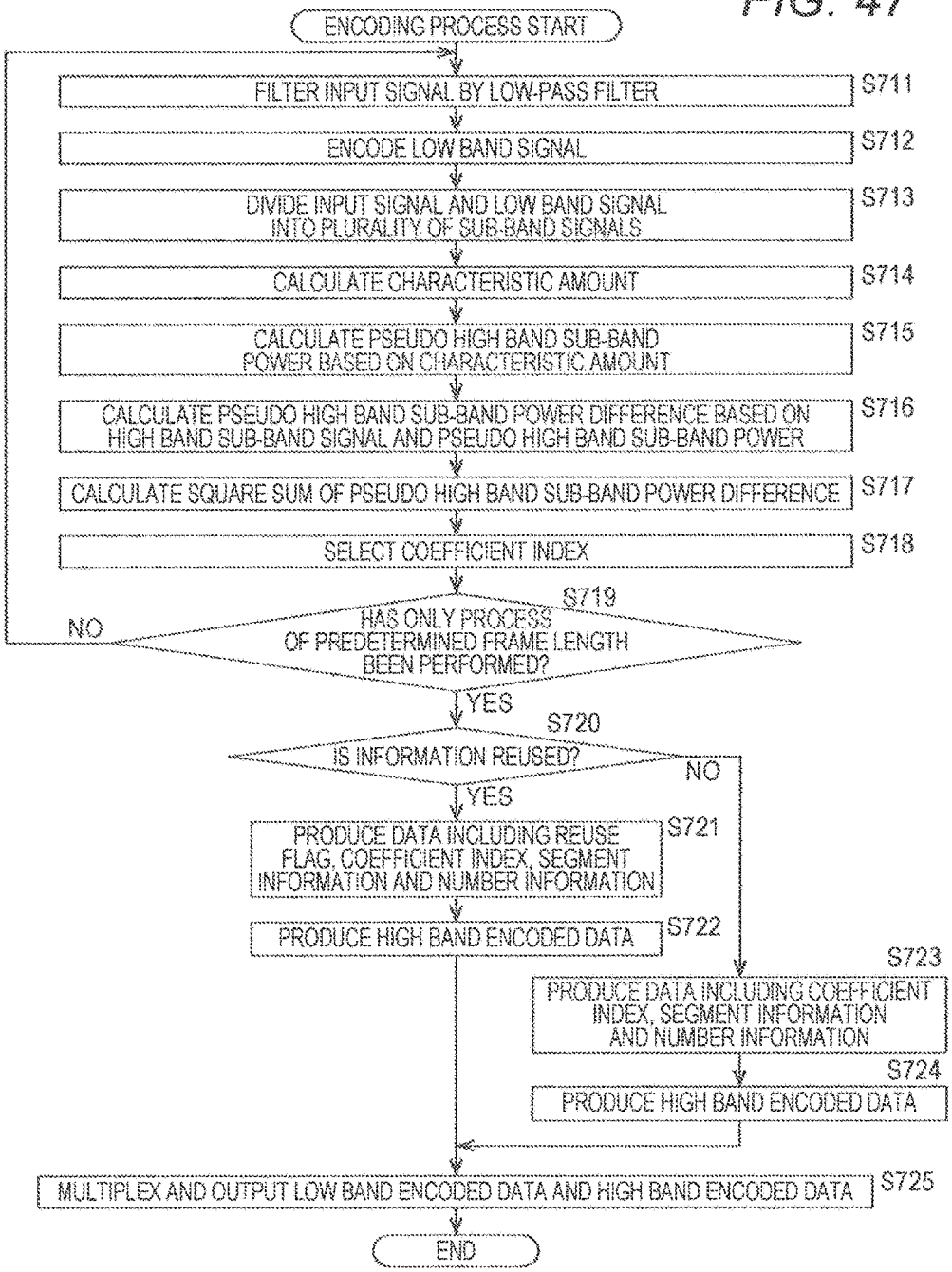
FIG. 47 is a flowchart describing an encoding process.

The decoding process starts when the encoding process described with reference to FIG. 47 is performed and the output code string output from the encoder 111 is supplied to the decoder 151 as the input code string, and is performed for each of a predetermined frame number, that is, the section to be processed. In addition, the process of the step S751 is identical with that of step S511 in FIG. 36, the description thereof is omitted.

In step S752, the high band decoding circuit 45 performs decoding of the high band encoded data supplied from the demultiplexing circuit 41 and supplies the data obtained from the result and the decoded high band sub-band power estimation coefficient to the selection unit 161 of the decoded high band sub-band power calculation circuit 46.

That is, the high band decoding circuit 45 reads the decoded high band sub-band power estimation coefficient indicated with the coefficient index obtained by decoding of the high-band encoded data in the decoded high band sub-band power estimation coefficient recorded in advance. In addition, the high band decoding circuit 45 supplies the decoded high band sub-band power estimation coefficient and data obtained by the decoding of the high band encoded data to the selection unit 161.

In this case, when the mode where the recycling of information is performed is assigned, the decoded high band sub-band power estimation coefficient, the recycling flag, the segment information and the number information are supplied to the selection unit 161. In addition, when the mode where the recycling of information is inhibited is assigned, the decoded high band sub-band power estimation coefficient, the segment information and the number information are supplied to the selection unit 161.

When the high band encoded data is decoded, after that, the processes of step S753 to step S755 are performed. However, since the processes are identical with those of step S513 to step S515 in FIG. 36, the description thereof is omitted.

In step S756, the selection unit 161 selects the decoded high band sub-band power estimation coefficient of the frames to be processed from the decoded high band sub-band power estimation coefficient supplied from the high band decoding circuit 45 based on data supplied from the high band decoding circuit 45.

That is, when the recycling flag, the segment information and the number information are supplied from the high band decoding circuit 45, the selection unit 161 selects the decoded high band sub-band power estimation coefficient of the frames to be processed based on the recycling flag, the segment information and the number information. For example, when the leading frame of the section to be processed is the frame to be processed and the recycling flag is "1", the decoded high band sub-band power estimation coefficient of frame just before the frame to be processed is selected as the decoded high band sub-band power estimation coefficient of the frame to be processed.

In this case, in consecutive frame segment of the lead of the section to be processed, the decoding high band sub-band estimation coefficient identical with the decoded high band sub-band power estimation coefficient of the frames just before the section to be processed is selected in each frame. In addition, in a consecutive frame segment subsequent to the second frame segment, the decoded high band sub-band power estimation power estimation coefficient of each frame is selected by the same process as in the process of step S516 in FIG. 36, that is, based on the segment information and the number information.

In addition, in this case, the selection unit 161 keeps the decoded high band sub-band power estimation coefficient of the frames just before the section to be processed, which is supplied from the high band decoding circuit 45 prior to starting the decoding processing.

Figure 36:
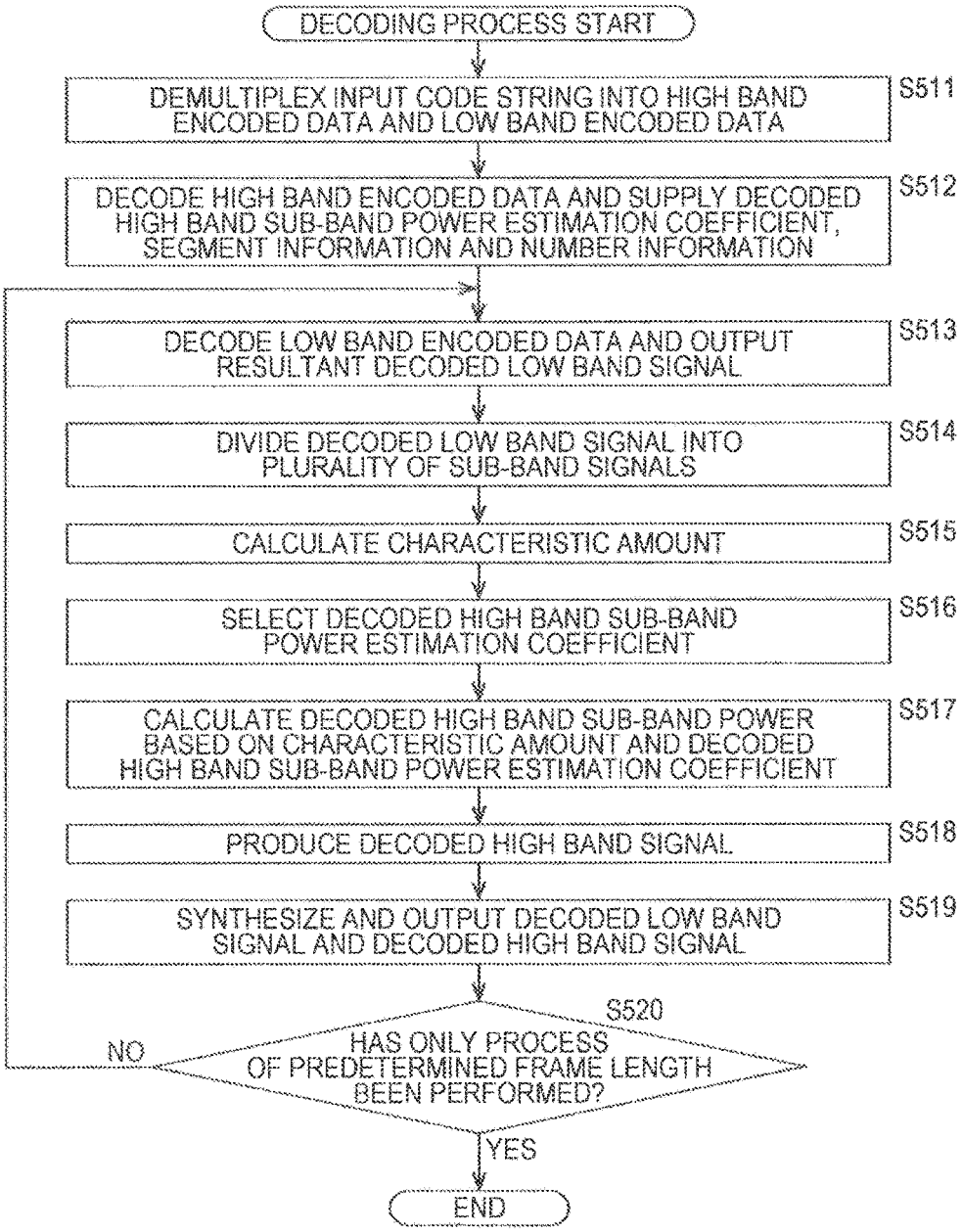
FIG. 36 is a flowchart describing a decoding process.

In addition, when the recycling flag is "0" or the decoded high band sub-band power estimation coefficient, the segment information and the number information are supplied from the high band decoding circuit 45, the same process as step S516 in FIG. 36 is performed and the decoded high band sub-band power estimation coefficient of the frame to be processed is selected.

When the decoded high band sub-band power estimation coefficient of the frames to be processed is selected, after that, the process in step S757 to step S760 is performed to complete the decoding process. However, since the processes are identical with those of step S517 to step S520 in FIG. 36, the description thereof is omitted.

In the processes of step S757 to step S760, the selected decoded high band sub-band power estimation coefficient is used to produce the decoded high band signal of the frame to be processed, and the produced decoded high band signal and the decoded low band signal are synthesized and output.

As described above, as needed, when the high band encoded data including the reuse flag is used, it is possible to obtain the output signal more efficiently from the input code string of less amount of data.

11. Eleventh Embodiment

[Description of Decoding Processing]

Next, a case where the recycling of information is performed as needed and the high band encoded data is produced by the fixed length method will be described. In this case, the encoding process and the decoding process are performed by the encoder 191 in FIG. 38 and decoder 231 in FIG. 40.

As described below, an encoding process by the encoder 191 will be described with reference to a flowchart in FIG. 49. The encoding process is performed for each of the predetermined number of the frames, that is, the section to be processed.

In addition, since the processes of step S791 to step S799 are identical with those of step S551 to step S559 in FIG. 39, the description thereof is omitted. In the processes of step S791 to step S799, each frame constituting the section to be processed is set as a frame to be processed in a sequence and the coefficient index is selected with respect to the frames to be processed.

In step S799, when it is determined that the process of a predetermined frame length only is performed, the process proceeds to step S800.

In step S800, the production unit 201 determines whether the recycling of information is performed. For example, when the mode where the recycling of information is performed by the user is assigned, it is determined that the recycling of information is performed.

In step S800, it is determined that the recycling of information is performed, the process proceeds to step S801.

In step S801, the production unit 201 produces data including the recycling flag, the coefficient index, the fixed length index and the switching flag based on the selection result of the coefficient index of each frame in the section to be processed and supplies the produced data to the high band encoding circuit 37.

For example, in an example in FIG. 37, since the coefficient index of the leading frame of the processing segment is "1", whereas the coefficient index of the frame just before of the frame is "3", the recycling flag is set as "0" without the recycling of the coefficient index. The production unit 201 produces data including the recycling flag "0", the fixed length index "2", the coefficient index "1", "2", "3" and the switching flag "1", "0", "1".

In addition, when the recycling flag is "1", data which does not include the coefficient index of the initial fixed length segment of the section to be processed is produced. For example, in an example in FIG. 37, when the recycling flag of the section to be processed is set as "1", data including the recycling flag, the fixed length index is "2", the coefficient index is "2", "3" and the switching flag is "1", "0", "1" is produced.

In step S802, the high band encoding circuit 37 encodes data including the recycling flag, the coefficient index, the fixed length index and the switching flag supplied from the production unit 201 and produces the high band encoded data. The high band encoding circuit 37 supplies the produced high band encoded data to the multiplexing circuit 38, and after that, the process proceeds to step S805.

Unlike this, in step S800, when it is determined that the recycling of information is not performed, that is, when the mode where the recycling of information is inhibited by user is assigned, the process proceeds to step S803.

In step S803, the production unit 201 produces data including the coefficient index, the fixed length index, and the switching flag based on the selection result of the coefficient index of each frame in the section to be processed and supplies them to the high band encoding circuit 37. In step S803, the same process as step S560 in FIG. 39 is performed.

In step S804, the high band encoding circuit 37 encodes data including the coefficient index, the fixed length index and the switching flag supplied from the production unit 201 and produces the high band encoded signal. The high band encoding circuit 37 supplies the produced high band encoded data to the multiplexing circuit 38 and then the process proceeds to step S805.

In step S802 or step S804, when the high band encoded data is produced, after that, the process of step S805 is performed to terminate the encoding process. However, since these processes are identical with those of step S562 in FIG. 39, the description thereof is omitted.

As described above, when the mode where the recycling of information is performed is designated, it is possible to reduce the encoded amount of the output code string by producing the high band encoded data including the recycling flag and to perform encoding and decoding of sound more efficiently.

[Description of Decoding Process]

Figure 50:
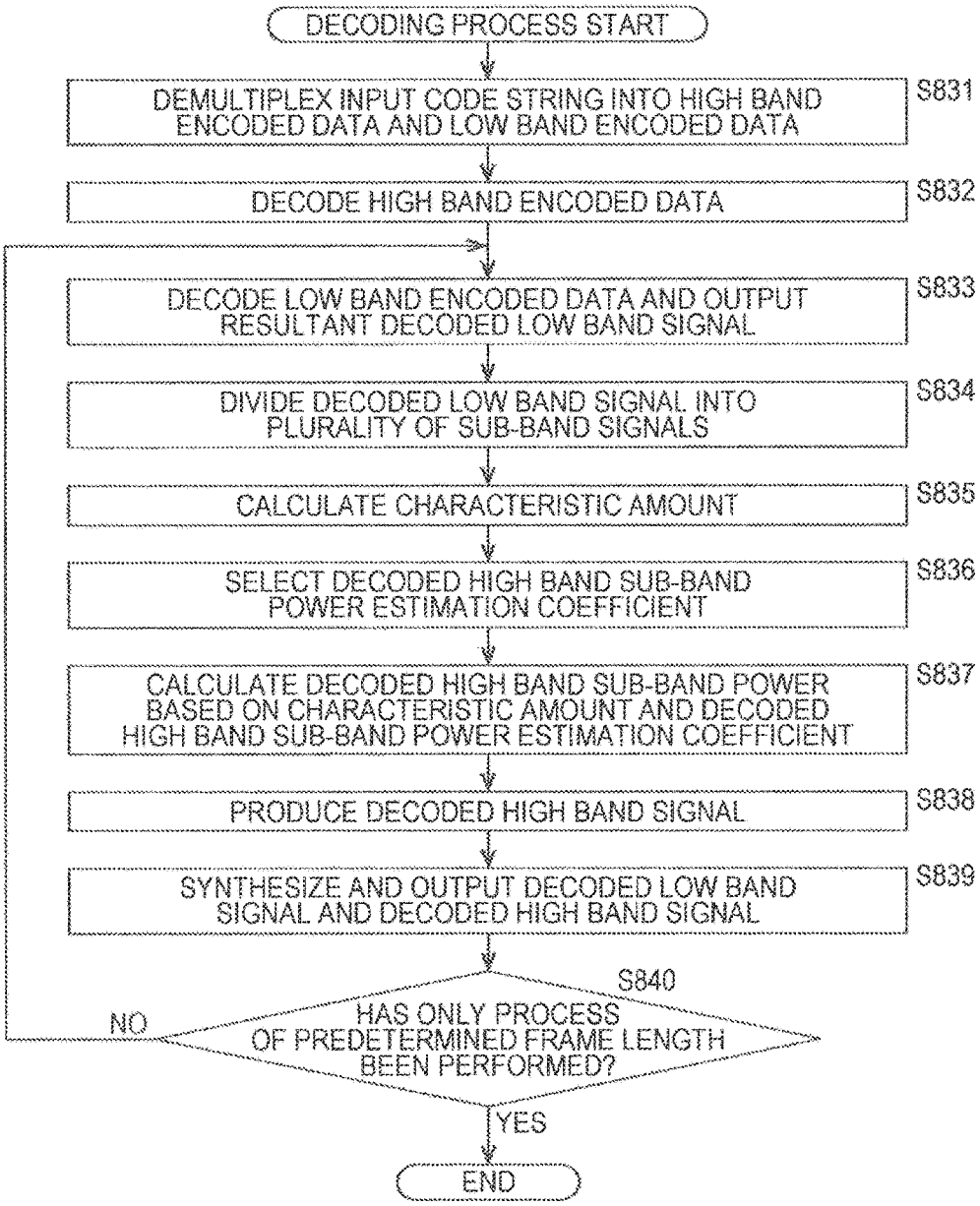
FIG. 50 is a flowchart describing the decoding process.

Next, a decoding process performed by decoder 231 in FIG. 40 will be described with reference to a flowchart in FIG. 50.

Figure 49:
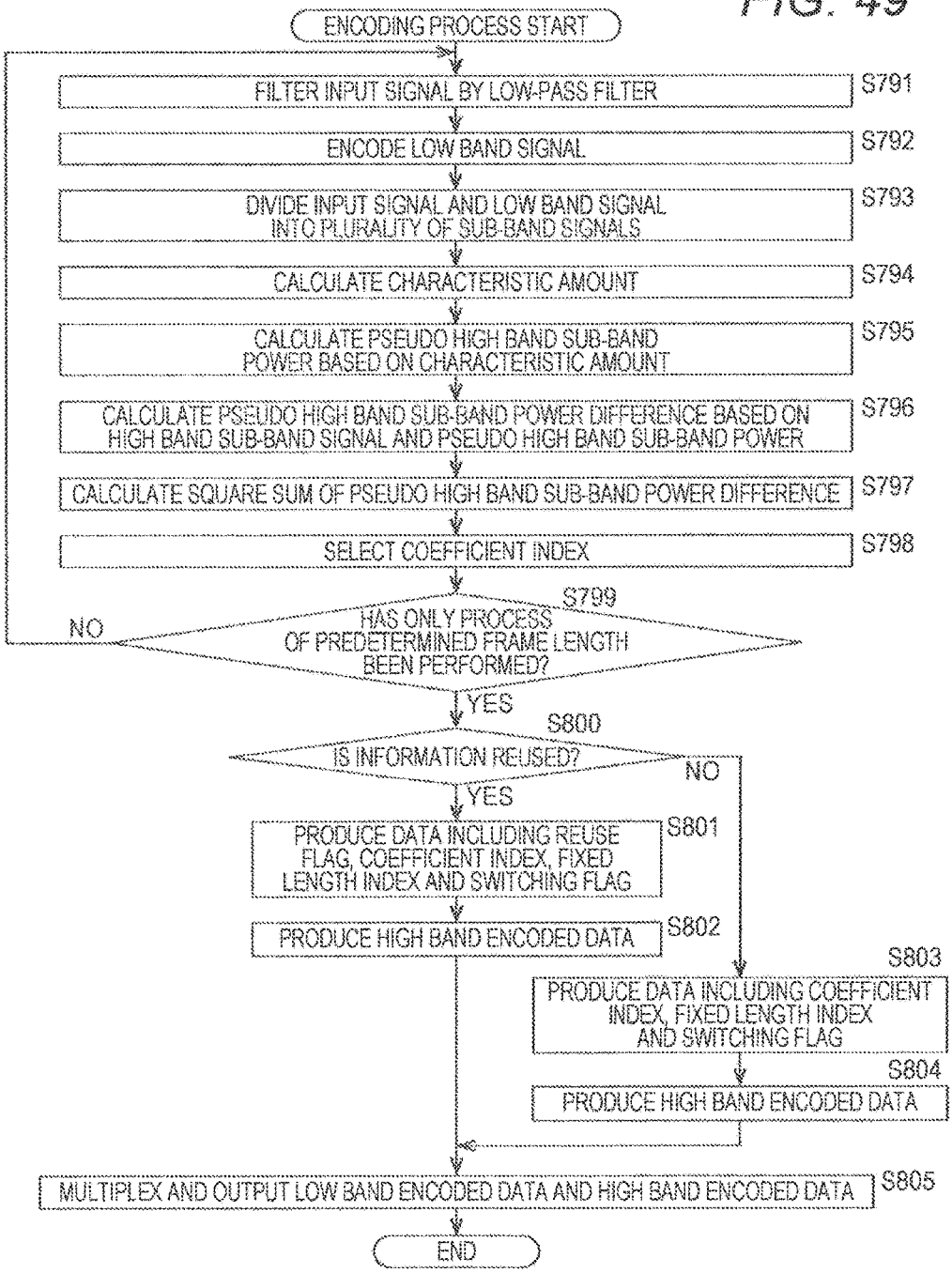
FIG. 49 is a flowchart describing an encoding process.

The decoding process starts when the encoding process described with reference to FIG. 49 is performed and the output code string output from the encoder 191 is supplied to the decoder 231 as the input code string and is performed for each of the predetermined number of the frames, that is, the section to be processed. In addition, since the process of step S831 are identical with those of step S591 in FIG. 41, the description thereof is omitted.

In step S832, the high band decoding circuit 45 performs the decoding of the high band encoded data supplied from the demultiplexing circuit 41 and supplies data obtained from the result and the decoded high band sub-band power estimation coefficient to the selection unit 241 of the decoded high band sub-band power calculation circuit 46.

That is, the high band decoding circuit 45 reads the decoded high band sub-band power estimation coefficient indicated by the coefficient index obtained by decoding of the high band encoded data in the decoded high band sub-band power estimation coefficient that is recorded in advance. In addition, the high band decoding circuit 45 supplies the decoded high band sub-band power estimation coefficient and data obtained by decoding of the high band encoded data to the selection unit 241.

In this case, when the mode where the reuse of information is performed is designated, the decoded high band sub-band power estimation coefficient, the reuse flag, the fixed length index and switching flag are supplied to the selection unit 241. In addition, when the mode where the reuse of information is inhibited, is designated, the decoded high band sub-band power estimation coefficient, the fixed length index and the switching flag is supplied to the selection unit 241.

When high band encoded data is decoded, after that, the process of step S833 to step S835 are performed. However, since the processes are identical with those of step S593 to step S595 in FIG. 41, the description thereof is omitted.

In step S836, the selection unit 241 selects the decoded high band sub-band power estimation coefficient of the frame to be processed from the decoded high band sub-band power estimation coefficient supplied from the high band decoding circuit 45 based on data supplied from the high band decoding circuit 45.

That is, when the reuse flag, the fixed length index and the switching flag is supplied from the high band decoding circuit 45, the selection unit 241 selects the decoded high band sub-band power estimation coefficient of the frames to be processed based on the reuse flag, the fixed length index and the switching flag. For example, when the leading frames of the section to be processed are frames to be processed and the reuse flag is "1", the decoded high band sub-band power estimation coefficient of the frames just before the frame to be processed is selected as the decoded high band sub-band power estimation coefficient of the frame to be processed.

In this case, in the fixed length segment of the lead of the section to be processed, the decoded high band sub-band estimation coefficient which is the same as the decoded high band sub-band power estimation coefficient of the frame just before the section to be processed is selected in each frame. In addition, in a fixed length segment subsequent to the second frame segment, the decoded high band sub-band power estimation coefficient of each frame is selected by the same process as in the process of step S596 in FIG. 41, that is, based on the fixed length index and the switching flag.

In addition, in this case, the selection unit 241 keeps the decoded high band sub-band power estimation coefficient of the frame just before the section to be processed supplied from the high band decoding circuit 45 prior to starting the decoding process.

In addition, when the reuse flag is "0" and the decoded high band sub-band power estimation coefficient, the fixed length index and the switching flag are supplied from the high band decoding circuit 45, the same process as step S596 in FIG. 41 are performed and the decoded high band sub-band power estimation coefficient of the frame to be processed is selected.

When the decoded high band sub-band power estimation coefficient of the frames to be processed is selected, after that, the processes of step S837 to step S840 are performed to complete the decoding process. However, since the processes are identical with those of step S597 to step S600 FIG. 41, the description thereof is omitted.

In the processes of step S837 to step S840, the selected decoded high band sub-band power estimation coefficient is used to produce the decoded high band signal of the frame to be processed and the produced decoded high band signal and the decoded low band signal is synthesized and output.

As described above, as needed, when the high band encoded data in which the reuse flag is included is used, it is possible to obtain the output signal more efficiently from the input code string of less data.

In addition, as described above, as an example where the reuse flag is used by using any one of the variable length system and the fixed length system, a case where the high band encoded data is produced is described. However, even in a case where the system where the encoded amount is small is selected among these systems, the reuse flag may be used.

The serial process described above is performed by a hardware and a software. When a serial process is performed by the software, a program constituted by the software is installed to a computer incorporated into an indicated software or a general-purpose personal computer capable of executing various functions by installing various programs from a program recording medium.

Figure 51:
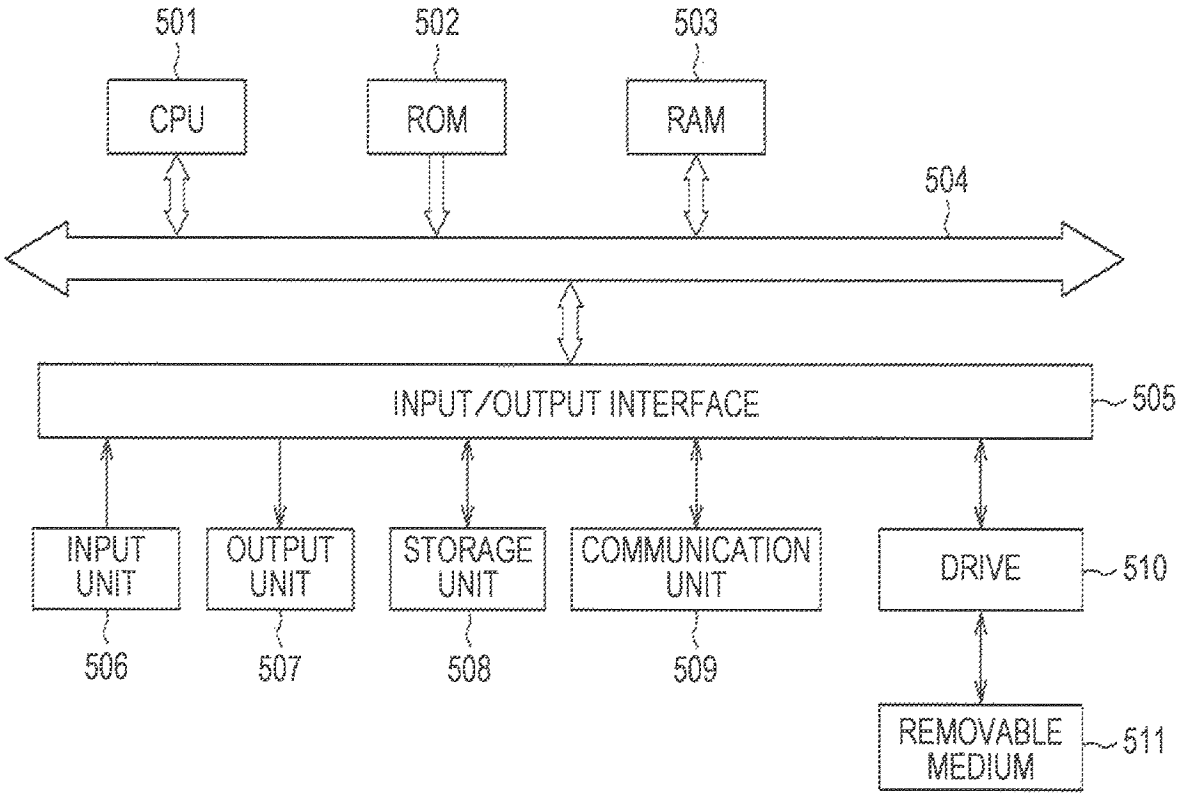
FIG. 51 is a block diagram illustrating a configuration example of hardware of a computer executing a process to which the present invention is applied by a program.

FIG. 51 is block diagram illustrating a configuration example of the hardware of a computer performing a series of processes described above by the computer.

In the computer, a CPU 501, a ROM (Read Only Memory) 502 and a RAM (Random Access Memory) 503 are connected each other by a bus 504.

In addition, an input/output interface 505 is connected to the bus 504. An input unit 506 including a key board, an mouse a microphone and the like, an output unit 507 including a display, a speaker and the like, a storage unit 508 including a hard disk or non-volatile memory and the like, a communication unit 509 including a network interface and the like, and a drive 510 that drives a removable medium 511 of a magnetic disc, an optical disc, a magneto-optical disc and semiconductor memory and the like are connected to the input/output interface 505.

In the computer configured as described above, for example, the CPU 501 loads and executes the program stored in the storage unit 508 to the RAM 503 via the input/output interface 505 and the bus 504 to perform a series of processes described above.

The program to be executed by the computer (CPU 501), for example, is recorded in a removable medium 511 such as a package medium including a magnetic disk, (including a flexible disc), an optical disc ((CD-ROM (Compact Disc-Read Only Memory)), DVD (Digital Versatile Disc) and the like), a magneto-optical disc or a semiconductor memory, or is provided via a wire or wireless transmission medium including a local area network, an internet and a digital satellite broadcasting.

In addition, the program can be installed to the storage unit 508 via the input/output interface 505 by mounting the removable medium 511 to the drive 510. In addition, the program is received in the communication unit 509 via the wire or wireless transmission medium and can be installed to the storage unit 508. In addition, the program can be installed in the ROM 502 or the storage unit 508 in advance.

In addition, the program performed by the computer may be a program where the process is performed in time sequence according the sequence described in the specification and a program where the process is performed in parallel or in timing necessary when a call is made.

In addition, the embodiment of the present invention is not limited the embodiment described above and various modifications is possible within a scope apart from a gist of the present invention.

REFERENCE SIGNS LIST

10 Frequency Band Expansion Apparatus
11 Low-pass filter
12 Delay Circuit
13, 13-1 to 13-N Band Pass Filter
14 Characteristic Amount Calculation Circuit
15 High Band Sub-Band Power Estimation Circuit
16 High Band Signal Production Circuit
17 High-pass filter
18 Signal Adder
20 Coefficient Learning Apparatus
21, 21-1 to 21-(K+N) Band Pass Filter
22 High Band Sub-Band Power Calculation Circuit
23 Characteristic Amount Calculation Circuit
24 Coefficient Estimation Circuit
30 Encoder
31 Low-pass filter
32 Low Band Encoding Circuit
33 Sub-Band Division Circuit
34 Characteristic Amount Calculation Circuit
35 Pseudo High Band Sub-Band Power Calculation Circuit
36 Pseudo High Band Sub-band Power Difference Calculation Circuit
37 High Band Encoding Circuit
38 Multiplexing Circuit

40 Decoder
41 Demultiplexing Circuit
42 Low Band Decoding Circuit
43 Sub-Band Division Circuit
44 Characteristic Amount Calculation Circuit
45 High Band Decoding Circuit
46 Decoded High Band Sub-Band Power Calculation Circuit
47 Decoded High Band Signal Production Circuit
48 Synthesis circuit
50 Coefficient Learning Apparatus
51 Low-pass filter
52 Sub-Band Division Circuit
53 Characteristic Amount Calculation Circuit
54 Pseudo High Band Sub-Band Power Calculation Circuit
55 Pseudo High Band Sub-Band Power Difference Calculation Circuit
56 Pseudo High Band Sub-Band Power Difference Clustering Circuit
57 Coefficient Estimation Circuit
101 CPU
102 ROM
103 RAM
104 Bus
105 Input/Output Interface
106 Input Unit
107 Output Unit
108 Storage Unit
109 Communication Unit
110 Drive
111 Removable Medium

The invention claimed is:

1. A decoder comprising:

a demultiplexing circuit configured to demultiplex input encoded data into high band encoded data and low band encoded data, wherein the high band encoded data includes segment information for segments, wherein each of the segments includes a plurality of frames associated with a same coefficient, wherein the segment information includes information of a number of segments, a length of each segment, and coefficient information for the plurality of frames;

a low band decoding circuit configured to decode the low band encoded data to produce a low band signal;

a selection circuit configured to select a coefficient from a plurality of the coefficients specified in the coefficient information included in the high band encoded data;

a high band sub-band power calculation circuit configured to calculate a high band sub-band power of a high band sub-band signal based on a low band sub-band signal of a plurality of sub-bands constituting the low band signal and the selected coefficient; and a high band signal production circuit configured to produce a high band signal based on the high band sub-band power and the low band sub-band signal.

2. A method of decoding, the method comprising:

demultiplexing input encoded data into high band encoded data and low band encoded data, wherein the high band encoded data includes segment information for segments, wherein each of the segments includes a plurality of frames associated with a same coefficient, wherein the segment information includes information of a number of segments, a length of each segment, and coefficient information for the plurality of frames;

decoding the low band encoded data to produce a low band signal;

selecting a coefficient from a plurality of the coefficients specified in the coefficient information included in the high band encoded data;

calculating a high band sub-band power of a high band sub-band signal based on a low band sub-band signal of a plurality of sub-bands constituting the low band signal and the selected coefficient; and producing a high band signal based on the high band sub-band power and the low band sub-band signal.

* * * * *